US008087654B2

(12) United States Patent
Awano et al.

(10) Patent No.: US 8,087,654 B2
(45) Date of Patent: Jan. 3, 2012

(54) POST-PROCESSING DEVICE

(75) Inventors: Hiroaki Awano, Kanagawa (JP); Toshio Endo, Kanagawa (JP); Tetsuya Fujita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 268 days.

(21) Appl. No.: 12/350,623

(22) Filed: Jan. 8, 2009

(65) Prior Publication Data

US 2009/0179373 A1 Jul. 16, 2009

(30) Foreign Application Priority Data

Jan. 10, 2008 (JP) ..... P2008-003692

(51) Int. Cl.
*B65H 37/04* (2006.01)

(52) U.S. Cl. ..... 270/58.11; 270/58.07; 270/58.08; 270/58.09; 270/58.12; 270/58.17

(58) Field of Classification Search ..... 270/58.07, 270/58.08, 58.09, 58.11, 58.12, 58.17, 58.27
See application file for complete search history.

(56) References Cited

U.S. PATENT DOCUMENTS

| | | | | |
|---|---|---|---|---|
| 5,263,697 | A * | 11/1993 | Yamazaki et al. | 270/58.08 |
| 5,709,376 | A | 1/1998 | Ushirogata et al. | |
| 5,772,198 | A * | 6/1998 | Yamamoto | 270/58.12 |
| 5,944,302 | A | 8/1999 | Loc et al. | |
| 6,283,354 | B1 * | 9/2001 | Hirota et al. | 227/39 |
| 6,371,472 | B1 * | 4/2002 | Miyake et al. | 270/58.14 |
| 6,942,206 | B2 * | 9/2005 | Kuwata et al. | 270/58.08 |
| 6,991,225 | B2 * | 1/2006 | Miyake et al. | 270/58.09 |
| 7,077,393 | B2 | 7/2006 | Ishida et al. | |
| 7,300,052 | B2 * | 11/2007 | Tamura et al. | 271/221 |
| 7,448,615 | B2 * | 11/2008 | Takamura | 271/176 |
| 2005/0067748 | A1 | 3/2005 | Fujii et al. | 270/58.08 |
| 2006/0071410 | A1 | 4/2006 | Koie | |
| 2007/0138729 | A1 * | 6/2007 | Terao et al. | 270/58.09 |
| 2007/0138731 | A1 * | 6/2007 | Terao et al. | 270/58.12 |
| 2008/0296833 | A1 | 12/2008 | Fujii et al. | 271/207 |

FOREIGN PATENT DOCUMENTS

| | | |
|---|---|---|
| JP | 07-049082 | 2/1995 |
| JP | 07-300270 | 11/1995 |
| JP | 08-081111 | 3/1996 |
| JP | 08-108965 | 4/1996 |
| JP | 08-192951 | 7/1996 |
| JP | 09-058924 | 3/1997 |
| JP | 2003-089463 | 3/2003 |
| JP | 3440166 B | 6/2003 |

(Continued)

*Primary Examiner* — Leslie A Nicholson, III
(74) *Attorney, Agent, or Firm* — Morgan, Lewis & Bockius LLP

(57) ABSTRACT

A post-processing device include a conveyed medium stacking portion, a medium bundle stapling member, a medium bundle stacking portion and a medium bundle stacking control unit. A plurality of recording mediums, on which images are recorded, are conveyed and stacked into the conveyed medium stacking portion. The medium bundle stapling member staples a medium bundle, which is a bundle of the plurality of recording mediums stacked on the conveyed medium stacking portion, with staples. The stapled medium bundle is conveyed and stacked into the medium bundle stacking portion. The medium bundle stacking control unit stacks a second medium bundle on a first medium bundle under the condition that a second stacking stapling position deviates from a first stacking stapling position in a width direction by a distance not less than a staple width.

10 Claims, 38 Drawing Sheets

FOREIGN PATENT DOCUMENTS

| | | |
|---|---|---|
| JP | 2005-104676 | 4/2005 |
| JP | 3956874 B | 5/2005 |
| JP | 2006-069747 | 3/2006 |
| JP | 2006-69748 | 3/2006 |
| JP | 2007-084159 | 4/2007 |
| JP | 3991891 B | 8/2007 |

* cited by examiner

FLOW CHART OF MEDIUM BUNDLE STACKING CONTROL PROCESSING AT THE TIME OF SADDLE STAPLING OF EXAMPLE 1

FLOW CHART OF MEDIUM BUNDLE STACKING CONTROL PROCESSING AT THE TIME OF SADDLE STAPLING OF EXAMPLE 2

POST-PROCESSING DEVICE

CROSS-REFERENCE TO RELATED APPLICATIONS

This application is based on and claims priority under 35 USC 119 from Japanese Patent Application No. 2008-003692 filed Jan. 10, 2008.

BACKGROUND

1. Technical Field

The present invention relates to an post-processing device.

2. Related Art

An post-processing device is known which stacks and arranges sheets of paper, on which images are recorded, on a compile tray, folds a bundle of recording sheets arranged on the compile tray, staples the bundle of recording sheets by a stapler and discharges the bundle of recording sheets onto a stacker tray.

SUMMARY post-processing device include a conveyed medium stacking portion, a medium bundle stapling member, a medium bundle stacking portion and a medium bundle stacking control unit. A plurality of recording mediums, on which images are recorded, are conveyed and stacked into the conveyed medium stacking portion. The medium bundle stapling member staples a medium bundle, which is a bundle of the plurality of recording mediums stacked on the conveyed medium stacking portion, with staples. The stapled medium bundle is conveyed and stacked into the medium bundle stacking portion. The medium bundle stacking control unit stacks a second medium bundle on a first medium bundle under the condition that a second stacking stapling position deviates from a first stacking stapling position in a width direction by a distance not less than a staple width. The first medium bundle indicates the medium bundle stacked in the medium bundle stacking portion. The second medium bundle indicates the medium bundle conveyed to and stacked on the medium bundle stacking portion after the first medium bundle is the second medium bundle. The first stacking stapling position indicates a position of the staple in the first medium bundle stacked in the medium bundle stacking portion. The second stacking stapling position indicates a position of the staple in the second medium bundle stacked in the medium bundle stacking portion. The staple width indicates a width of the staple in the width direction of the medium bundle perpendicular to a conveyance direction of the medium bundle.

BRIEF DESCRIPTION OF THE DRAWINGS

Exemplary embodiments of the present invention will be described in detail based on the following figures, wherein:

FIG. 7A is a schematic illustration for explaining a main paddle, FIG. 7B is a schematic illustration for explaining a conic paddle and FIG. 7C is a schematic illustration for explaining a rotary brush.

FIG. 8A is a plan view and FIG. 8B is a view taken in the direction of the arrow VIIIB of FIG. 8A;

FIG. 13 is a so-called block diagram;

FIG. 16A is a schematic illustration for explaining a case in which the second medium bundle is stacked on the first medium bundle in the post-processing device of Example 1 and FIG. 16B is a schematic illustration for explaining a case in which the second medium bundle is stacked on the first medium bundle in the conventional post-processing device;

FIG. 17 is a so-called block diagram. And FIG. 17 is a schematic illustration corresponding to FIG. 13 of Example 1;

FIG. 22 is a schematic illustration for explaining a case in which the second medium bundle is stacked on the first medium bundle.

DETAILED DESCRIPTION

Figure 1:
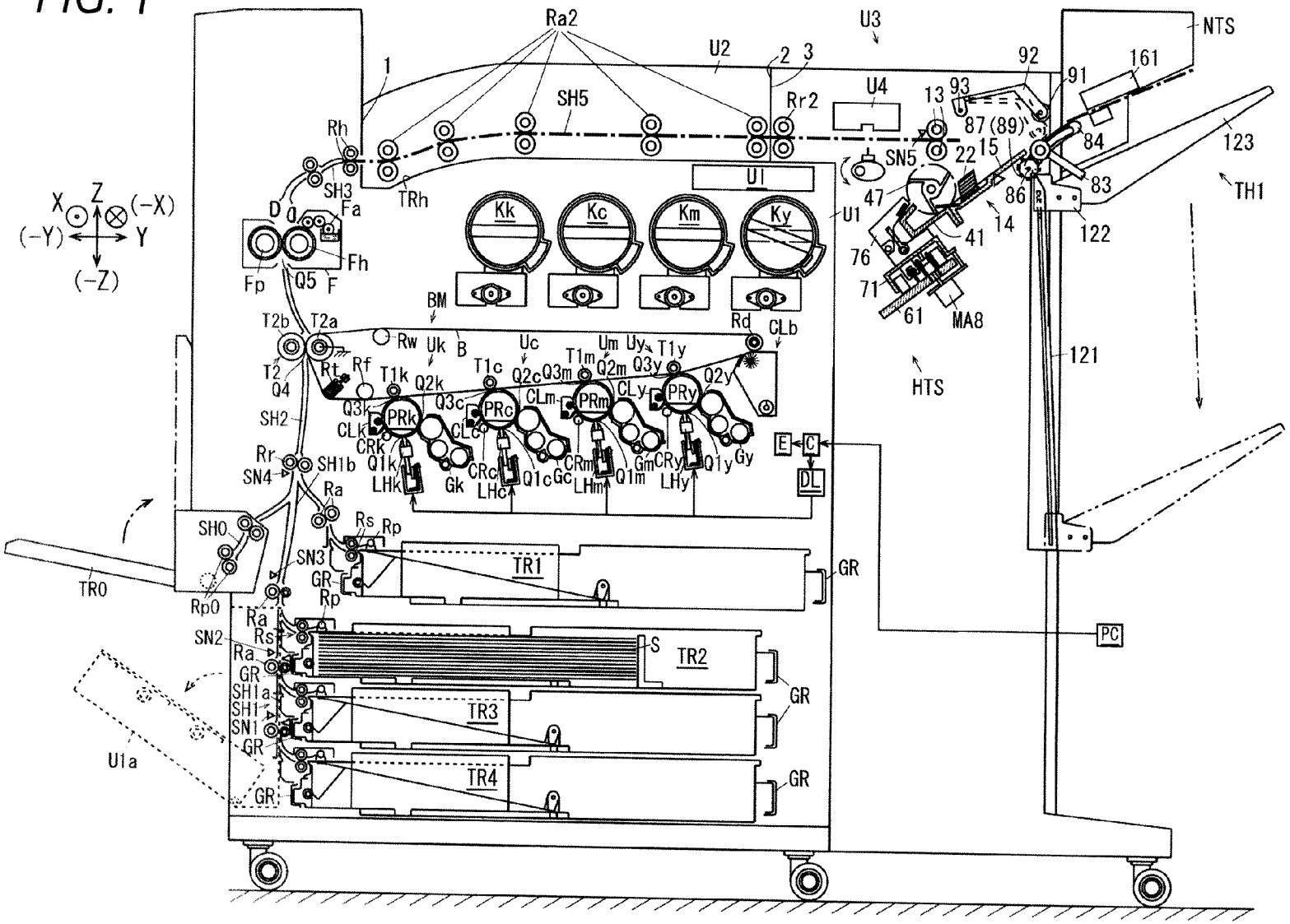
FIG. 1 is an overall schematic illustration of the image forming apparatus of Example 1 of the present invention.

Next, referring to the drawings, a specific example of the exemplary embodiment of the present invention, which will be described as an example hereinafter, will be explained below. However, it should be noted that the present invention is not limited to the following examples.

In this connection, in order to facilitate the understanding of the following explanations, the terminology is defined as follows. In the drawings, the longitudinal direction is a direction of X-axis, the lateral direction is a direction of Y-axis, and the vertical direction is a direction of Z-axis. Directions shown by the arrows X, −X, Y, −Y, Z and −Z are respectively the front, the rear, the right, the left, the upper and the lower. Sides shown by the arrows X, −X, Y, −Y, Z and −Z are respectively the front side, the rear side, the right side, the left side, the upper side and the lower side.

In the drawings, the mark, in which "●" is described in "○", means an arrow which directs from a reverse side to a surface side of the sheet of paper. The mark, in which "×" is described in "○", means an arrow which directs from a surface side to a reverse side of the sheet of paper.

In this connection, in order to facilitate the understanding in the following explanations in which the drawings are used, illustrations of the components, which are not necessary for the explanations, are appropriately omitted.

EXAMPLE 1

FIG. 1 is an overall arrangement view of the image forming apparatus of Example 1 of the present invention.

In FIG. 1, the printer U, which is an example of the image forming apparatus of Example 1 of the present invention, includes an image forming apparatus body U1. Image information, which is transmitted from the information processing device PC of an example of the image information transmitting device electrically connected to the printer U, is inputted into the control portion C. The image information inputted into the control portion C is converted into image information of yellow Y, magenta M, cyan C and black K, which are used for forming a latent image at a predetermined time, and then outputted to the latent image forming device drive circuit DL.

In this connection, in the case where a document image is a monochromatic image, the image information of only black K is inputted into the latent image forming apparatus drive circuit DL.

The latent image forming apparatus drive circuit DL includes drive circuits not shown of the colors Y, M, C and K and outputs signals corresponding to the inputted image information to the latent image forming devices LHy, LHm, LHc, LHk arranged for each color.

Figure 2:
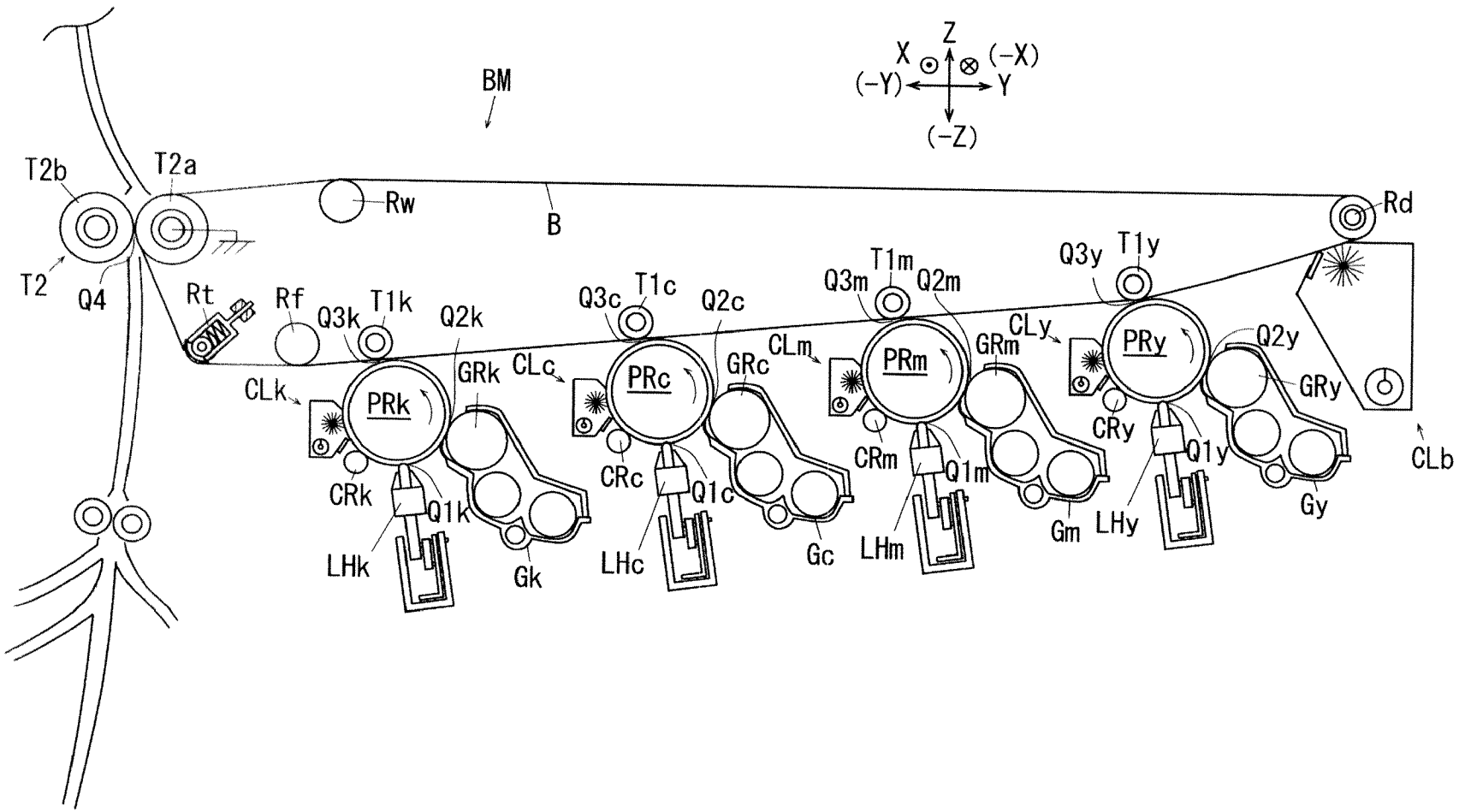
FIG. 2 is an enlarge schematic illustration showing a primary portion of the image forming apparatus of Example 1 of the present invention.

FIG. 2 is an enlarged schematic illustration showing a primary portion of the image forming apparatus of Example 1.

In FIGS. 1 and 2, the visible image forming apparatus Uy, Um, Uc, Uk, which are arranged in a central portion in the gravity direction of the printer U, are apparatus for respectively forming visible images of the colors Y, M, C and K.

Latent image writing light Ly, Lm, Lc, Lk of colors Y, M, C, K, which are emergent from the latent image writing light sources of the latent image forming devices LHy to LHk, are respectively incident upon the rotating image holding bodies PRy, PRm, PRc, PRk. In this connection, in Example 1, the latent image forming devices LHy to LHk are formed out of arrays of LED.

The visible image forming apparatus Uy of color Y includes: a rotating image holding body PRy, a charger CRy, a latent image forming device LHy, a developing device Gy, a primary transfer device T1*y* and an image holding body cleaning device CLy. In this connection, in Example, 1, the image holding body PRy, the charger CRy and the image holding body cleaning device CLy are formed into an image holding body unit which is capable of being detachably, integrally attached to the image forming apparatus body U1.

The visible image forming apparatus Um, Uc, Uk are composed in the same manner as that of the visible image forming apparatus Uy of color Y described before.

In FIGS. 1 and 2, after the image holding bodies PRy, PRm, PRc, PRk have been electrically charged by the respective chargers CRy, CRm, CRc, CRk, at the image writing positions Q1*y*, Q1*m*, Q1*c*, Q1*k*, electrostatic latent images are formed on the respective surfaces of the image holding bodies PRy, PRm, PRc, PRk by the latent image writing light Ly, Lm, Lc, Lk at the image writing positions Q1*y*, Q1*m*, Q1*c*, Q1*k*. The electrostatic latent images formed on the surfaces of the image holding bodies PRy, PRm, PRc, PRk are developed into toner images by the developing agent held on the developing rollers GRy, GRm, GRc, GRk, which are an example of the developing agent holding bodies of the developing devices Gy, Gm, Gc, Gk, in the developing regions Q2*y*, Q2*m*, Q2*c*, Q2*k*.

The developed toner images are conveyed to the primary transfer regions Q3*y*, Q3*m*, Q3*c*, Q3*k* coming into contact with the intermediate transfer belt B which is an example of the intermediate transfer body. To the primary transfer devices T1*y*, T1*m*, T1*c*, T1*k* arranged on the reverse side of the intermediate transfer belt B in the primary transfer regions Q3*y*, Q3*m*, Q3*c*, Q3*k*, the primary transfer voltage, the polarity of which is inverse to the toner charging polarity is applied at the predetermined time from the electric power source circuit E controlled by the control portion C.

Toner images formed on the image holding bodies PRy to PRk are primarily transferred onto the intermediate belt B by the primary transfer devices T1*y*, T1*m*, T1*c*, T1*k*. Objects remaining and attaching onto the surfaces of the image holding bodies PRy, PRm, PRc, PRk after the completion of the primary transfer are cleaned by the image holding body cleaning devices CLy, CLm, CLc, CLk. Surfaces of the image holding bodies PRy, PRm, PRc, PRk are charged again by the chargers CRy, CRm, CRc, CRk.

Above the image holding bodies PRy to PRk, the belt module BM, which is an example of the intermediate transfer device capable of being moved in the vertical direction and also capable of being drawn out to the front, is arranged. The belt module BM includes: an intermediate transfer belt B; a belt drive roller Rd which is an example of the intermediate transfer body drive member; a tension roller Rt which is an example of the intermediate transfer body stretching member; a walking roller Rw which is an example of the snaking prevention member; an idler roller Rf which is an example of the driven member; a backup roller T2*a* which is an example of the secondary transfer region opposing member; and primary transfer devices T1*y*, T1*m*, T1*c*, T1*k*. The intermediate transfer belt B is supported by the belt supporting rollers Rd, Rt, Rw, Rf, T2*a*, which are an example of the intermediate transfer supporting member formed out of the rollers Rd, Rt, Rw, Rf T2*a*, in such a manner that the intermediate transfer belt B can be rotated and moved.

The secondary transfer roller T2*b*, which is an example of the secondary transfer member, is arranged being opposed to a surface of the intermediate transfer belt B coming into contact with the backup roller T2*a*. The secondary transfer device T12 includes the rollers T2*a*, T2*b*. In a region in which the secondary transfer roller T2*b* and the intermediate transfer belt B are opposed to each other, the secondary transfer region Q4 is formed.

A monochromatic toner image or a multiple color toner image, which is transferred onto the intermediate transfer belt B being superimposed in order by the primary transfer devices T1*y*, T1*m*, T1*c*, T1*k* in the primary transfer regions Q3*y*, Q3*m*, Q3*c*, Q3*k*, is conveyed to the secondary transfer region Q4.

The transfer devices T1+T2+B are formed out of the primary transfer devices T1*y* to T1*k*, the intermediate transfer belt B and the secondary transfer device T2.

Below the visible image forming devices Uy to Uk, pairs of guide rails GR are arranged in four stages. By the guide rails GR, the sheet feeding trays TR1 to TR4, which are an example of the sheet feeding container, are supported so that the sheet feeding trays TR1 to TR4 can be taken in and out in the longitudinal direction. The recording sheets S, which are an example of the mediums accommodated in the sheet feeding trays TR1 to TR4, are picked up by the pickup rollers Rp which are an example of the feeding member. Then, the recording sheets S are separated from each other by the managing roller Rs which is an example of the medium managing member. Then, the recording sheet S is conveyed by a plurality of conveyance rollers Ra which are an example of the conveyance member. After that, the recording sheet S is sent to the register roller Rr which is an example of the transfer region conveyance time adjusting member arranged on the upstream side in the sheet conveyance direction of the secondary transfer region Q4.

The sheet feeding device Rp+Rs of Example 1 includes the pickup roller Rp and the managing Rs described above.

On the left of the sheet feeding tray TR1 in the uppermost stage, the hand-feed tray TRO, which is an example of the hand-feed sheet feeding portion, is arranged. The recording sheet S supported by the hand-feed tray TRO is fed by the hand-feed roller RpO, which is an example of the hand-feed member, and conveyed in the hand-feed conveyance passage SHO and sent to the register roller Rr.

The register roller Rr conveys the recording sheet S to the main conveyance passage SH2, which is an example of the conveyance passage on the downstream side of the sheet feeding passage SH1, synchronously with the conveyance of the toner image, which is formed on the intermediate transfer belt B, to the secondary transfer region Q4. In this way, the recording sheet S is conveyed to the secondary transfer region Q4. When the recording sheet S passes through the secondary transfer region Q4, the backup roller T2*a* is grounded and the secondary transfer voltage, the polarity of which is inverse to the toner charging polarity, is applied to the secondary transfer device T2*b* by the power supply source circuit E controlled by the control portion C. At this time, the toner image formed on the intermediate transfer belt B is transferred onto the recording sheet S by the secondary transfer device T2.

After the completion of the secondary transfer, the intermediate transfer belt B is cleaned by the belt cleaner CLb which is an example of the intermediate transfer body cleaner.

The recording sheet S, onto which the toner image is secondarily transferred, is conveyed to the heating roller Fh, which is an example of the fixing member for heating of the fixing device F and also conveyed to the fixing region Q5 which is a pressure contacting region of the pressure roller Fp which is an example of the fixing member for heating. When the recording sheet passes through the fixing region, the recorded image is heated and fixed. In this connection, on a surface of the heating roller Fh, a mold releasing agent is coated by the mold releasing agent coating device Fa so that the recording sheet S can be easily released from the heating roller.

In an upper portion which is the downstream side in the conveyance direction of the fixing device F, the sheet discharging passage SH3, which is an example of the conveyance passage for conveying the recording sheet S to the discharging sheet tray TRh which is an example of the medium discharging portion, is arranged. Accordingly, in the case where the recording sheet S is conveyed to the discharging sheet tray TRh, the fixed recording sheet S is conveyed in the discharging sheet passage SH3 and conveyed by the sheet discharging roller Rh.

In FIG. 1, the first sheet feeding passage sensor SN1, the second sheet feeding passage sensor SN2, the third sheet feeding passage sensor SN3 and the fourth sheet feeding passage sensor SN4, which are an example of the medium detecting member and detect the recording sheet S fed from the sheet feeding trays TR1 to TR4, are arranged in the sheet feeding passage SH1.

The conveyance passages SH1 to SH4 compose the conveyance passage SH of Example 1. The conveyance passage SH, the sheet feeding device Rp+Rs, the sheet conveyance roller Ra, the register roller Rr and the sheet discharging roller Rh compose the medium conveyance device SH+Ra to Rh.

In Example 1 shown in FIG. 1, on the left of the lower three stages of the sheet feeding trays TR2 to TR4, the lower cover U1*a*, which is an example of the upstream side opening member, is supported capable of being opened and closed between the normal position shown by a solid line in FIG. 1 and the open position shown by a broken line in FIG. 1. The lower cover U1*a* supports a guide on the left of the sheet feeding passage SH1 on the left of the sheet feeding trays TR2 to TR4 and also supports the outside of a pair of conveyance rollers Ra. Accordingly, when the lower cover U1*a* is moved to the opening position, a lower portion of the sheet feeding passage SH1, that is, the upstream side sheet feeding passage SH1*a* on the upstream side in the conveyance direction is opened.

(Explanations of Sheet Conveyance Unit U2)

In FIG. 1, the printer U of Example 1 includes a sheet conveyance unit U2 which is an example of the recorded medium conveyance device supported by the discharging sheet tray TRh. In the sheet conveyance unit U2 of Example 1, on one side connected to the image forming apparatus body U1, the sheet carry-in port 1, through which the recording sheet S discharged from the sheet discharging roller Rh is carried in, is provided. The recording sheet S carried in from the carry-in port 1 is conveyed in the conveyance passage SH5 for connection by the recorded medium conveyance roller Ra2 which is an example of the recorded medium conveyance member provided in the sheet conveyance unit U2. After that, the recording sheet S is discharged from the sheet discharging port 2 provided on the other side of the sheet conveyance unit U2.

(Explanations of Post-processing Device U3)

Figure 3:
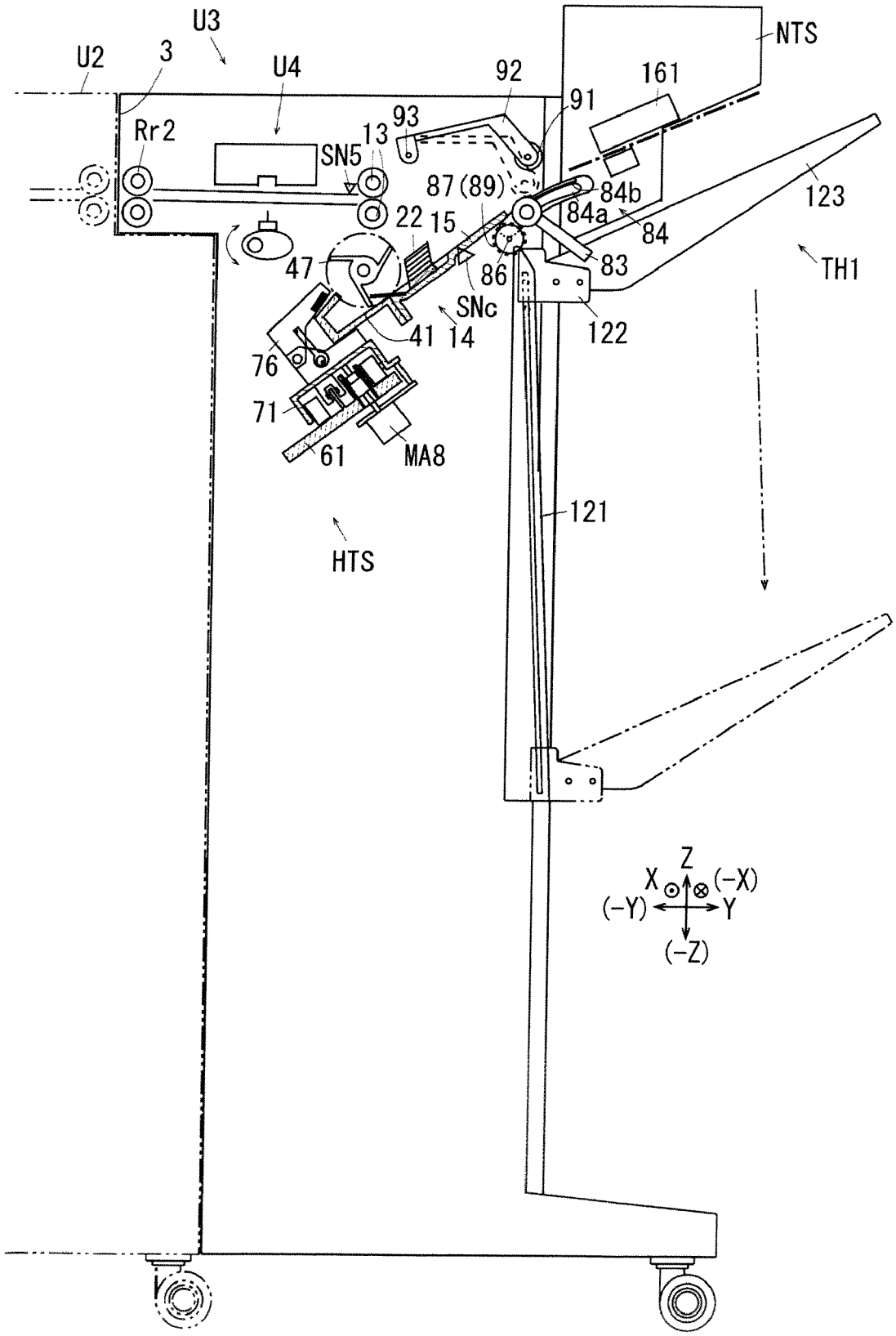
FIG. 3 is an enlarged view showing a primary portion of the post-processing device of Example 1 of the present invention and a schematic illustration showing a movement in the vertical direction of the discharging clamp roller.

FIG. 3 is an enlarged view of a primary portion of the post-processing device of Example 1 of the present invention. That is, FIG. 3 is a schematic illustration showing a vertical movement of the clamp roller for discharging.

Figure 4:
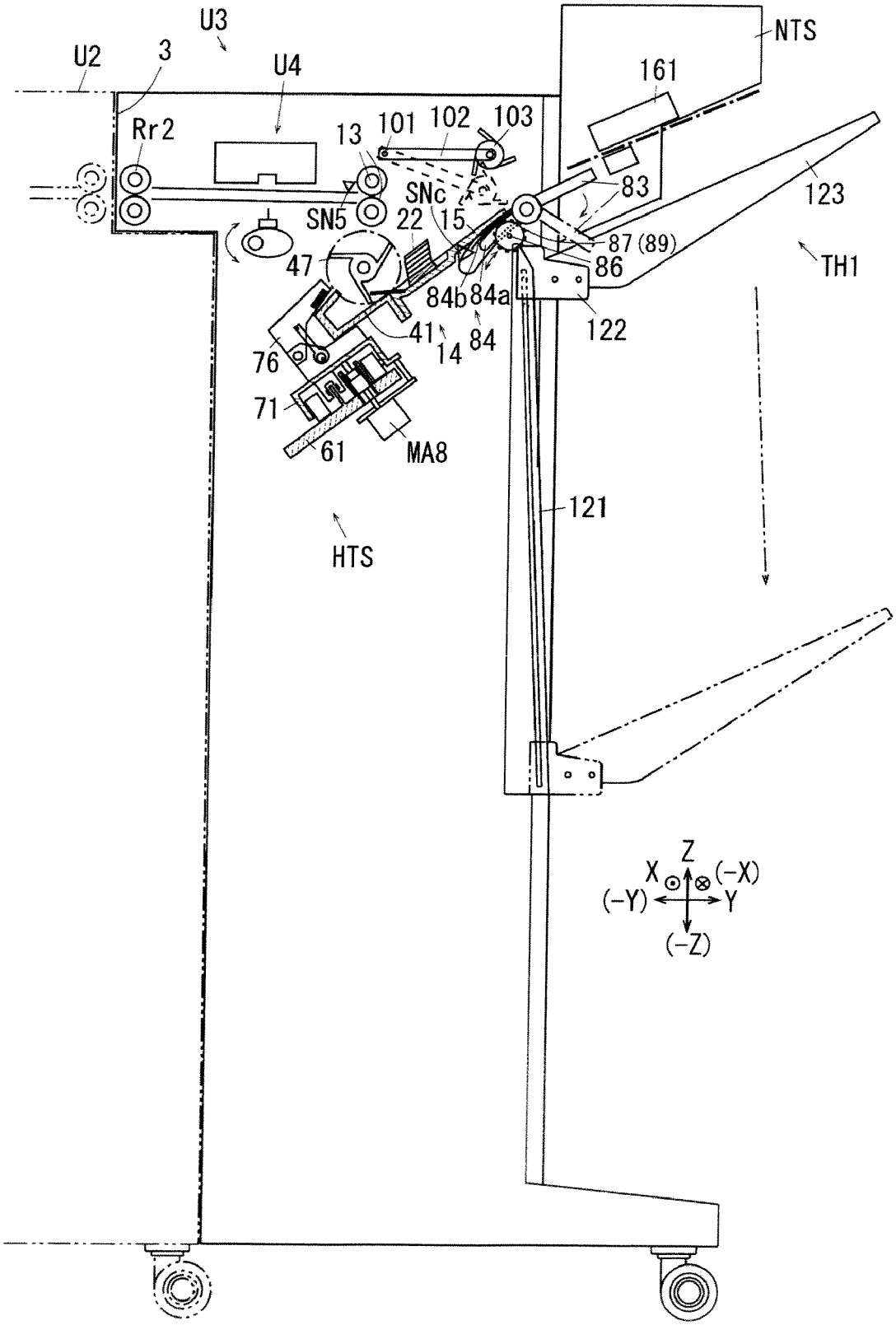
FIG. 4 is an enlarged view showing a primary portion of the post-processing device of Example 1 of the present invention and a schematic illustration showing a movement in the vertical direction of the sub-paddle.

FIG. 4 is an enlarged view of a primary portion of the post-processing device of Example 1 of the present invention. That is, FIG. 4 is a schematic illustration showing a vertical movement of the sub-paddle.

In FIGS. 1, 3 and 4, the printer U of Example 1 includes a post-processing device U3, which is connected to the sheet conveyance unit U2, for executing a so-called post-processing on the recording sheet S discharged from the sheet discharging port 2. In the post-processing device U3 of Example 1, on one side connected to the sheet conveyance unit U2, the sheet carry-in port 3 for carrying in the recording sheet S, on which an image is formed by the image forming apparatus U1, is provided. In the sheet carry-in port 3, the register roller Rr2 for making a fold is arranged. On the downstream side in the conveyance direction of the register roller Rr2 for making a fold, the fold making unit U4 for making a fold on the recording sheet S, on which an image has already been formed, is arranged. The register roller Rr2 for making a fold of Example 2 conveys the recording sheet S to the fold making unit U4 at an appropriate timing of making a fold on the recording sheet S by the fold making unit U4. In this connection, the fold making unit U4 is known. Therefore, the detailed explanations are omitted here.

(Explanations of Edge Stapling Device HTS)

Figure 5:
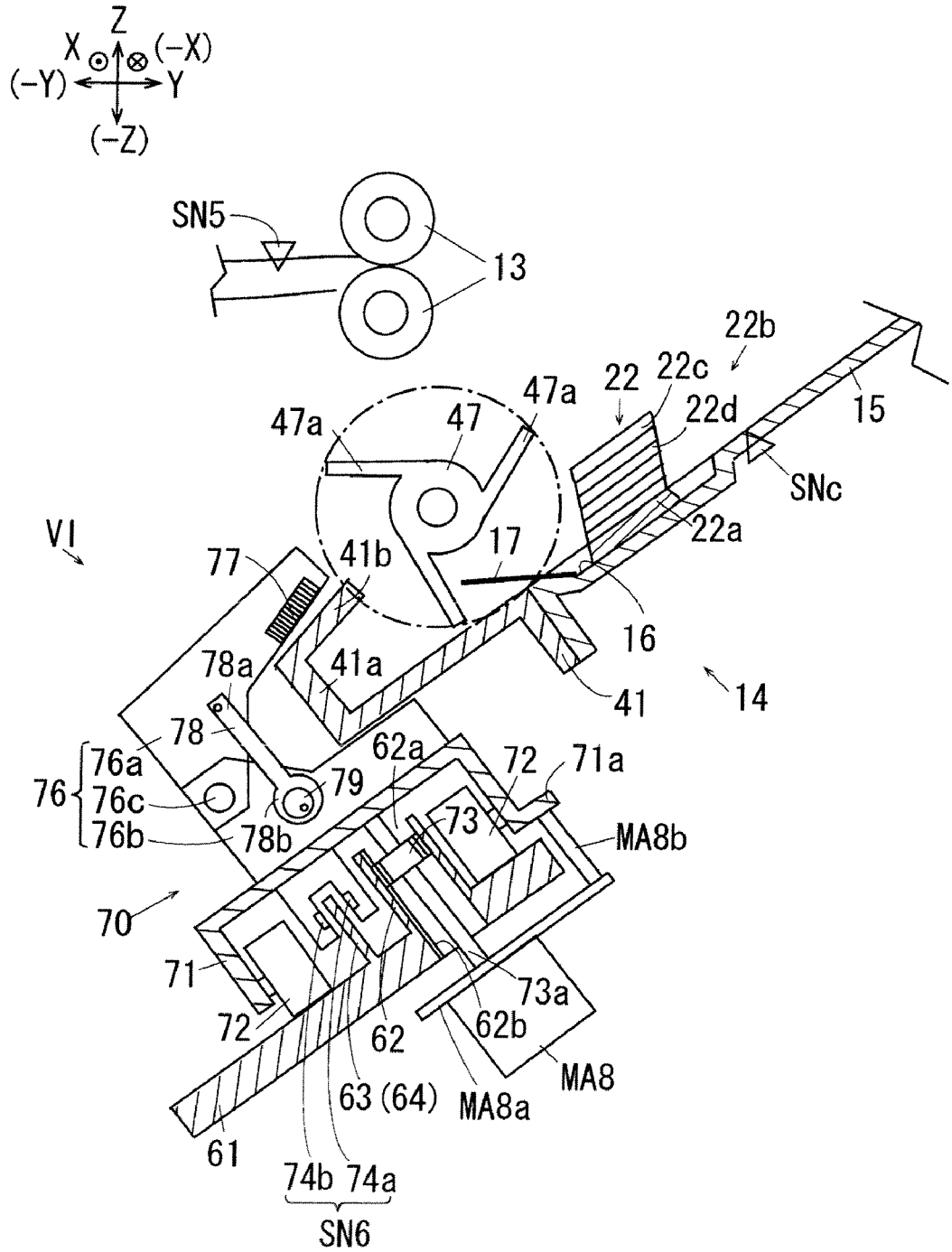
FIG. 5 is an enlarged view showing a primary portion of the rear end portion in the sheet discharging direction of the edge stapling device of Example 1.

FIG. 5 is an enlarged view showing a primary portion of the rear end portion in the sheet discharging direction of the edge stapling device of Example 1.

Figure 6:
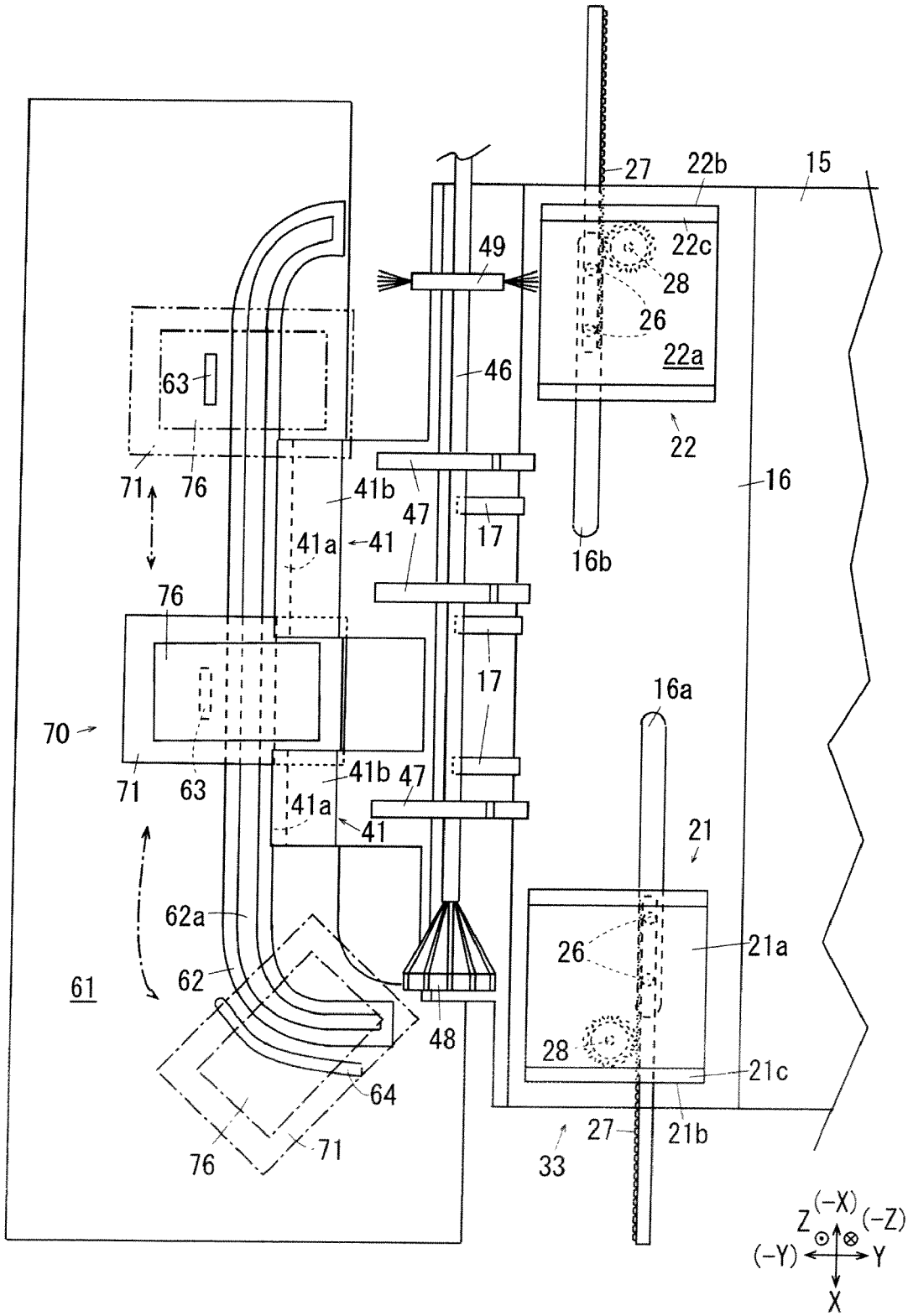
FIG. 6 is a view taken in the direction of the arrow VI of FIG. 5.

FIG. 6 is a view taken in the direction of the arrow VI of FIG. 5.

In FIGS. 3 to 5, the recording sheet S, which is carried into the sheet carry-in port 3, is discharged onto the compile tray 14, which is an example of the carry-in medium accumulating portion, by the compile tray discharging roller 13 which is an example of the medium carry-in member. In this connection, in the neighborhood of the compile tray discharging roller 13, the compile tray discharging sheet sensor SN5, which is an example of the medium carry-in detecting member for detecting the recording sheet S conveyed from the sheet carry-in port 3, is arranged. The compile tray 14 is arranged being gently inclined with respect to the horizontal direction and composed so that a plurality of recording sheets can be accommodated being arranged. The compile tray 14 includes a compile tray body 15 which is an example of the carry-in medium stacking portion body on which the recording sheets are stacked. In the left end portion on the upper face of the compile tray body 15, the tamper moving recess portion 16, which is an example of the recess portion for moving a medium bundle moving member, is formed. In FIG. 6, in tamper moving recess portion 16, the tamper guide grooves 16*a*, 16*b*, which are an example of a pair of medium bundle moving member guide grooves, are formed. In this connection, in the compile tray 14, the compile tray sheet sensor SNc, which is an example of the medium detecting member for a carry-in medium stacking portion for detecting whether or not the recording sheet S is existing, is provided.

In FIGS. 5 and 6, in the left end portion of the tamper moving recess portion 16, a base end portion of the miler 17, which is an example of the film-shaped medium lifting member, is fixed and supported. A forward end portion of the miler 17 is protruded upward from an upper face of the compile tray body 15. The rigidity of the miler 17 of Example 1, that is, the mechanical strength of the miler 17 is set as follows. Under the condition that the recording sheets S, the number of which is small, for example, five recording sheets S of plain paper are stacked on the compile tray body 15, when the bundle of recording sheets S1, which are an example of the bundle of a plurality of recording mediums, are lifted upward and a large number of recording sheets S are stacked, the mechanical strength of the miler 17 is determined so that the miler 17 can be elastically deformed by the weight of the recording sheet bundle S1 and the forward end portion of the miler 17 can be tightly contacted with an upper face of the compile tray 14. Accordingly, by the miler 17, even when the number of accommodated sheets is small, a distanced between the uppermost face of the accommodated recording sheet and the main paddle 47, which is an example of the medium conveyance member for arranging one end described later, can be maintained at a predetermined value.

(Explanations of Sheet Side Edge Arranging Member 33)

In FIGS. 5 and 6 in the tamper moving recess portion 16, a pair of the front side tamper 21 and the rear side tamper 22, which are an example of the medium bundle moving member for arranging both longitudinal side edges of the recording sheet S conveyed onto the compile tray 14, are arranged. The front side tamper 21 includes: a tamper base 21*a* which is an example of the medium stacking portion, the upper face of which is formed on the same face as the upper face of the compile tray body 15 and the rear end portion of which is inclined downward; and a medium side end arranging wall 21*b* rising upward from a front end of the tamper base 21*a*. At an upper end of the medium side end arranging wall 21*b*, the medium side edge engaging portion 21*c* protruding inside is formed. The medium side edge engaging portion 21*c* prevents the sheet front side edge of the recording sheet S on the compile tray 14 from running on the front side tamper 21. Further, the medium side edge engaging portion 21*c* prevents the sheet side edge, which is curled, from sliding upward.

In the same manner as that of the front side tamper 21, the rear side tamper 22 includes: a tamper base 22*a*; a medium side end arranging wall 22*b*; and a medium side edge engaging portion 22*c*. On an inner face of the medium side end arranging wall 22*b*, that is, on a pushing face for pushing the rear side edge of the recording sheet S, a large number of protrusions 22*d*, which are parallel with an upper face of the compile tray body 15, are formed. Accordingly, the medium side edge engaging portion 22*c* and the protrusions 22*d* prevent the rear side edge of the recording sheet S from running on the rear side tamper 22.

In FIG. 6, the guided pins 26, which are an example of two guided members, are protruded downward onto a lower face of the medium stacking portion 21*a* of the front side tamper 21. The guided pins 26 penetrate the front side tamper guide groove 16*a* and extend downward. In lower end portions of the guided pins 26, the rack gears 27, which are an example of the plate-shaped gear extending in the longitudinal direction, are supported. The rack gears 27 are meshed with the pinion gears 28 which are an example of the disk-shaped gear rotated by the front side tamper drive motor MA7*a* which is an example of the front side medium bundle moving member drive member. Accordingly, when the front side tamper drive motor MA7*a* is normally or reversely rotated, the front side tamper 21 can be moved in the longitudinal direction.

In the same manner as that of the front side tamper 21, in the rear side tamper 22, two guided pins 26 penetrate the rear side tamper guide groove 16*b* and extend downward. The rack gears 27 are supported in a lower end portion of the guided pins 26. The rack gears 27 are meshed with the pinion gears 28 which are rotated by the rear side tamper drive motor MA7*b* which is an example of the rear side medium bundle moving member drive member. Accordingly, when the rear side tamper drive motor MA7*b* is normally or reversely rotated, the rear side tamper 22 can be moved in the longitudinal direction.

As a result of the foregoing, in Example 1, when the front side drive motor MA7*a* and the rear side drive motor MA7*b* are driven, the front side tamper 21 and the rear side tamper 22 are respectively independently moved and both side edges in the longitudinal direction of the recording sheet S can be arranged. Further, the bundle S1 of the recording sheets, the side edges of which are arranged, can be moved in the width direction of the recording sheet bundle S1.

The sheet side edge arranging member 33 includes the tamper drive motors MA7*a*, MA7*b*, the tampers 21, 22, the guided pins 26, the rack gears 27 and the pinion gears 28. In this connection, the constitution of the sheet side edge arranging member is not restricted by the above constitution.

(Explanations of Sheet Rear End Positioning Member 41)

In FIGS. 5 and 6, on the sheet discharging direction rear end side of the compile tray body 15, the sheet rear end positioning member 41, which is an example of the medium rear end positioning member, is supported and fixed. The compile tray 14 includes: a rear end positioning wall 41*a* which is formed being raised upward so that a rear end in the sheet discharging direction of the recording sheet S conveyed onto the compile tray 14 can be positioned, that is, a so-called end wall, or that is, a sheet end positioning portion, that is, one end arranging portion; and a sheet guide wall 41*b* which is an example of the medium guide wall extending from an upper end of the rear end positioning wall 41*a* to the compile tray body 15 side. In this connection, as shown in FIG. 6, the rear end positioning wall 41*a* is provided in a portion except for the position at which the stapling member 70, which is an example of the moving side edge stapling member, that is, the stapler conducts stapling on the recording sheet bundle S1. In the case where a rear end of the recording sheet S, which moves toward the sheet rear end positioning wall 41*a* for arranging the sheets, is curled upward, the sheet rear end guide wall 41*b* guides a rear end of the recording sheet S so as to reduce an amount of curl of the recording sheet.

The compile tray 14 includes: a compile tray body 15; and a sheet rear end positioning member 41.

In this connection, the sheet rear end positioning member 41 of Example 1 is fixed and supported by the compile tray body 15. However, it should be noted that the present invention is not limited to the above specific example.

(Explanations of Main Paddle 47)

Figure 7A:
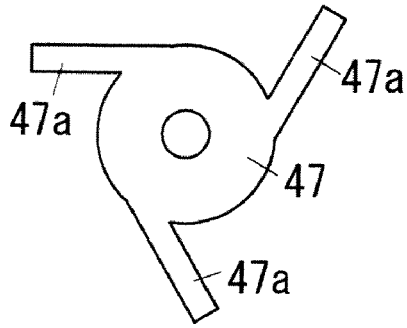
FIGS. 7A, 7B and 7C are schematic illustrations showing a sheet end portion arranging member.
Figure 7B:
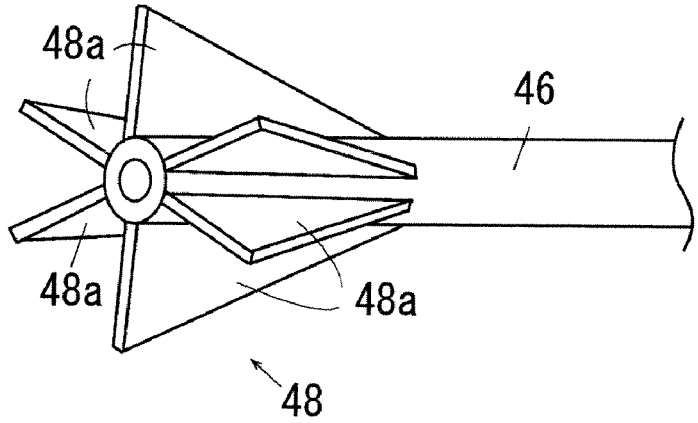
Figure 7C:
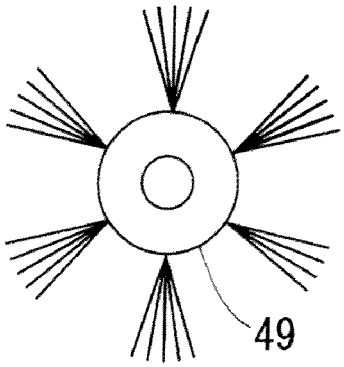

FIGS. 7A. 7B and 7C are schematic illustrations of the sheet rear end arranging member. FIG. 7A is a schematic illustration of the main paddle. FIG. 7B is a schematic illustration of the conic paddle. FIG. 7C is a schematic illustration of the rotary brush.

In FIGS. 6, 7A, 7B and 7C above the sheet rear end positioning member 41 the rear end arranging member supporting shaft 46 is pivotally supported by a frame not shown of the post-processing device U3. The rear end arranging member supporting shaft 46 is driven by a motor not shown arranged at the rear. On the rear end arranging member supporting shaft 46, three main paddles 47, which is an example of the medium rear end arranging member arranged at an interval in the longitudinal direction at positions corresponding to the sheet rear end positioning member 41, that is, a sheet end arranging member, that is, a medium conveyance member for arranging one end is fixed and supported. As shown in FIG. 7A, the main paddle 47 has a sheet contacting portion 47*a* which is an example of three flexible medium contacting portions. The main paddle 47 comes into contact with an upper face of the recording sheet S on the compile tray 14 or the uppermost face of the recording sheet bundle S1 and conveys the recording sheet S onto the sheet rear end positioning wall 41*a* side.

The sheet contacting portion 47*a* extends in the tangential direction at a position deviating by 120° in the circumferential direction on the cylindrical face. In this connection, the number and the arranging position of the sheet contacting portion 47*a* are not limited to three pieces and 120°. It is possible to employ an arbitrary number of pieces and angle such as only one piece, two pieces and 180°, four pieces and 90°, five pieces and 72°, and six pieces and 60°. An extending direction of the sheet contacting portion 47*a* is not limited to the tangential direction. It is possible to set the extending direction of the sheet contacting portion 47*a* in the radial direction.

In this connection, in the main paddle 47 of Example 1 described before, a distance between the main paddle 47 and the compile tray 14 is set so that a contact pressure of the sheet contacting portion 47*a* with the recording sheet S can be an appropriate value in the case where the number of the recording sheet bundles S1 accommodated on the compile tray 14 is large.

In FIGS. 6 and 7B, the conic paddle 48, which is an example of the medium side edge guiding rotary member for guiding downward one side edge of the recording sheet S moving forward, is fixed to the front end portion of the rear end arranging member supporting shaft 46. The conic paddle 48 has a conic rotary face, the outside diameter of which is increased large when it comes to the front side. That is, as shown in FIG. 7B, the conic paddle 48 has six pieces of triangular fin-shaped members 48*a* extending in the radial direction at positions deviating from each other by the angle 60° in the circumferential direction on the cylindrical face. Outside edges of the fin-shaped members 48*a* form a conic face when they are rotated. When a sheet curling upward comes to the front, the conic paddle 48 directs the curled portion of the sheet downward.

At the rear end portion of the rear end arranging member supporting shaft 46, the rotary brush 49 shown in FIGS. 6 and 7C, which is an example of the rotary linear member, is fixed. In FIG. 7C, the rotary brush 49 has a plurality of linear members extending in the radial direction at positions deviating from each other by the angle 60° in the circumferential direction on the cylindrical face, that is, the rotary brush 49 has brush hair. The rotary brush 49 has a function of suppressing a curl of the rear end portion of the recording sheet S downward. In this connection, it may be possible to omit the conic paddle 48 and the rotary brush 49.

(Explanations of Stapler Guide Member 61)

In FIGS. 5 and 6, at a position on the left below the sheet rear end positioning member 41, the stapler guide member 61, which is an example of the medium bundle side edge stapling member guiding member is fixed and supported by a frame not shown of the post-processing processing device U3. In the stapler guide member 61, the stapler guide portion 62, which is an example of the medium bundle side edge stapling member guiding portion which extends linearly in the longitudinal direction and curves into an arcuate shape inside in both longitudinal end portions, is formed being protruded upward. In the stapler guide portion 62, the stapler guide groove 62*a*, which is an example of the medium bundle side edge stapling member, is formed along the stapler guide portion 62. On one inner face of the stapler guide groove 62*a*, the gear teeth 62*b*, which is an example of the gear, are formed as shown in FIG. 5.

In this connection, at the front and the rear end of the stapler guide groove 62, a snap-fit engaging portion not shown, which prevents the staple member described later from moving onto the front or the rear end side anymore, is provided.

In FIG. 6, on the left of the stapler guide groove 62*a*, corresponding to the stapling position which is an example of the side edge stapling position at which the side end of the recording sheet S is stapled, the stapling position shading portion 63, which is an example of the side edge stapling position detecting portion, is provided. The stapling position shading portion 63 is formed along the linear stapler guide groove 62 in the longitudinal direction. At the front end portion of the stapler guide member 61, the home position shading portion 64, which is an example of the reference position detecting portion, is formed along the arcuate curved portion of the stapler guide groove 62.

In this connection, a length in the longitudinal direction of the stapling position shading portion 63 of Example 1 is set at 12.6 mm. The home position shading portion 64 of Example 1 is sufficiently longer than the stapling position shading portion 63, for example, the home position shading portion 64 of Example 1 is formed to be substantially 50 mm long. The home position shading portion 64 is used for detecting a home position which is an example of the reference position. At the same time, the home position shading portion 64 is used for detecting a stapling position for stapling a corner which is an example of the corner stapling position for carrying out the corner stapling.

(Explanations of Moving Stapling Member 70)

In FIGS. 5 and 6, on the stapler guide member 61, the moving stapling member 70 is arranged. The moving stapling member 70 has a carriage 71. At the right end portion of the carriage 71, the shaft supporting portion 71*a*, which is an example of the shaft supporting portion, is formed. By the carriage 71, the roller 72, which is an example of the rotary member, is pivotally supported. The carriage 71 is composed so that it can be moved on the stapler guide member 61. On a lower face of the carriage 71, the guide gear 73, which is an example of the guide gear, is pivotally supported. The guide gear 73 is engaged in the stapler guide groove 62*a* and meshed with the gear teeth 62*b*. The rotary shaft 73*a* of the guide gear 73 penetrates the stapler guide groove 62*a*. A lower end portion of the rotary shaft 73*a* of the guide gear 73 is connected to the stapler drive motor MA8 which is an example of the moving side edge stapling member driving member. The motor supporting plate MA8*a*, which is an example of the drive member supporting plate, is supported by the stapler drive motor MA8. Between the right end portion of the motor supporting plate MA8*a* and the shaft supporting portion 71*a*, the shaft MA8*b* for supporting the motor, which is an example of the drive member supporting shaft, is connected. Accordingly, the stapler driving motor MA8 can be moved integrally with the carriage 71.

Accordingly, when the stapler driving motor MA8 is normally or reversely rotated, the guide gear 73 is driven and rotated and the carriage 71 is moved by the gear teeth 62*b* of the stapler guide groove 62*a* meshed with the guide gear 73 being guided in the longitudinal direction along the stapler guide portion 62. The stapler drive motor MA8 of Example 1 is formed out of a so-called stepping motor which is rotated by a predetermined angle each time a pulse is inputted into the stepping motor. In this connection, the stapler driving motor MA8 of Example 1 is set so that the carriage 71 can be moved in the longitudinal direction at the moving speed 31.5 cm/s. Accordingly, the carriage 71 of Example 1 passes through a range from the front end to the rear end of the stapling position shading portion 63 in a period of time of 40 ms. The carriage 71 of Example 1 needs a period of time not less than 50 ms for passing through the home position shading portion 64. In this connection, at the time of carrying out the stapling operation, the carriage 71 is moved to the stapling position on the basis of the home position which is a reference position of starting a movement of the carriage 71.

In FIG. 5, on a lower face of the carriage 71, the stapler position detecting sensor SN6, which is an example of the moving end side edge stapling member position detecting member, is fixed. The stapler position detecting sensor SN4 includes: a light emitting portion 74*a* from which light is emergent; and a light sensor having a light receiving portion 74*b* capable of receiving light emergent from the light emitting portion. In the case where the carriage 71 is moved to the stapling position or the home position, the stapler position detecting sensor SN6 is arranged at a position shaded when the stapling position shading portion 63 or the home position shading portion 64 proceeds to between the light emitting portion 74*a* and the light receiving portion 74*b*. Accordingly by the stapler position detecting sensor SN6, the stapling position shading portion 63 and the home position shading portion 64, the carriage 71 can be moved among the stapling position which is the side edge stapling position shown by the solid line or the two-dotted chain line in FIG. 6, the reference position shown by the one-dotted chain line in FIG. 6 and the home position which is the corner stapling position.

On an upper face of the carriage 71, the stapler body 76, which is an example of the moving side edge stapling member body, is supported. The stapler body 76 includes: a staple driving portion 76*a* for driving a staple 77 which is an example of the staple for stapling the recording sheet bundle S1 stacked on the compile tray 14; and a staple bending portion 76*b* for bending a tip of the staple 77 driven out from the staple driving portion 76*a*. The staple driving portion 76*a* is pivotally supported by the rotary shaft 76*c* in the staple bending portion 76*b*. The forward end portion 78*a* of the stapler operating member 78, which is an example of the moving side edge stapling member operating member, is connected to the staple driving portion 76*a* through a pin. The ring-shaped rear end portion 78*b*, which is an example of the annular rear end portion of the stapler operating member 78, is idly engaged with the eccentric cam 79 which is an example of the eccentric rotary member pivotally supported by the staple bending portion 76*b*. Accordingly, when the eccentric cam 79 is rotated by a drive unit not shown, the stapler operating member 78 is moved in the vertical direction and the staple driving portion 72*a* is moved in the vertical direction and stapling is executed.

The moving staple member 70 includes the members attached with reference marks 71 to 79.

(Explanations of Discharging Roller 82, Shelf 84 and Set Clamp Paddle 83)

Figure 8A:
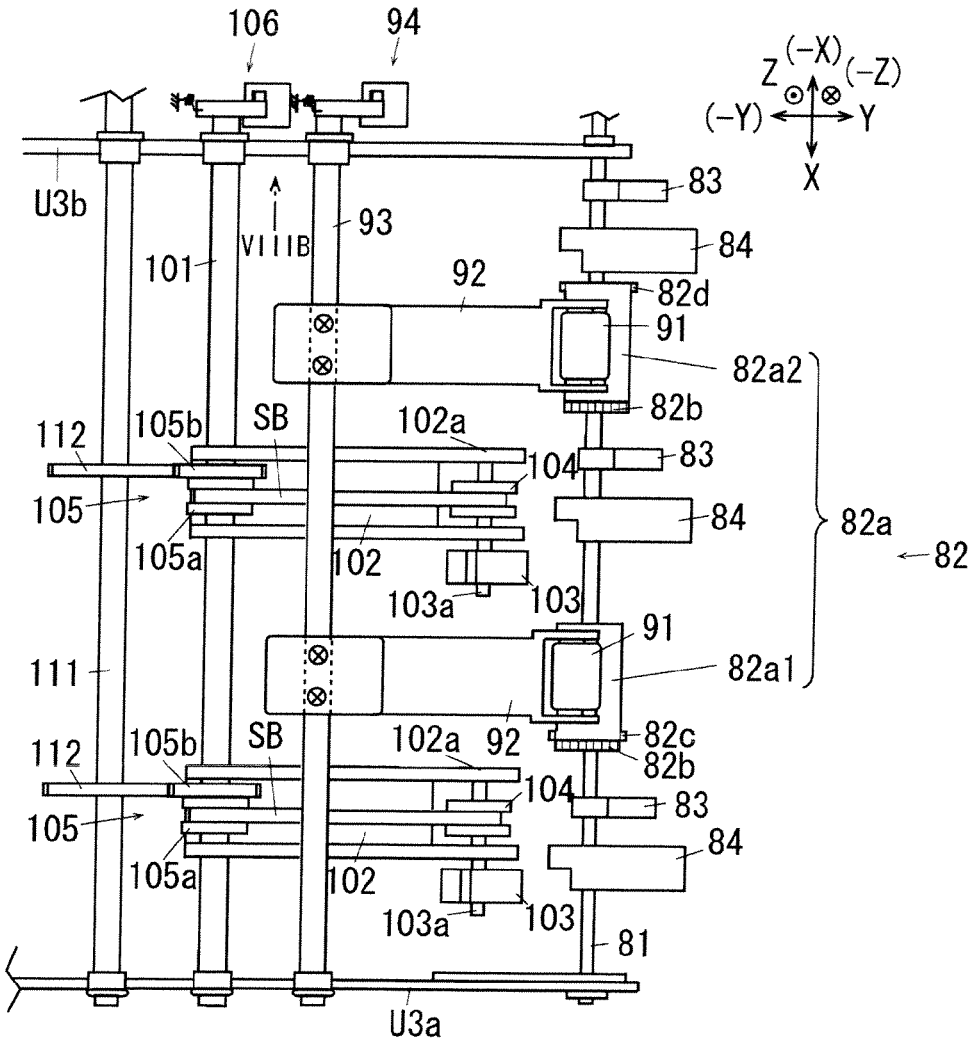
FIGS. 8A and 8B are schematic illustrations showing a clamp roller and sub-paddle.
Figure 8B:
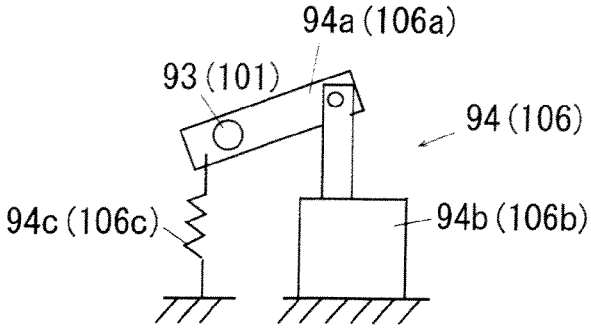

FIGS. 8A and 8B are schematic illustrations of the clamp roller and the sub-paddle. FIG. 8A is a plan view and FIG. 8B is a view taken in the direction of the arrow VIIIB in FIG. 8A.

In FIGS. 3, 4, 8A and 8B, in the front portion in the sheet discharging direction of the compile tray 14, the discharging roller shaft 81, that is, a so-called stacker tray discharging roller shaft, which is an example of the shaft member for a discharging member, pivotally supported between the front end frame U3*a* and the rear end frame U3*b*, which are example of the frame member of the post-processing device U3, is provided. To the discharging roller shaft 81, torque is transmitted from the discharging roller drive motor MA2, which is an example of the medium bundle stacking portion discharging member driving member, capable of rotating normally and reversely through an electromagnetic clutch not shown. Therefore, the discharging roller shaft 81 is rotated when the electromagnetic clutch is turned on and off.

In FIGS. 8A and 8B, by the discharging roller shaft 81, two discharging rollers 82, which are an example of the medium bundle stacking portion discharging member, are pivotally supported at an interval in the longitudinal direction, that is, a so-called stacker tray discharging roller or a discharging member is pivotally supported. Each discharging roller 82 includes: a discharging roller body 82*a* which is an example of the medium bundle stacking portion discharging member body; and a roller gear 82*b* which is an example of the gear for a discharging member, supported on the front end face of the discharging roller body 82*a*.

In the discharging roller body 82*a*, in the front end portion of the front side discharging roller body 82*a*1 which is an example of the front side discharging member body arranged in the front portion and in the rear end portion of the rear side discharging roller body 82*a*2 which is an example of the rear side discharging member body arranged in the rear portion, the lower side sheet conveyance blades 82*c*, 82*d*, which are an example of the three lower side medium conveyance blades, are fixed and supported in the circumferential direction at regular intervals, for example, at the intervals 120°. Each lower side sheet conveyance blade 82*c*, 8*d* is extended in the tangential direction of the outer circumferential face of the discharging roller body 82*a*. The lower side sheet conveyance blades 82*c*, 82*d* are made of flexible resin such as PET, that is, polyethylene terephthalate. Accordingly, when the lower side sheet conveyance blades 82*c*, 82*d* are contacted with a lower face of the recording sheet S on the compile tray 14, in the case of the recording sheet bundle S1, when the lower side sheet conveyance blades 82*c*, 82*d* are contacted with the lowermost face of the recording sheet bundle S1, the lower side sheet conveyance blades 82*c*, 82*d* are pushed downward and bent by the weight of the recording sheet S itself. As a result, by the elastic restoring forces of the lower side sheet conveyance blades 82*c*, 82*d* which are bent, the lower side sheet conveyance blades 82*c*, 82*d* are pressed against a lower face of the recording sheet S by a predetermined force. Accordingly, when the discharging roller 82 is rotated, the recording sheet S can be positively given a conveyance force.

In this connection, the lower side sheet conveyance blades 82*c*, 82*d* are arranged in a range except for the range in which the discharging roller body 82*a* and the clamp roller 91, which is an example of the interposing member described later, interpose the recording sheet bundle S1, that is, the lower side sheet conveyance blades 82*c*, 82*d* are arranged in a portion except for the central portions of the discharging roller bodies 82*a*, 82*b*.

By the discharging roller shaft 81, three set clamp paddles 83, which are an example of the set clamp paddle of the example of the stacked medium bundle pressing member arranged at an interval are fixed and supported. The stacker tray discharging rotary members (81 to 83), which are an example of the medium bundle stacking portion discharging rotary member, include the components shown by reference numerals 81 to 83.

On the discharging roller shaft 81, three shelves 84, which are an example of the medium lower face supporting member arranged at intervals, are provided. In the shelves 84, the guided elliptical hole 84*a*, which is an example of the guided elliptical hole extending along the sheet discharging direction and penetrating by the discharging roller shaft 81, is formed. In the shelves 84, the rack gear 84*b*, which is an example of the arcuate gear extending in the sheet discharging direction, is formed.

In FIGS. 3 and 4, below the discharging roller shaft 81, the drive shaft 86, which is an example of the discharging member rotating drive shaft to which torque is transmitted from the discharging roller drive motor MA2, is arranged. By the drive shaft 86, the discharging roller driving gear 87, which is an example of the discharging member driving gear meshed with the roller gear 82*b* of the discharging roller 82, is fixed and supported. By the drive shaft 86, the shelf operation gear 89, which is an example of the medium lower face supporting member moving gear meshed with the rack gear 84*b* of the shelf 84, is fixed and supported. Therefore, according to the normal and reverse rotation of the discharging roller driving motor MA2, the discharging roller 82 is normally and reversely rotated. At the same time, while the shelf 84 is being guided by the discharging roller shaft 81, the shelf 84 is moved between the sheet lower face supporting position, which is an example of the medium lower face supporting position shown in FIG. 3, and the accommodating position shown in FIG. 4. In this connection, in the case where a rotation of moving the shelf 84 forward or backward is transmitted from the drive shaft 86 under the condition that the shelf 84 is moved to the sheet lower face supporting position or the accommodating position, the drive shaft 86 is idly rotated with respect to the shelf operation gear 89 by an action of the torque limiter.

The set clamp paddle 83 is rotated according to the rotation of the discharging roller shaft 81 when the electromagnetic clutch CLO, which is an example of the drive force transmitting member, is turned on and off. The set clamp paddle 83 comes into contact with an upper face of the recording sheet bundle S1 on the stacker tray TH1 which is an example of the medium bundle stacking portion described later. Then, the set clamp paddle 83 is rotated between the sheet clamp position, which is an example of the medium pressing position shown in FIG. 3 for pressing the recording sheet bundle S1, and the sheet lower face supporting position which is an example of the medium lower face supporting position shown in FIG. 4 for supporting a lower face of the recording sheet discharged onto the edge stapling compile tray 14 under the condition that the shelf 84 is held at the accommodating position.

(Explanations of Clamp Roller 91)

In FIGS. 3, 8A and 8B, above the discharging roller 82, the clamp roller 91, which is an example of the medium bundle upper face pressing member, is arranged. The clamp roller 91 is supported by the clamp roller supporting member 92 which is an example of the medium bundle upper face pressing member supporting member, the shape of which is formed into a plate-spring-shape. A left end portion of the clamp roller supporting member 92 is fixed and supported by the clamp roller elevating shaft 93 which is an example of the medium bundle upper face pressing member elevating shaft pivotally supported by the frames U3*a*, U3*b*. At the rear end of the clamp roller elevating shaft 93, the clamp roller elevating member 94 is provided. The clamp roller elevating member 94 includes: an elevating bar 94*a* which is an example of the elevating shaft connected to a rear end of the clamp roller elevating shaft 93 which is an example of the medium bundle upper face pressing member elevating member body; a clamp roller elevating solenoid 94*b* which is an example of the medium bundle upper face pressing member elevating member body connected to a right end portion of the elevating bar 94*a* and a tensile spring 94*c* which is an example of the tensile elastic member connected to a left end portion of the elevating bar 94*a*.

Therefore, under the condition that the clamp roller elevating solenoid 94*b* is turned off, the clamp roller 91 is held at an upper waiting position shown by the solid line in FIG. 3 by the tensile spring 94*c*. On the other hand, under the condition that the clamp roller elevating solenoid 94*b* is turned on, the clamp roller 91 is held at the clamp position which is an example of the lower medium bundle upper face pressing position shown by the dotted line in FIG. 3. Therefore, an upper face of the recording sheet S on the compile tray 14 or an upper face of the recording sheet bundle S1 is interposed between the discharging roller 82 and the clamp roller 91. At this time, the recording sheet is held by the plate-spring-shaped clamp roller supporting member 92 being given an appropriate pressure. According to a normal rotation or a reverse rotation of the discharging roller 82, the held recording sheet S or the recording sheet bundle S1 is drawn onto the compile tray 14 or discharged from the compile tray 14.

The clamp roller elevating member 94 is not limited to the solenoid (94*b*) and the spring (94*c*). For example, it is possible to use a structure in which an elevation is executed by using a motor and an eccentric cam. The clamp roller supporting member 92 is not limited to the plate-spring-shaped structure. For example, it is possible to use a structure including: a highly rigid clamp roller supporting member; and a coil spring for pushing the roller supporting member to the discharging roller 82 side.

(Explanations of Sub-paddle 103)

In FIGS. 4, 8A and 8B, on the left below the clamp roller elevating shaft 93, the sub-paddle supporting shaft 101, which is an example of the second one end arranging medium conveyance member supporting shaft, is pivotally supported by the frames U3*a*, U3*b*. By the sub-paddle supporting shaft 101, a plurality of sub-paddle supporting members 102, which are an example of the second one end arranging medium conveyance member supporting member extending in the longitudinal direction at an interval, is fixed and supported. In the right end portion of the sub-paddle supporting member 102, the sub-paddle supporting arm 102*a*, which is an example of the second one end arranging medium conveyance member supporting shaft, is formed. By the sub-paddle supporting arm 102*a*, the sub-paddle 103, which is composed in the same manner as that of the main paddle 47 and which is an example of the second one end arranging medium conveyance member supporting shaft for conveying the recording sheet on the compile tray 14 onto the main paddle 47 side, is pivotally supported, that is, the second sheet end arranging member is pivotally supported. By the rotary shaft 103*a* of the sub-paddle 103, the pulley 104, which is an example of the driven side belt-shaped member rotation supporting member, is supported. By the sub-paddle supporting shaft 101, the drive side pulley 105, which is an example of the drive side belt-shaped member rotation supporting member, is pivotally supported at a position corresponding to the pulley 104. The drive side pulley 105 includes: a pulley portion 105*a* which is an example of the rotation supporting portion; and a gear portion 105*b* which is an example of the gear portion. Between the pulley 104 and the pulley portion 105*a*, the sub-paddle drive belt SB, which is an example of the second one end arranging medium conveyance member drive belt-shaped member, is mounted.

At the rear end of the sub-paddle supporting shaft 101, the sub-paddle elevating member 106, which is an example of the second one end arranging medium conveyance member elevating member composed in the same manner as that of the clamp roller elevating member 94, is provided. That is, the sub-paddle elevating member 106 includes: an elevating bar 106*a* which is an example of the elevating shaft; a sub-paddle elevating solenoid 106*b* which is an example of the second one end arranging medium conveyance member elevating member body; and a tensile spring 106*c* which is an example of the tensile elastic member. Accordingly, when the sub-paddle elevating solenoid 106*b* is turned on and off, the sub-paddle 103 is moved between the upper waiting position shown by the solid line in FIG. 4 and the sheet drawing position which is an example of the lower medium drawing position, which is shown by the dotted line in FIG. 4, for drawing the recording sheet S onto the main paddle 47 side.

In FIGS. 8A and 8B, on the left of the sub-paddle supporting shaft 101, the sub-paddle drive shaft 111, which is an example of the second one end arranging medium conveyance member drive shaft, is pivotally supported by the frames U3*a*, U3*b*. By the sub-paddle drive shaft 111, the drive gear 112, which is an example of the drive gear meshed with the gear portion 105*b* of the drive side pulley 105, is fixed and supported. To the sub-paddle drive shaft 111, a rotation is transmitted from the post-processing device sheet conveyance roller driving motor MA1 which is an example of the post-processing device medium conveyance member driving member not shown for driving the compile tray discharging roller 6. According to the drive of the post-processing device sheet conveyance roller drive motor MA1, a rotation is transmitted through the drive gear 112, the gear portion 105*b*, the pulley portion 105*a*, the sub-paddle drive belt SB and the pulley 104, so that the sub-paddle 103 can be rotated.

In this connection, in the post-processing device U3 of Example 1, the sub-paddle supporting shaft 101 and the clamp roller supporting shaft 93 are arranged separately from each other. However, when the following constitution is employed, the sub-paddle supporting shaft 101 can be omitted. For example, the sub-paddle supporting member 102 and the drive side pulley 105 are pivotally supported by the clamp roller supporting shaft 93. Further, the constitution includes: an elevating bar extending in the longitudinal direction and capable of moving integrally with a plurality of sub-paddle supporting members 102; a solenoid for elevating the sub-paddle connected to the elevating bar; and a tensile spring. The sub-paddle supporting member 102 may be omitted.

(Explanations of Stacker Tray TH1)

In FIGS. 3 and 4, on the right side wall of the post-processing device U3, the stacker tray TH1, which is an example of the medium bundle stacking portion for receiving the recording sheets described below, is protruded. That is, a so-called edge stapling discharging tray for receiving the recording sheets described later is provided being protruded outside. The recording sheets are: a recording sheet bundle S1 which is arranged on the compile tray 14 and carried out by the discharging roller 82; a recording sheet bundle S1, the side end portion of which is stapled by the moving stapling member 70; and a recording sheet bundle S1, the intermediate end portion of which is stapled by the saddle stapling device NTS. The stacker tray TH1 includes: a tray guide 121 which is an example of the stacking portion guiding portion supported on the right side face of the post-processing device U3; a slider 122 which is an example of the stacking portion supporting member supported by the tray guide 121 being capable of sliding in the vertical direction; and a stacker tray body 123 which is an example of the medium bundle stacking portion body connected to the slider 122 by a screw. In this connection, the slider 122 and the stacker tray body 123 are composed so that they can be vertically moved by a known elevating mechanism. The slider 122 and the stacker tray body 123 are composed so that they can be vertically moved by a height sensor according to an amount of recording sheet bundle on the stacker tray body 123, that is, according to the height of an upper face of the sheet bundle.

The edge stapling device HTS includes: a compile tray discharging roller 13; a compile tray 14; a sheet side edge arranging member 33; a sheet rear end positioning member 41; a main paddle 47; a stapler guide member 61; a moving stapling member 70; a discharging roller 82; a set clamp paddle 83; a shelf 84; a clamp roller 91; a sub-paddle 103; and a stacker tray TH1. The edge stapling device HTS of Example 1 executes: a sheet carry-in processing which is an example of the medium carry-in processing for carrying in the recording sheet S onto the compile tray 14; an arranging processing for arranging rear ends and side edges of the recording sheet bundle S1 stacked on the compile tray 14; a stapling processing which is an example of the side edge stapling processing for stapling the recording sheet bundle S for which the arranging processing has been carried out; an saddle stapling processing executed by the saddle stapling device NTS described later; and a sheet discharging processing which is an example of the medium bundle discharging processing for discharging the recording sheet bundle S1 from the compile tray 14 onto the stacker tray TH1.

(Explanations of Saddle Stapling Device NTS)

Figure 9:
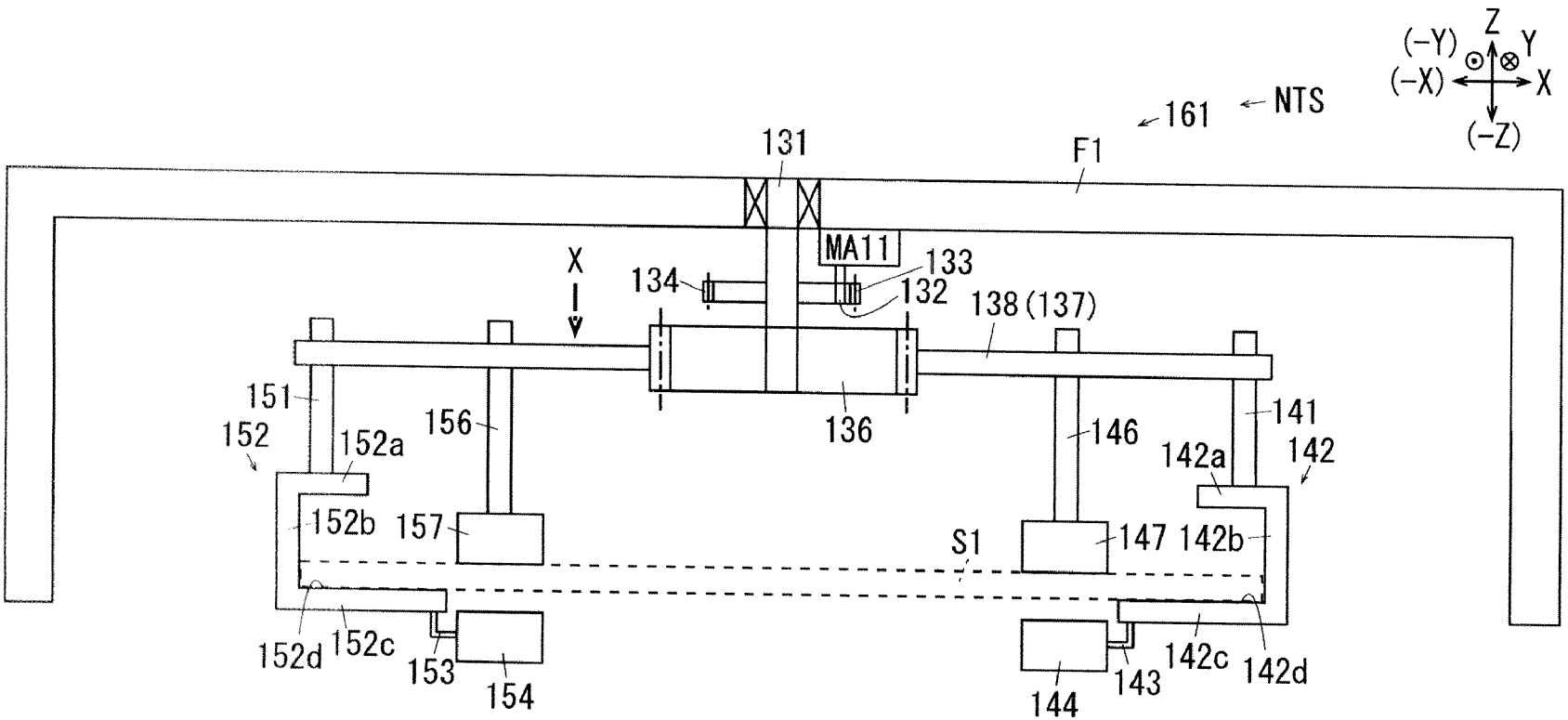
FIG. 9 is an enlarged schematic illustration showing a primary portion of the saddle stapling device of Example 1 and a sectional schematic illustration showing a primary portion in a state in which the medium bundle stapling member is moved to the first stapling position.

FIG. 9 is an enlarged schematic illustration of a primary portion of the saddle stapling device of Example 1, that is, FIG. 9 is a sectional schematic illustration of a primary portion showing a state in which a medium bundle stapling member is moved to the first stapling position.

Figure 10:
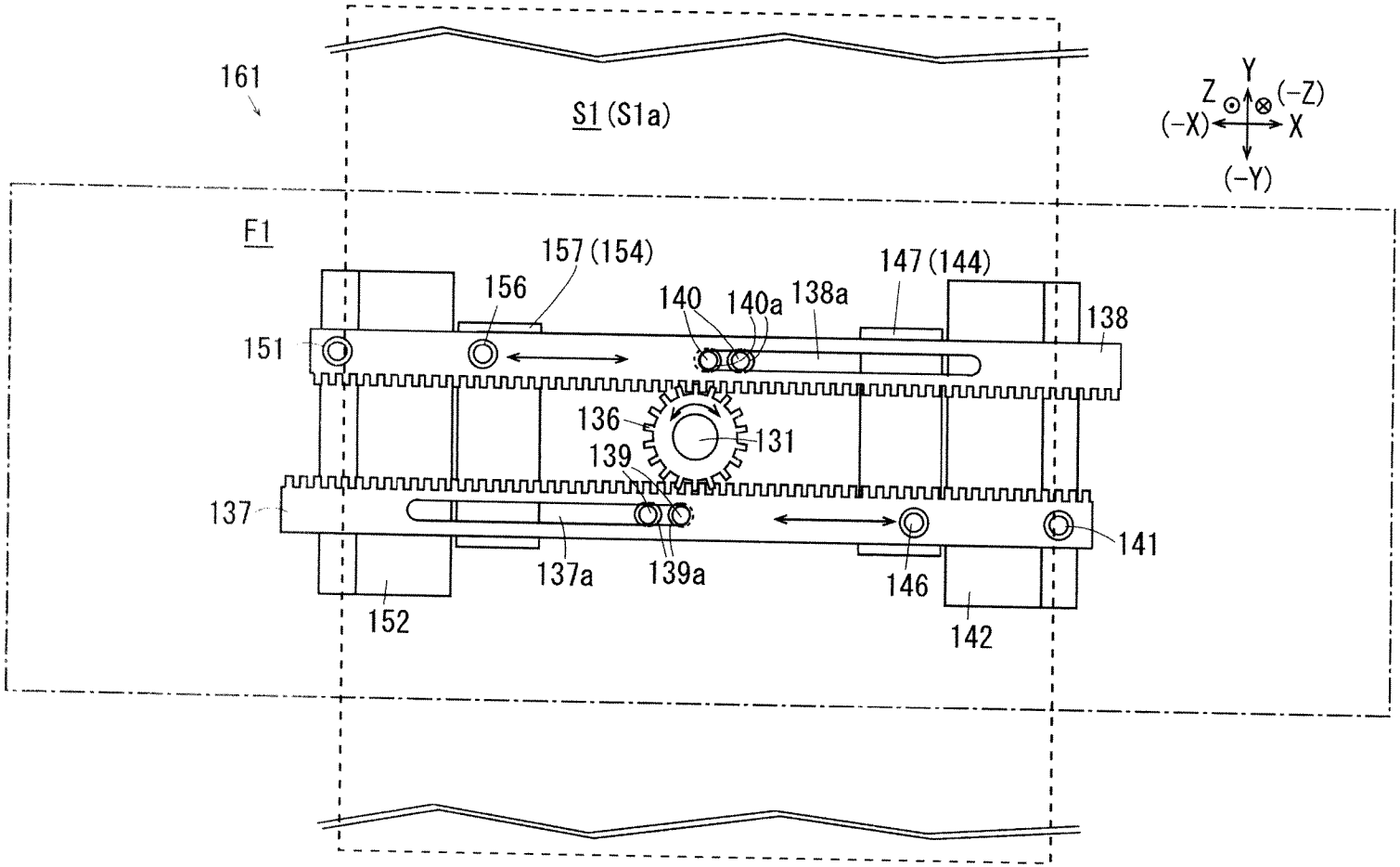
FIG. 10 is a schematic illustration taken in the direction of the arrow X in FIG. 9.

FIG. 10 is a schematic illustration taken when FIG. 9 is viewed in the direction of the arrow X.

In FIGS. 2 and 3, in the right side wall upper end portion of the post-processing device U3, the saddle stapling device NTS is arranged which staples a central portion in the sheet conveyance direction of the recording sheet bundle S1 arranged on the compile tray 14, that is, the saddle stapling device NTS, which carries out the saddle stapling processing, is arranged. The saddle stapling device NTS of Example 1 includes a saddle stapling unit capable of being attached to and detached from the post-processing device U3.

In FIGS. 9 and 10, on the upper end wall F1 of the saddle stapling device NTS, the rotary shaft 131 is pivotally supported. The rotary shaft 131 of Example 1 is arranged in a central portion in the width direction of the recording sheet bundle S1 conveyed for executing the saddle stapling processing.

In the front portion of the rotary shaft 131, the width direction movement drive motor MA11, which is an example of the width direction movement drive member, is supported on a lower face of the upper end wall F1. The width direction movement drive motor MA11 drives: a width direction moving driving member rotating shaft 132 extending downward; and a width direction movement drive gear 133 which is an example of the width direction movement driving gear supported by a lower end portion of the width direction movement driving member rotating shaft 132. In a central portion in the axial direction of the rotary shaft 131, the width direction movement driven gear 134, which is an example of the width direction movement driven gear meshed with the width direction movement driving gear 133, is supported. In the lower end portion of the rotary shaft 131, the width direction movement pinion gear 136, which is an example of the width direction movement disk-type gear, is supported. With both sides of the pinion gear 136, the left side width movement rack gear 137 and the right side width movement rack gear 138, which are an example of the width direction movement flat-plate-type gear extending in the width direction of the recording sheet bundle S1, are meshed.

In the left side width direction movement rack gear 137, the left side width direction guided elliptical hole 137*a*, which extends from the width direction central portion of the recording sheet bundle S1 to the width direction rear end portion, is formed. In the left side width direction guided elliptical hole 137*a*, two left side gear guide shaft shafts 139, which extend downward from the upper end wall F1, penetrate. In the right side width direction movement rack gear 138, the right side width direction guided elliptical hole 138*a*, which extends from the width direction central portion of the recording sheet bundle S1 to the width direction front end portion, is formed. In the right side width direction guided elliptical hole 138*a*, two right side gear guide shafts 140, which extend downward from the upper end wall F1, penetrate.

In the lower end portions of the gear guide shafts 139, 140 penetrating the width direction guided elliptical holes 137*a* 138*a*, the disk-shaped width direction movement rack gear supporting portions 139*a*, 140*a*, the diameters of which are larger than those of the gear guide shafts 139, 140, are respectively formed. That is, the width direction movement rack gears 137, 138 are supported by the gear guide shafts 139, 140 so that they can be moved in the width direction of the recording sheet bundle S1. At the same time, the width direction movement rack gears 137, 138 are supported by the width direction movement rack gear supporting portions 139*a*, 140*a*.

By the front end portion of the left side width direction movement rack gear 137, the front side width direction movement stacking portion supporting member 141, which extends downward, is supported. By the lower end portion of the front side width direction movement stacking portion supporting member 141, the front side width direction movement stacking portion 142, which supports the front end portion of the recording sheet bundle S1 in the case where the saddle stapling processing is executed, is supported. The front side width direction movement stacking portion 142 includes: a supported portion 142*a* supported by the front side width direction movement stacking portion supporting member 141; a front wall portion 142*b* extending downward from the front end portion of the supported portion 142*a*; and a medium bundle stacking portion 142*c* extending backward from the lower end portion of the front wall portion 142*b*. On an upper face of the medium bundle stacking portion 142*c*, the medium bundle supporting face 142*d* for supporting the recording sheet bundle S1 is formed. By the lower face rear portion of the medium bundle stacking portion 142*c*, the reverse-L-shaped front side width direction movement staple bending portion supporting portion 143 is supported. By the rear end portion of the reverse-L-shaped front side width direction movement staple bending portion supporting portion 143, the front side width direction movement staple bending portion 144 is supported.

At the rear of the front side width direction movement stacking portion supporting member 141, the front side width direction movement staple driving portion supporting member 146 is supported. In the lower end portion of the front side width direction movement staple driving portion supporting member 146, the front side width direction movement staple driving portion 147 for driving a staple for stapling the recording sheet bundle S1 stacked on the medium bundle stacking face 142*c* is supported being opposed to the front side width direction movement staple bending portion 144. The front side medium bundle stapling members 137+141 to 147 of Example 1 are formed out of the left side width direction movement rack gear 137 and the front side members 141 to 147.

The rear end portion of the right side width direction movement rack gear 138 supports: a rear side width direction movement stacking portion 152 having a rear side width direction movement stacking portion supporting member 151, a supported portion 152*a*, a rear wall portion 152*b*, a medium bundle stacking portion 152*c* and a medium bundle supporting face 152*d*, which are longitudinally symmetrically arranged corresponding to the members 141 to 147 in the same manner as that of the left side width direction movement rack gear 137; an L-shaped rear side width direction movement staple bending portion supporting portion 153; a rear side width direction movement staple bending portion 154; a rear side width direction movement staple driving portion supporting member 156; and a rear side width direction movement staple driving portion 157. The rear side medium bundle stapling members 138+151 to 157 of Example 1 are formed out of the right side width direction movement rack gear 138 and the rear side members 151 to 157.

Figure 11:
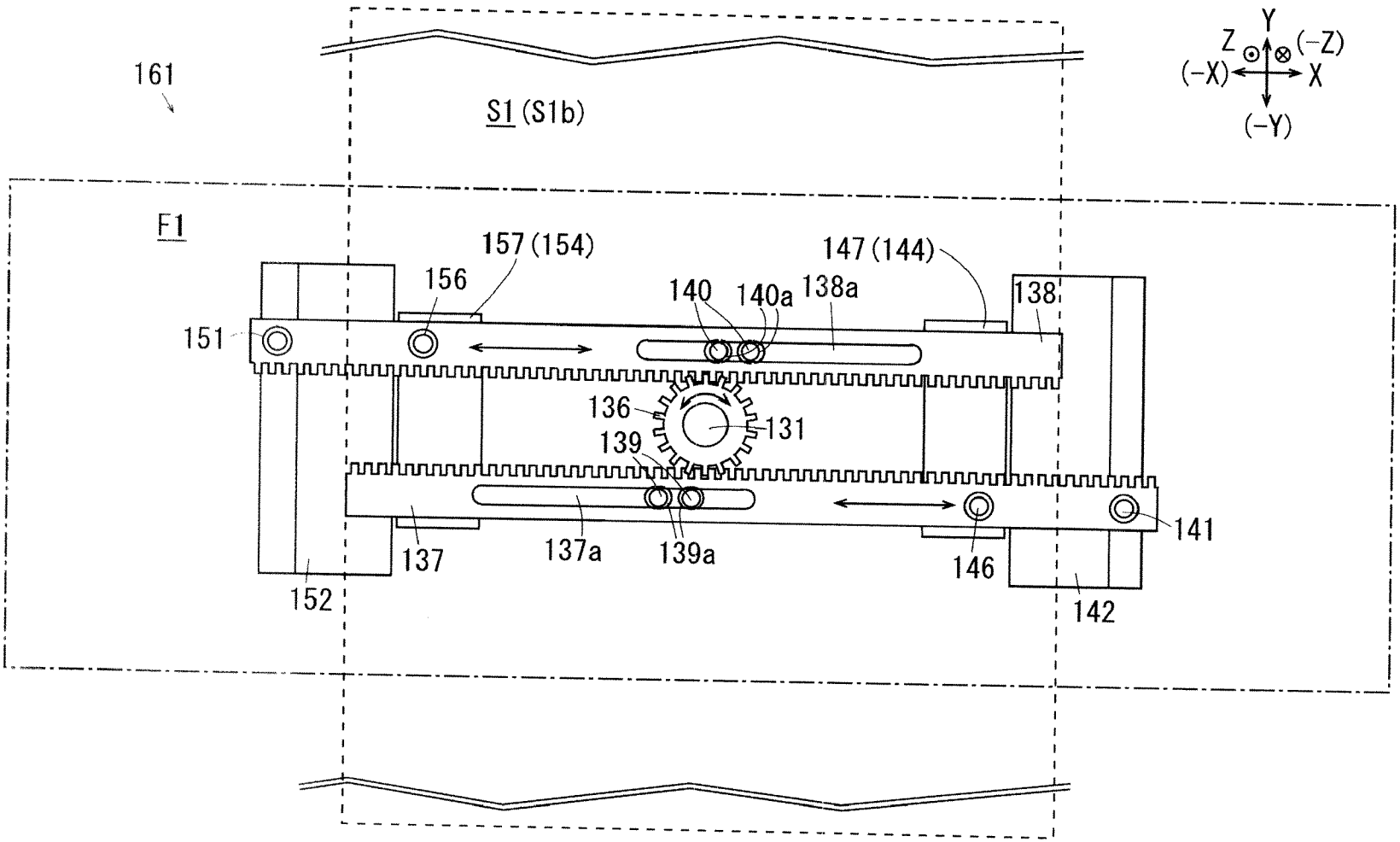
FIG. 11 is a schematic illustration showing a state in which the medium bundle stapling member is moved from the state shown in FIG. 10 to the second stapling position.

FIG. 11 is a schematic illustration showing a state in which the medium bundle stapling member is moved to the second stapling position from the state shown in FIG. 10.

Figure 12:
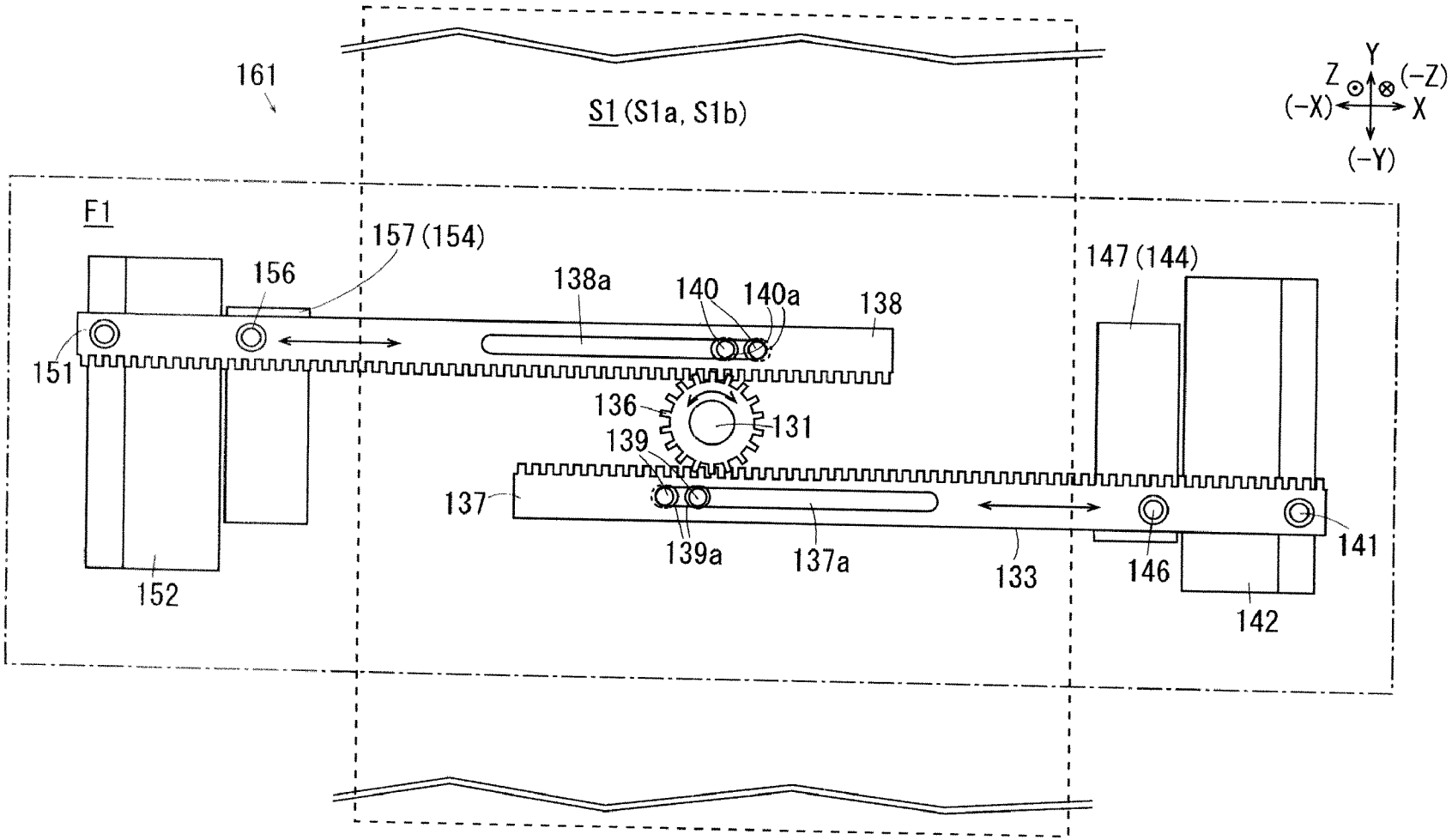
FIG. 12 is a schematic illustration showing a state in which the medium bundle stapling member is moved from the state shown in FIG. 11 to a medium bundle dropping position.

FIG. 12 is a schematic illustration showing a state in which the medium bundle stapling member is moved to a medium bundle dropping position from the state shown in FIG. 11.

In Example 1, when the width direction movement driving motor MA11 is driven and rotated, the width direction movement pinion gear 136 is rotated through the width direction movement driving member rotating shaft 132, the width direction movement driving gear 133 and the width direction movement driven gear 134. Therefore when the width direction movement driving motor MA11 is rotated in the normal or the reverse direction, the width direction movement rack gears 137, 138 are moved in the opposite direction from each other in the longitudinal direction. Therefore, according to the movements of the width direction movement rack gears 137, 138, the front side medium bundle stapling member 137+141 to 147 and the rear side medium bundle stapling member 138+151 to 157 are moved in the directions so that they can come close to and separated from each other, that is, the front side medium bundle stapling member 137+141 to 147 and the rear side medium bundle stapling member 138+151 to 157 are moved in the width direction of the recording sheet bundle S1.

That is, in Example 1, according to the width of the recording sheet bundle S1, a width from the inside face of the front wall portion 142*b* to the inside face of the rear wall portion 152*b* is adjusted so that the width direction movement stacking portions 142, 152 can be made to come close to each other. In this way, the stapling members are freely moved between the medium bundle supporting position of supporting the recording sheet bundle S1 on the medium bundle supporting faces 142*d*, 152*d* and the medium bundle dropping position at which the recording sheet bundle S1 is not supported but dropped onto the stacker tray TH1 when the width direction movement stacking portions 142, 152 are separated from each other.

In this connection, in Example 1, according to the amount of rotation of the width direction movement driving motor MA11, an interval between the inside faces of the wall portions 142*b*, 152*b* becomes the width of the recording sheet bundle S1. Therefore, the recording sheet bundle S1 can be moved to the first stapling position at which the recording sheet bundle S1 is supported on the entire faces of the medium bundle supporting faces 142*d*, 152*d* and to the second stapling position shown in FIG. 11 at which the width direction movement stacking portions 142, 152 are separate from each other compared with the first stapling position and the recording sheet bundle S1 is supported by portions of the medium bundle supporting faces 142*d*, 152*d*. In this connection, in Example 1, the second stapling position sown in FIG. 11 is previously set in such a manner that the width is wider than the staple width of the staple in the width direction of the recording sheet bundle S1 as compared with the first stapling position shown in FIG. 10.

The moving type medium bundle stapling member 161 includes members attached with the reference marks MA11, 131 to 157.

(Explanations of Control Portion of Example 1)

Figure 13:
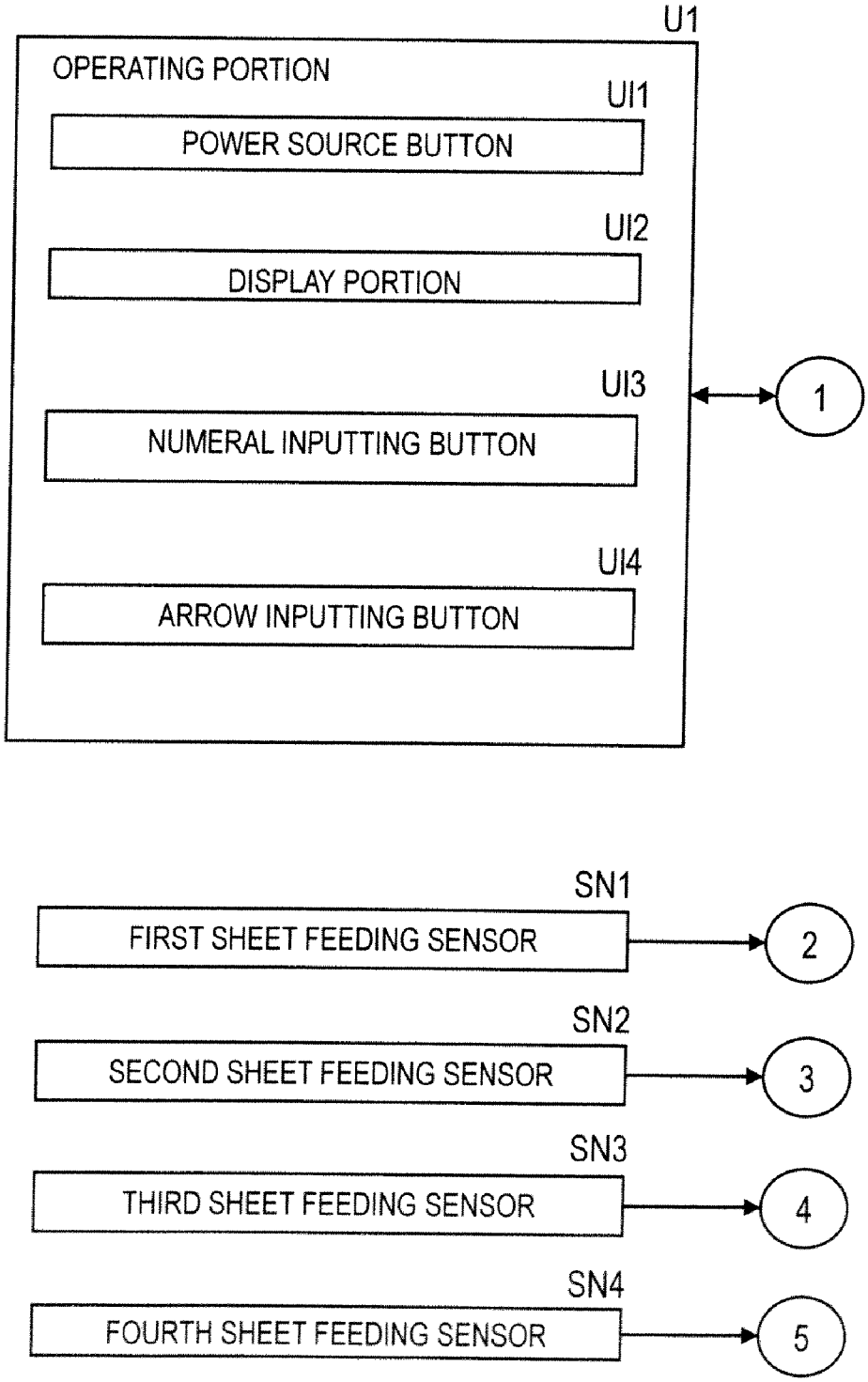
FIG. 13 is a functional diagram of the control portion of the image forming apparatus of Example 1 of the present invention, that is.
Figure 13:
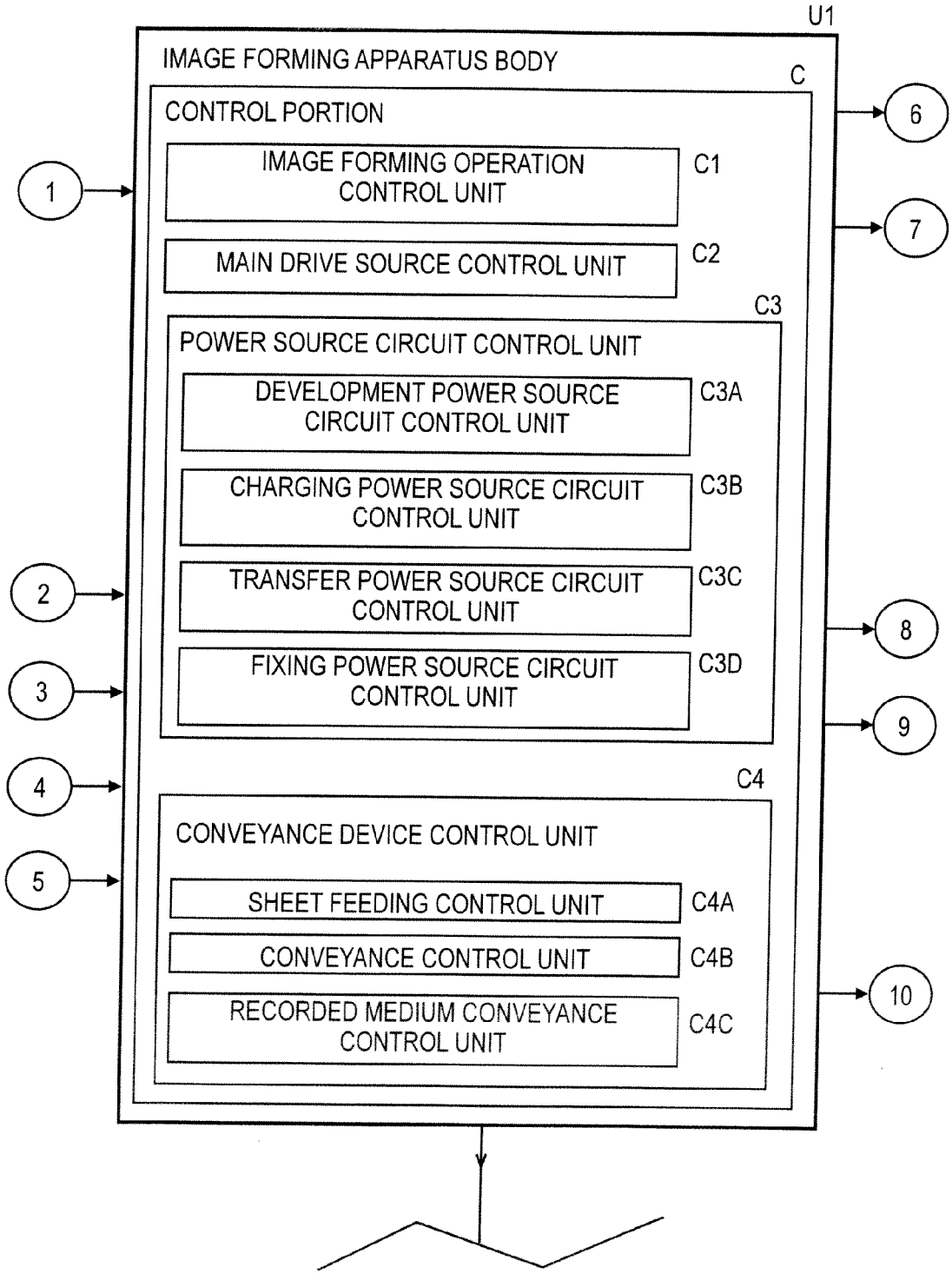
Figure 13:
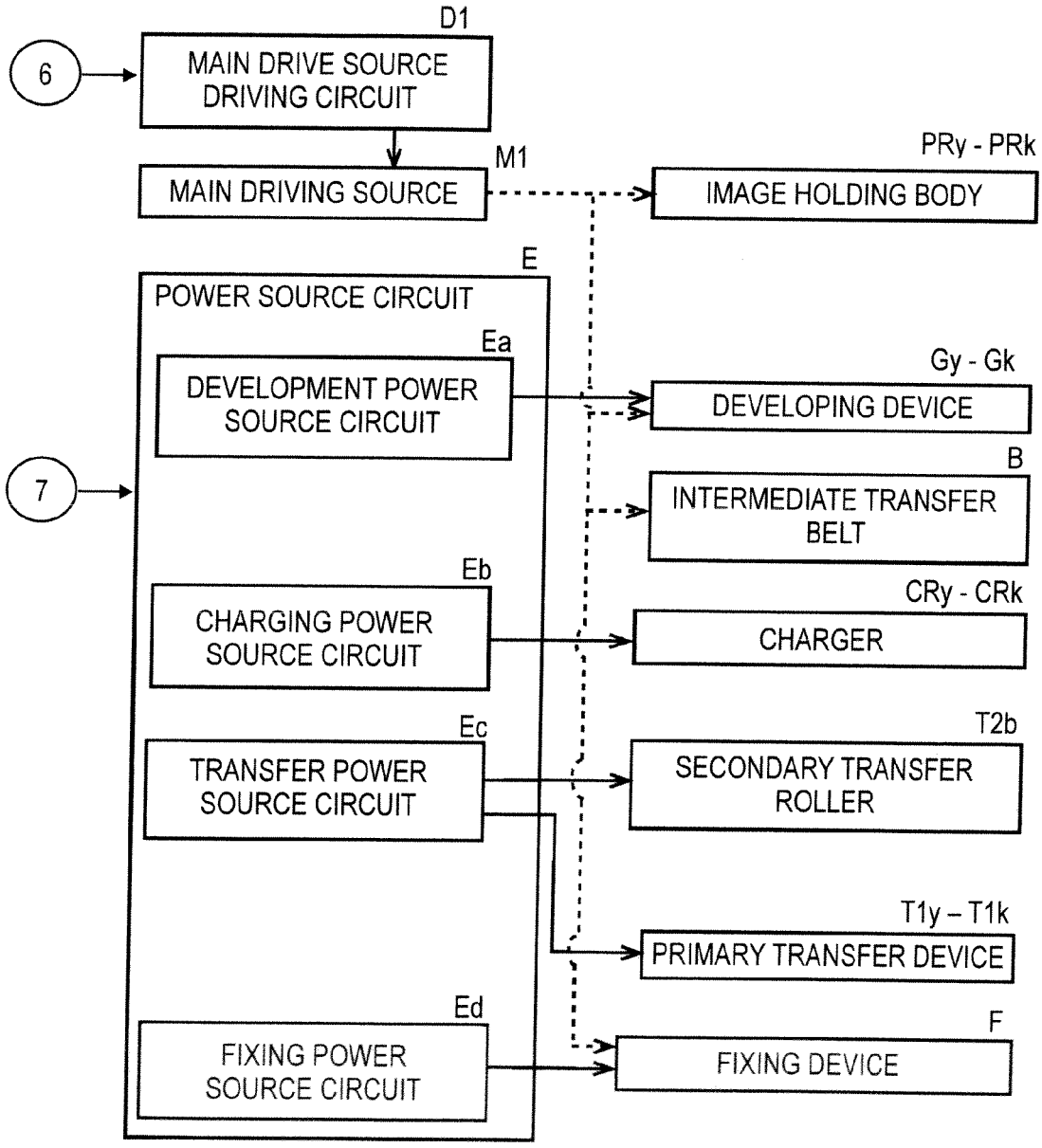
Figure 13:
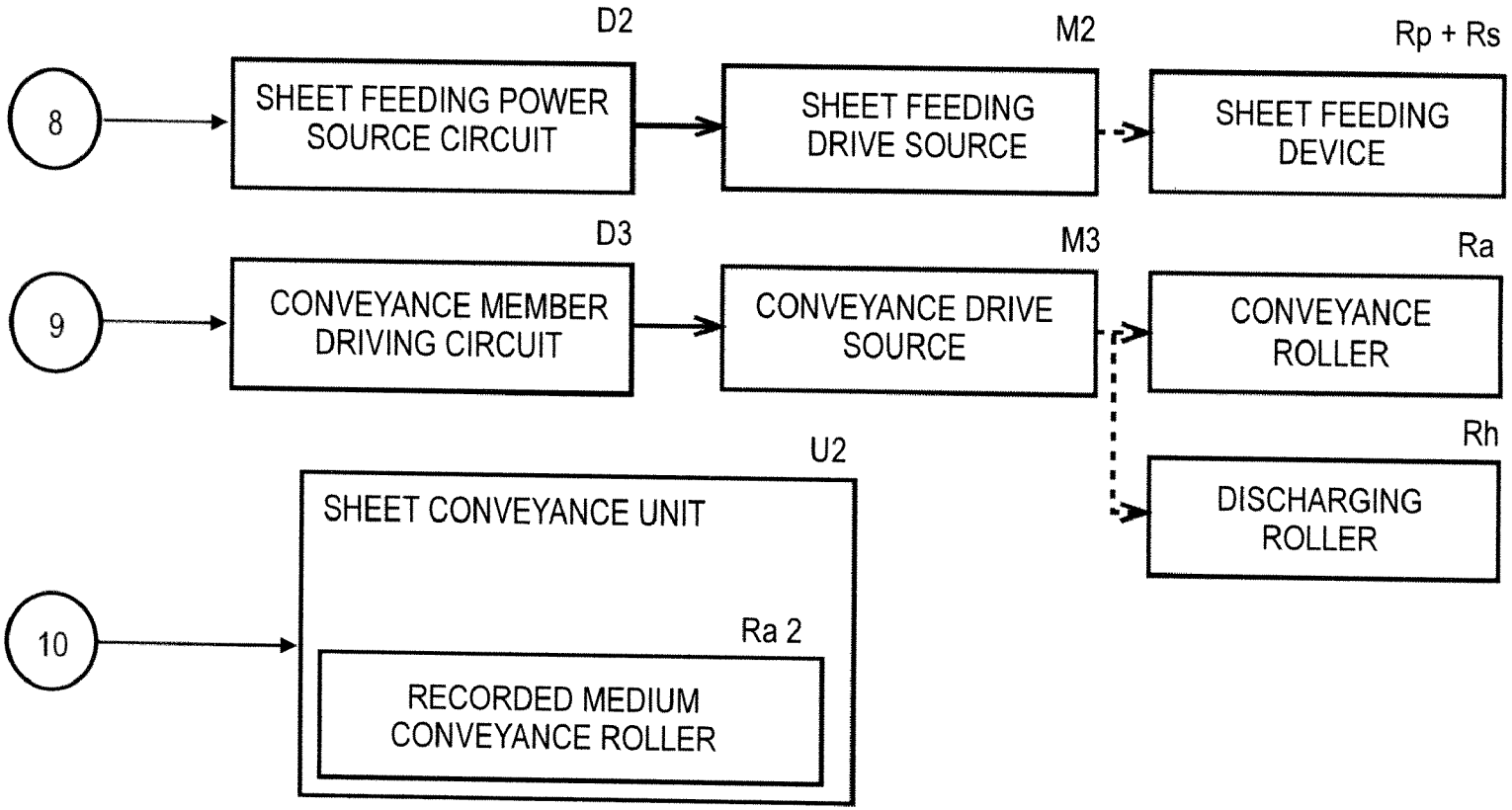

FIG. 13 is a functional diagram of the control portion of the image forming apparatus of Example 1 of the present invention, that is, FIG. 13 is a so-called block diagram.

Figure 14:
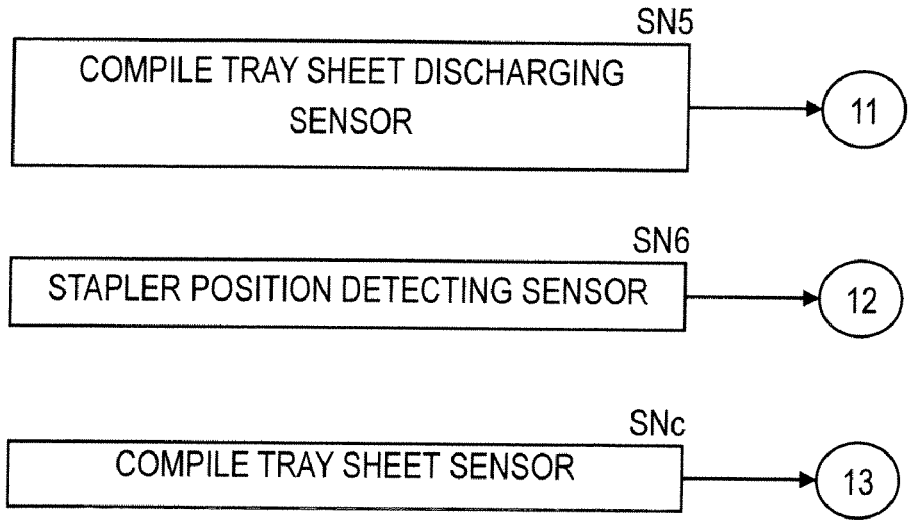
FIG. 14 is a block diagram continuing to FIG. 13.
Figure 14:
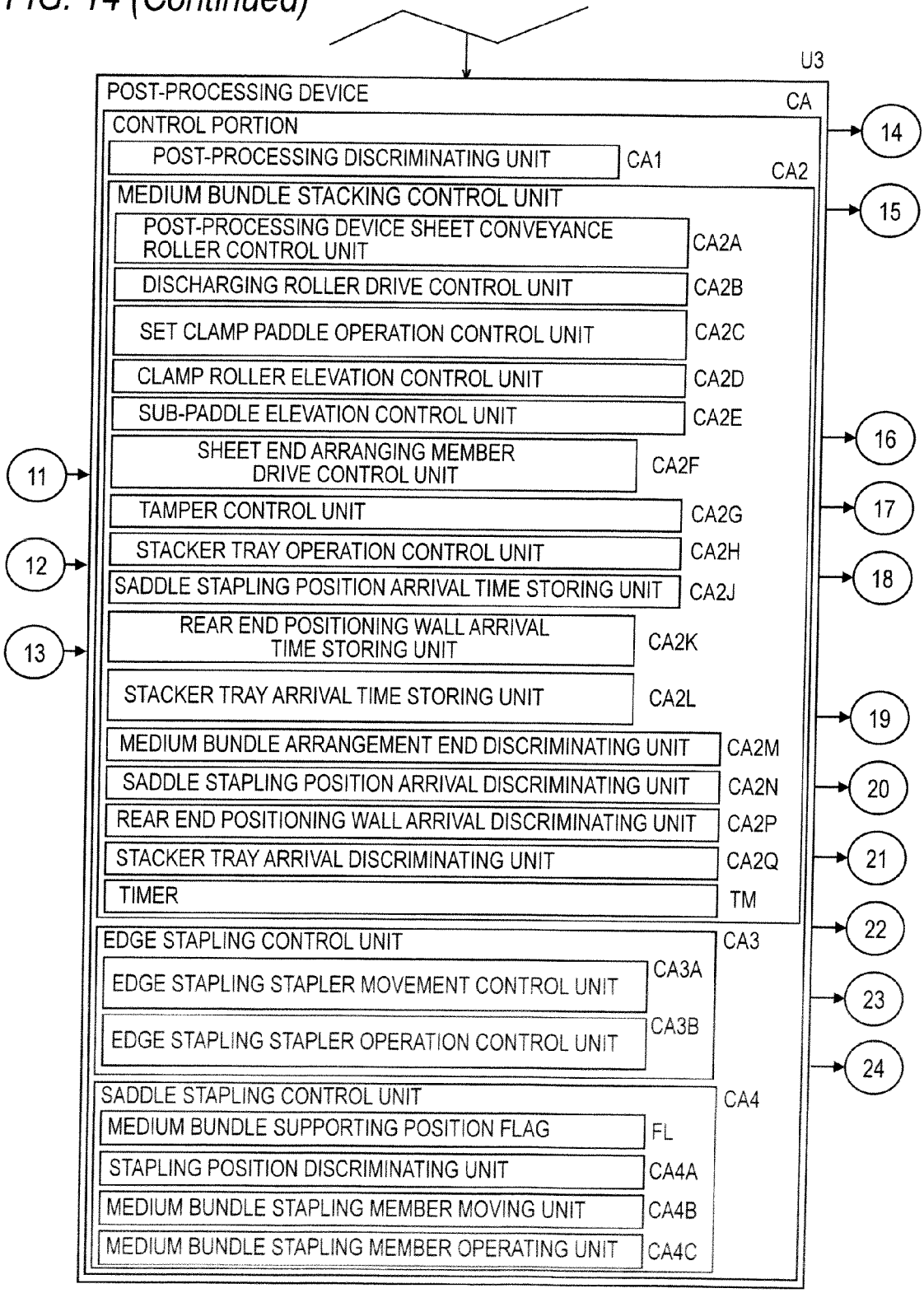
Figure 14:
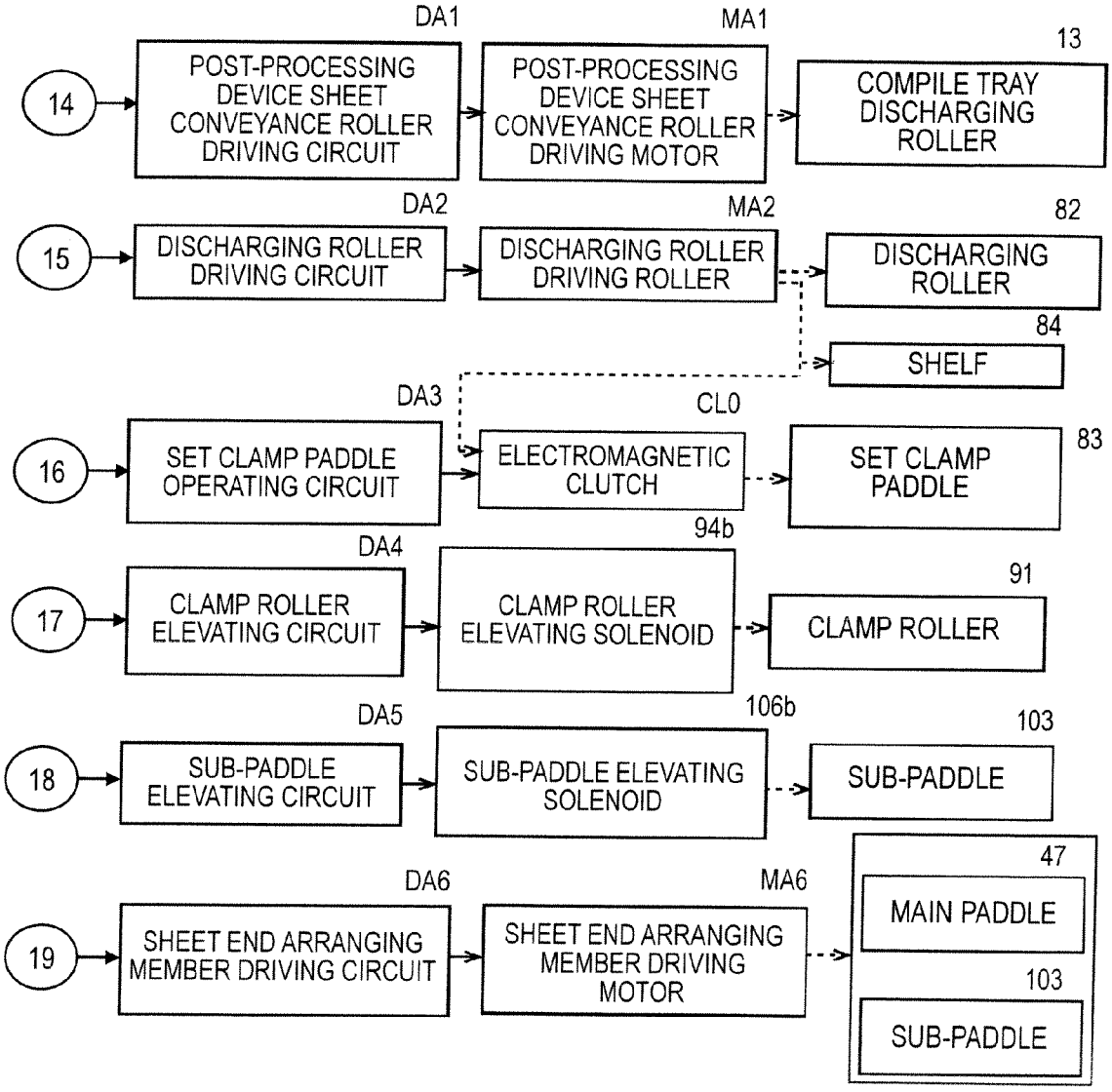
Figure 14:
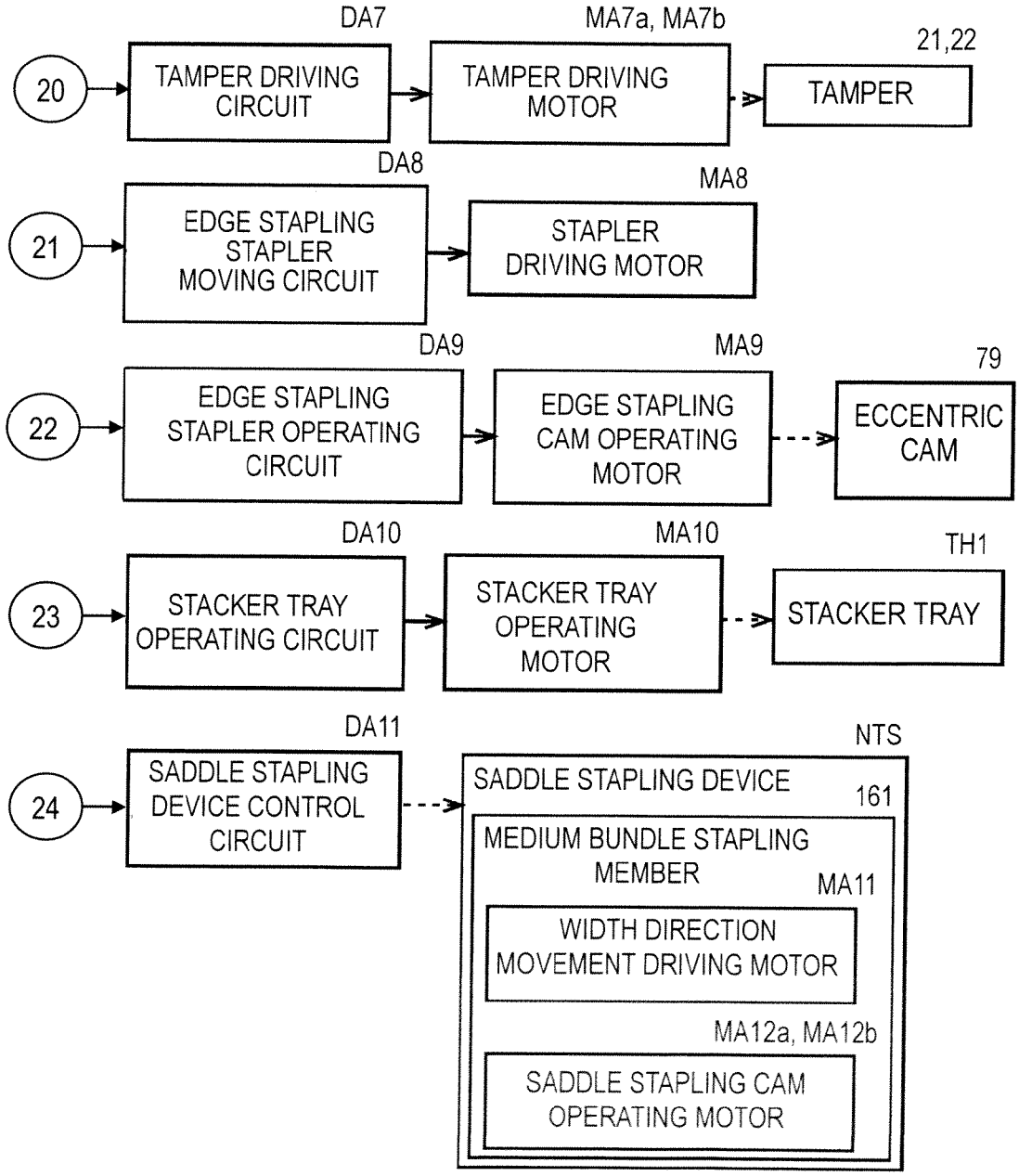

FIG. 14 is a block diagram continuing to FIG. 13.

In FIGS. 13 and 14, the control portion C of the image forming apparatus body U1 and the control portion CA of the post-processing device U3 include: an input and output interface I/O for inputting and outputting a signal with respect to the outside; a ROM (Read Only Memory) in which a program and information for executing a necessary processing are stored; a RAM (Random Access Memory) for temporarily storing necessary data; a CPU (Central Processing Unit) for executing processing corresponding to the program stored in ROM; and a small information processing device (Microcomputer) having an oscillator. When the program stored in ROM is carried out, the control portion can realize various functions.

(Signal Outputting Element Connected to Control Portion C of Image Forming Apparatus Body U1)

Outputting signals are inputted into the control portion C of the image forming apparatus body U1 from the signal outputting elements such as an operating portion U1, a first sheet feeding passage sensor SN1, a second sheet feeding passage sensor SN2, a third sheet feeding passage sensor SN3 and a fourth sheet feeding passage sensor SN4.

The operating portion U1 includes: a power source button U11; a display portion U12; a numeral inputting button U13; and an arrow inputting button U14.

The sensors SN1 to SN4 detect whether or not a recording sheet S is existing at positions where the sensors SN1 to SN4 are arranged.

(Controlled Elements Connected to Control Portion C of Image Forming Apparatus Body U1)

The control portion C of the image forming apparatus body U1 is connected to a main drive source driving circuit D1, a power source circuit E, a sheet feeding device driving circuit D2, a conveyance member driving circuit D3 and other control elements not shown in the drawing. Therefore, the control portion C outputs operation control signals outputted from those components.

The main drive source driving circuit D1 drives and rotates the image holding bodies PRy to PRk and the intermediate transfer belt B through the main drive source M1.

The power source circuit E includes: a power source circuit Ea for development; a power source circuit Eb for charging; a power source circuit Ec for transfer; and a power source circuit Ed for fixing.

The power source circuit Ea for development applies a development voltage to the developing rollers of the developing devices Gy to Gk.

The power source circuit Eb for charging applies a charging voltage to the respective chargers CRy to CRk so that surfaces of the image holding bodies PRy to PRk can be charged.

The power source circuit Ec for transfer applies a transfer voltage to the primary transfer devices T1*y* to T1*k* and the secondary transfer roller T2*b*.

The power source circuit Ed for fixing supplies electric power for heating a heater to the heating roller Fh of the fixing device F.

The sheet feeding device driving circuit D2 drives the sheet feeding devices Rp+Rs through the drive source M2 for feeding sheets.

The conveyance member driving circuit D3 drives the conveyance roller Ra and the sheet discharging roller Rh through the driving source M3 for conveyance.

(Function of Control Portion C of Image Forming Apparatus Body U1)

The control portion C of the image forming apparatus body U1 has a function of carrying out processing corresponding to an input signal sent from the signal output element and also has a function of outputting a control signal to each control element described before. That is, the control portion C of the image forming apparatus body U1 has the following functions.

C1: Image Forming Action Control Unit

The image forming action control unit C1 controls a drive of each member of the printer U according to the image information inputted from the information processing device PC and also controls the time of applying the voltage to each component. In this way, a job, which is an image forming action, is carried out. In this connection, the image information of Example 1 includes post-processing setting information such as "No post-processing", "No stapling (Only arranging)", "Saddle stapling", "Corner stapling" and "Side edge stapling". The image information of Example 1 also includes information of the number of sheets carried out in the post-processing.

C2: Main Drive Source Control Unit

The main drive source control unit C2 controls driving of the main driving source M1 through the main drive source driving circuit D1 and also controls driving of the image holding bodies PRy to PRk.

C3: Power Circuit Control Unit

The power circuit control unit C3 includes: a power source circuit control unit C3A for development: a power source circuit control unit C3B for charging: a power source circuit control unit C3C for transfer; and a power source circuit control unit C3D for fixing, wherein the power circuit control unit C3 controls operation of the power source circuit so as to control voltage to be applied to each component and so as to control supply of power to each component.

C3A: Power Source Circuit Control Unit for Development

The power source circuit control unit C3A for development controls the power source circuit Ea for development and controls a developing voltage to be applied to the developing rollers of the developing devices Gy to Gk.

C3B: Power Source Circuit Control Unit for Charging

The power source circuit control unit C3B for charging controls the power source circuit Eb for charging and controls a charging voltage to be applied to the chargers CRy to CRk.

C3C: Power Source Circuit Control Unit for Transfer

The power source circuit control unit C3C for transfer controls the power source circuit Ec for transfer so as to control the primary transfer voltage applied to the primary transfer devices T1*y* to T1*k* and to control the secondary transfer voltage applied to the secondary transfer roller T2*b*.

C3D: Power Source Circuit Control Unit for Fixing

The power source circuit control unit C3D for fixing controls the power source circuit Ed for fixing and controls a temperature of the heater of the heating roller Fh of the fixing device F, that is, the power source circuit control unit C3D for fixing controls a fixing temperature.

C4: Conveyance Device Control Unit

The conveyance member control unit C4 includes: a sheet feeding control unit C4A; a conveyance control unit C4B: and a recorded medium conveyance control unit C4C. At the time of image forming operation, the conveyance member control unit C4 controls operation of the medium conveyance devices SH+Ra to Rh according to the designation of two-sided-printing with respect to the recording sheet S and according to the setting of the discharging trays TRh, TRh2, TRh3. In this way, the conveyance member control unit C4 controls operation of the conveyance members Rp, Rs, Ra, Rh so as to control the conveyance of the recording sheet S.

C4A: Sheet Feeding Control Unit

The sheet feeding control unit C4A controls driving of the drive source M2 for feeding sheets through the sheet feeding device driving circuit D2 so as to control feeding of the recording sheet S executed by the sheet feeding device Rp+Rs.

C4B: Conveyance Control Unit

The conveyance control unit C4B controls driving of the drive source M3 for conveyance through the conveyance member driving circuit D3 so as to control conveyance of the recording sheet S executed by the conveyance roller Ra and the sheet discharging roller Rh.

C4C: Recorded Medium Conveyance Control Unit

The recorded medium conveyance control unit C4C controls the sheet conveyance unit U2 so as to control the conveyance of the recording sheet S, on which an image has already been recorded executed by the recorded medium conveyance roller Ra2.

(Signal Outputting Element Connected to Control Portion CA of Post-processing Device U3)

Output signals sent from the signal output elements such as a compile tray sheet discharging sensor SN5, a stapler position detection sensor SN6 and a compile tray sheet sensor SNc are inputted into the control portion CA of the post-processing device U3.

SN5: Compile Tray Sheet Discharging Sensor

The compile tray sheet discharging sensor SN5 detects that a forward end portion of the recording sheet S discharged onto the compile tray 14 has passed through.

SN6: Stapler Position Detecting Sensor

The stapler position detecting sensor SN6 detects that shading has been executed by the stapling position shading portion 63 or the home position shading portion 64.

SNc: Compile Tray Sheet Sensor

The compile tray sheet sensor SNc detects whether or not the sheet S is accommodated in the compile tray 14.

(Controlled Element Connected to Control Portion CA of Post-processing Device U3)

The control portion C of the image forming apparatus body U1 is connected to an post-processing device sheet conveyance roller driving circuit DA1, a discharging roller driving circuit DA2, a set clamper paddle operating circuit DA3, a clamp roller elevating circuit DA4, a sub-paddle elevating circuit DA5, a sheet end arranging member driving circuit DA6, a tamper driving circuit DA7, an edge stapling stapler moving circuit DA8, an edge stapling stapler operating circuit DA9, a stacker tray operating circuit DA10, an saddle stapling device control circuit DA11, and other control elements not shown in the drawing. The control portion C of the image forming apparatus body U1 outputs operation control signals to those components.

DA1: Post-Processing Device Sheet Conveyance Roller Driving Circuit

The post-processing device sheet conveyance roller driving circuit DA1 controls the post-processing device sheet conveyance roller driving motor MA1 and drives the sheet conveyance roller such as a compile tray discharging roller 13.

DA2: Discharging Roller Driving Circuit

The discharging roller driving circuit DA2 controls a normal and a reverse rotation of the discharging roller driving motor MA2 so as rotate the discharging roller 82 in the normal or the reverse direction. Further, the discharging roller driving circuit DA2 moves the shelf 84 between the sheet lower face supporting position shown in FIG. 3 and the accommodating position shown in FIG. 4.

DA3: Set Clamp Paddle Operating Circuit

The set clamp paddle operating circuit DA3 controls turning on and off of the electromagnetic clutch CL0 so as to move the set clamp paddle 83 between the sheet clamp position shown in FIG. 3 and the sheet lower face supporting position shown in FIG. 4.

DA4: Clamp Roller Elevating Circuit

The clamp roller elevating circuit DA4 controls turning on and off of the clamp roller elevating solenoid 94*b* so as to move the clamp roller 91 between the waiting position shown by the solid line in FIG. 3 and the clamp position shown by the broken line in FIG. 3.

DA5: Sub-paddle Elevating Circuit

The sub-paddle elevating circuit DA5 controls turning on and off of the sub-paddle elevating solenoid 106*b* so as to move the sub-paddle 103 between the waiting position shown by the solid line in FIG. 4 and the sheet drawing position shown by the broken line in FIG. 4.

DA6: Sheet End Arranging Member Driving Circuit

The sheet end arranging member driving circuit DA6 controls a rotation of the sheet end arranging member driving motor MA6 so as to rotate or stop the main paddle 47 and the sub-paddle 103.

DA7: Tamper Driving Circuit

The tamper driving circuit DA7 controls a normal and a reverse rotation of the tamper driving motors MA7*a*, MA7*b* so as to operate the tamper 21, 22.

DA8: Edge Stapling Stapler Moving Circuit

The edge stapling stapler moving circuit DA8 controls a normal and a reverse rotation of the stapler driving motor MA8 and moves the carriage 71 and the stapler body 76.

DA9: Edge Stapling Stapler Operating Circuit

The edge stapling stapler operating circuit DA9 controls the edge stapling cam operating motor MA9 so as to rotate the eccentric cam 79 and drive out a staple 77 from the staple driving portion 76*a* and staple the recording sheet bundle S1.

DA10: Stacker Tray Operating Circuit

The stacker tray operating circuit DA10 controls the stacker tray operating motor MA10 so as to elevate the stacker tray TH1.

DA11: Saddle Stapling Device Control Circuit

The saddle stapling device control circuit DA11 controls a normal and a reverse rotation of the width direction movement driving motor MA11 so as to move the medium bundle stapling member 161 in the width direction. The saddle stapling device control circuit DA11 also controls the saddle stapling cam operating motors MA12*a*, MA12*b* so as to rotate eccentric cams not shown and drive out a staple from each width direction moving staple driving portion 147, 157 and staple the recording sheet bundle S1. In this way, the saddle stapling device control circuit DA11 executes the saddle stapling processing for the recording sheet bundle S1.

(Function of Control Portion CA of Post-processing Device U3)

The control portion CA of the post-processing device U3 has a function of carrying out processing according to an input signal sent from the signal output element and a function of outputting a control signal to the control elements described before. That is, the control portion CA has the following functions.

CA1: Post-processing Discriminating Unit

The post-processing discriminating unit CA1 discriminates whether the post-processing carried out by the post-processing device U3 is "No post-processing", "No stapling (Only arranging)", "Saddle stapling", "Corner stapling" or "Side edge stapling" according to the image information received by the image forming operation control unit C1.

CA2: Medium Bundle Stacking Control Unit

The Medium bundle stacking control unit CA2 includes the unit CA2A to CA2Q and the timer TM and controls each component of the post-processing device U3 so as to stack the recording sheets S on the stacker tray TH1. In the case where the post-processing discriminated by the post-processing discriminating unit CA1 is "No post-processing", that is, in the case where the post-processing is not carried out, the medium bundle stacking control unit CA2 of Example rotates the discharging roller 82 in the normal direction so as to stack the recording sheets S on the stacker tray TH1. In the case where the post-processing discriminated by the post-processing discriminating unit CA1 is "No stapling (Only arranging)", "Saddle stapling", "Corner stapling" and "Side edge stapling", the medium bundle stacking control unit CA2 rotates the discharging roller 82 in the normal and the reverse direction so as to stack the recording sheets S on the compile tray 14 and to execute the post-processing such as an arranging processing. Then, the recording sheet bundle S1, which has been subjected to the post-processing, is stacked on the stacker tray.

CA2A: Post-processing Device Sheet Conveyance Roller Control Unit

The post-processing device sheet conveyance roller control unit CA2A controls driving of the sheet conveyance rollers such as a compile tray discharging roller 13 through the post-processing device sheet conveyance roller driving circuit DA1 synchronously when the sheet is carried into the post-processing device U3. In this way, the post-processing device sheet conveyance roller control unit conveys the recording sheet S.

CA2B: Discharging Roller Drive Control Unit

The discharging roller drive control unit CA2B controls the discharging roller driving circuit DA2 so as to rotate the discharging roller 82 in the normal and the reverse direction. In this way, the recording sheet bundle S1 is discharged onto the stacker tray TH1, the recording sheet bundle S1 is conveyed to the saddle stapling position where the saddle stapling device NTS executes the saddle stapling processing, the recording sheet S or the recording sheet bundle S1 is drawn in onto the rear end positioning wall 41*a* side of the compile tray 14 and the shelf 84 is moved between the accommodating position and the sheet lower face supporting position. In this connection, in the case where the recording sheet bundle S1, which has been arranged or stapled on the compile tray 14, is discharged onto the stacker tray TH1, the discharging roller driving control unit CA2B of Example 1 rotates the discharging roller 82 in the normal direction and moves the shelf 84 to the accommodating position shown in FIG. 4.

When the first recording sheet S is discharged onto the compile tray 14 under the condition that no sheets are stacked on the compile tray 14, the discharging roller driving control unit CA2B rotates the discharging roller 82 in the normal direction. When the discharged recording sheet S is drawn onto the rear end positioning wall 41*a* side, the discharging roller driving control unit CA2B rotates the discharging roller 82 in the reverse direction so as to draw the recording sheet and moves the shelf 84 to the sheet lower face supporting position shown in FIG. 3.

In the case where the saddle stapling processing is carried out after the saddle stapling device NTS has been optionally attached to the post-processing device U3, by the discharging roller driving control unit CA2B, the discharging roller 82 is rotated in the normal direction before the recording sheet bundle S1 is discharged onto the stacker tray TH1 and the recording sheet bundle S1 arranged on the compile tray 14 is conveyed to the saddle stapling position shown in FIG. 10. After the saddle stapling processing has been carried out, the discharging roller 82 is rotated in the reverse direction so as to draw in the recording sheet bundle S1, which has been subjected to the saddle stapling processing, onto the compile tray 14 again.

CA2C: Set Clamp Paddle Operation Control Unit

The set clamp paddle operation control unit CA2C turns on and off the electromagnetic clutch CL0 through the set clamp paddle operating circuit DA3 and moves the set clamp paddle 83 between the sheet clamp position shown in FIG. 3 and the sheet lower face supporting position shown in FIG. 4. Under the condition that the shelf 84 is moved to the sheet lower face supporting position, the set clamp paddle operation control unit CA2C holds the set clamp paddle 83 at the sheet clamp position. The set clamp paddle operation control unit CA2C moves the set clamp paddle 83 to the sheet lower face supporting position synchronously when a rear end of the recording sheet bundle S1 discharged onto the stacker tray TH1 passes through the discharging roller 82. Further, the set clamp paddle operation control unit CA2C moves the set clamp paddle 83 to the sheet clamp position synchronously when the next first recording sheet is carried into the compile tray 14 and drawn onto the main paddle 47 side after the discharge of the recording sheet bundle S1.

CA2D: Clamp Roller Elevating Control Unit

The clamp roller elevating control unit CA2D turns on and off the clamp roller elevating solenoid 94*b* through the clamp roller elevating circuit DA6 so as to move the clamp roller 91 between the waiting position and the clamp position at the time of discharging the recording sheet bundle S1 onto the stacker tray TH1, at the time of conveying the recording sheet bundle S1 to the saddle stapling position where the saddle stapling device NTS executes the saddle stapling processing and at the time of drawing the recording sheet S or the recording sheet bundle S1 onto the rear end positioning wall 41*a* of the compile tray 14.

CA2E: Sub-paddle Elevating Control Unit

The sub-paddle elevating control CA2E unit turns on and off the sub-paddle elevating solenoid 106*b* through the sub-paddle elevating circuit DA5 so as to move the sub-paddle 103 between the waiting position and the sheet drawing position at the time of carrying in the recording sheet S onto the compile tray 14.

CA2F: Sheet End Arranging Member Drive Control Unit

The sheet end arranging member drive control unit CA2F controls a rotation of the sheet end arranging member driving motor MA6 through the sheet end arranging member driving circuit DA6 so as to rotate and stop the main paddle 47 and the sub-paddle 103.

CA2G: Tamper Control Unit

The tamper control unit CA2G, which is an example of the medium bundle movement control unit, controls a normal and a reverse rotation of each tamper driving motor MA7*a*, MA7*b* through the tamper driving circuit DA7 according to a size of the recording sheet S carried in onto the compile tray 14 so as to operate the tamper 21, 22 and arrange the side edge of the recording sheet bundle S1 carried in onto the compile tray 14. Each time one recording sheet S is carried in onto the compile tray 14, the tamper control unit CA2G of Example 1 operates the tampers 21, 22 so that the side edge of the recording sheet bundle S1 can be arranged. In this connection, the tamper control unit CA2G of Example 1 operates the tampers 21, 22 so that a central portion in the width direction of the recording sheet bundle S1 shown in FIG. 18 described later can be stacked at the first stacking position located in the central portion in the width direction of the compile tray 14.

CA2H: Stacker Tray Operation Control Unit

The stacker tray operation control unit CA2H controls driving of the stacker tray operation motor MA10 through the stacker tray operation circuit DA10 so as to elevate the stacker tray TH1 according to an amount of recording sheet bundle S1 stacked on the stacker tray TH1.

CA2J: Saddle stapling Position Arriving Time Storing Unit

The saddle stapling position arriving time storing unit CA2J stores the saddle stapling position arriving time T1 from when the rear end in the conveyance direction of the recording sheet bundle S1 is arranged on the rear end positioning wall 41*a* by the normal rotation of the discharging roller 82 to when the recording sheet bundle S1 is conveyed to the saddle stapling position shown in FIG. 10.

CA2K: Rear End Positioning Wall Arriving Time Storing Unit

The rear end positioning wall arriving time storing unit CA2K stores the rear end positioning wall arriving time T1 from when the recording sheet bundle S1 is at the saddle stapling position to when the rear end in the conveyance direction of the recording sheet bundle S1 collides with the rear end positioning wall 41*a* again by a reverse rotation of the discharging roller 82.

CA2L: Stacker Tray Arriving Time Storing Unit

The stacker tray arriving time storing unit CA2L, which is an example of the medium bundle stacking portion arriving time storing unit, stores the stacker tray arriving time T3 which is an example of the medium bundle stacking portion arriving time from when the rear end in the conveyance direction of the recording sheet bundle S1 collides with the rear end positioning wall 41*a* by a normal rotation of the discharging roller 82 to when the recording sheet bundle S1 drops onto the stacker tray TH1 and stacked.

CA2M: Medium Bundle Arranging Finish Discriminating Unit

The medium bundle arranging finish discriminating unit CA2M discriminates whether or not the arranging of the recording sheet bundle S1 by the compile tray 14 has been finished. The medium bundle arranging finish discriminating unit CA2M of Example 1 counts the number of the recording sheets S stacked on the compile tray 14 and discriminates whether or not the recording sheet bundle S1, the number of recording sheets of which is the same as that of the recording sheets to be processed, is stacked on the compile tray 14. Due to the foregoing, it is discriminated whether or not the arranging of the recording sheet bundle S1 has been finished.

TM: Timer

In the case where "Saddle stapling", which is the post-processing, is carried out, the timer TM checks the time T1 to T3 in which the arranged recording sheet bundle S1 is subjected to the saddle stapling and stacked on the stacker tray TH1.

CA2N: Saddle stapling Position Arrival Discriminating Unit

The saddle stapling position arrival discriminating unit CA2N discriminates whether or not the time is up in the timer TM in which the saddle stapling position arriving time T1 is set. Due to the foregoing, it is discriminated whether or not the recording sheet bundle S1, which was arranged on the compile tray 14, has been conveyed to the saddle stapling position.

CA2P: Rear End Positioning Wall Arrival Discriminating Unit

The rear end positioning wall arrival discriminating unit CA2P discriminates whether or not the time is up in the timer TM in which the rear end positioning wall arriving time T2 is set. Due to the foregoing, it is discriminated whether or not the recording sheet bundle S1, which was subjected to the saddle stapling, has been conveyed from the saddle stapling position to the position where the rear end in the conveyance direction of the recording sheet bundle S1 collides with the rear end positioning wall 41*a* again.

CA2Q: Stacker Tray Arrival Discriminating Unit

The stacker tray arrival discriminating unit CA2Q, which is an example of the medium bundle stacking portion arrival discriminating unit, discriminates whether or not the time is up in the timer TM in which the stacker tray arriving time T3 is set. Due to the foregoing, it is discriminated whether or not the recording sheet bundle S1 is dropped and stacked on the stacker tray TH1 from the state in which the rear end in the sheet conveyance direction of the recording sheet bundle S1, which has been subjected to the saddle stapling collides with the rear end positioning wall 41*a*.

CA3: Edge stapling Control Unit

The edge stapling control unit CA3 includes: an edge stapling stapler movement control unit CA3A; and an edge stapling stapler operation control unit CA3B. In the case where the post-processing discriminated by the post-processing discriminating unit CA1 is "Corner stapling" and "Side edge stapling", the edge stapling control unit CA3 moves the moving staple member 70 and carries out the edge stapling for stapling the recording sheet bundle S1.

CA3A: Edge stapling Stapler Movement Control Unit

The edge stapling stapler movement control unit CA3A controls a rotation of the staple driving motor MA8 through the edge stapling stapler moving circuit DA8 so as to move the moving staple member 70 to the home position shown by the one-dotted chain line shown in FIG. 6 and to the stapling position shown by the solid line or the two-dotted chain line in FIG. 6. The edge stapling stapler movement control unit CA3A of Example 1 moves the moving staple member 70 to a stapling position corresponding to "Corner stapling" or "Side edge stapling" which is the post-processing.

CA3B: Edge Stapling Stapler Operation Control Unit

The edge stapling stapler operation control unit CA3B controls a rotation of the edge stapling cam operating motor MA9 through the edge stapling stapler operating circuit DA9 so as to rotate the eccentric cam 79 and to staple the recording sheet bundle S when the staple 77 is driven out from the staple driving portion 76*a*.

CA4: Saddle Stapling Control Unit

The saddle stapling control unit CA4, which is an example of the medium bundle stapling member control unit, includes: a medium bundle supporting position flag FL; a stapling position discriminating unit CA4A; a medium bundle stapling member moving unit CA4B; and a medium bundle stapling member operating unit CA4C. In the case where the post-processing discriminated by the post-processing discriminating unit CA1 is "Saddle stapling", the saddle stapling control unit CA4 moves the medium bundle stapling member 161 in the width direction. At the same time, staples are driven out from the width direction moving staple driving portions 147, 157 and the recording sheet bundle S1 is stapled. In this way, the saddle stapling processing of the recording sheet bundle S1 is carried out.

FL: Medium Bundle Supporting Position Flag

An initial value of the medium bundle supporting position flag FL, which is an example of the medium bundle supporting position discriminating value, is "0". Each time the saddle stapling processing is carried out, the medium bundle supporting position flag FL becomes "1", "0", "1", . . . . That is, it is alternately changed between "0" and "1".

CA4A: Stapling Position Discriminating Unit

The stapling position discriminating unit CA11A discriminates whether a stapling position in the width direction of the recording sheet bundle S1 at the time of carrying out the saddle stapling processing is the first stapling position shown in FIG. 10 or the second stapling position shown in FIG. 11. In the case where the medium bundle supporting position flag FL is "0", the stapling position discriminating unit CA11A of Example 1 discriminates that it is the first stapling position. In the case where the medium bundle supporting position flag FL is "1", the stapling position discriminating unit CA11A of Example 1 discriminates that it is the second stapling position.

CA4B: Medium Bundle Stapling Member Moving Unit

The medium bundle stapling member moving unit CA4B moves the medium bundle stapling member 161 in the width direction through the saddle stapling device control circuit DA11. The medium bundle stapling member moving unit CA4B of Example 1 controls a normal and a reverse rotation of the width direction moving driving motor MA11 through the saddle stapling device control circuit DA11 so as to rotate the members 132 to 136 described before. Further, the medium bundle stapling member moving unit CA4B moves the width direction moving rack gears 137, 138 in the longitudinal opposite direction to each other so that the front side medium bundle stapling members 137+141 to 147 and the rear side medium stapling members 138+151 to 157 can be moved in the direction in which the members come close to each other and separate from each other, that is, in the width direction of the recording sheet bundle S1. In this connection, in the medium bundle stapling member moving unit CA4B, in the case where the saddle stapling processing is executed, the medium bundle stapling member 161 is moved to the first stapling position corresponding to the sheet width of the recording sheet bundle S1 shown in FIG. 10 or to the second stapling position wider than the sheet width of the recording sheet bundle S1 shown in FIG. 11. In the case where the recording sheet bundle S1 is discharged onto the stacker tray TH1, the medium bundle stapling member 161 is moved to the medium bundle dropping position shown in FIG. 12.

CA4C: Medium Bundle Stapling Member Operating Unit

The medium bundle stapling member operating unit CA4C rotates the saddle stapling cam operating motors MA12*a*, MA12*b* through the saddle stapling device control circuit DA11 in the same manner as that of the edge stapling stapler operating control unit CA3B described before so as to rotate an eccentric cam not shown in the drawing and drives out staples from the width direction moving staple driving portions 147, 157. In this way, the recording sheet bundle S1 is stapled.

(Explanations of Flow Chart of Example 1)

Next, a flow of control executed in the printer U of Example 1 will be explained referring to a flow chart. In this connection, the arranging processing of arranging the recording sheet bundle S1 on the compile tray 14 in the medium bundle stacking control unit C2 in Example 1 and the edge stapling processing executed by the edge stapling control unit C3 are known, the illustration and the detailed explanations are omitted here for simplification.

(Explanations of Flow Chart of Medium Bundle Stacking Control Processing at Time of Saddle Stapling)

Figure 15:
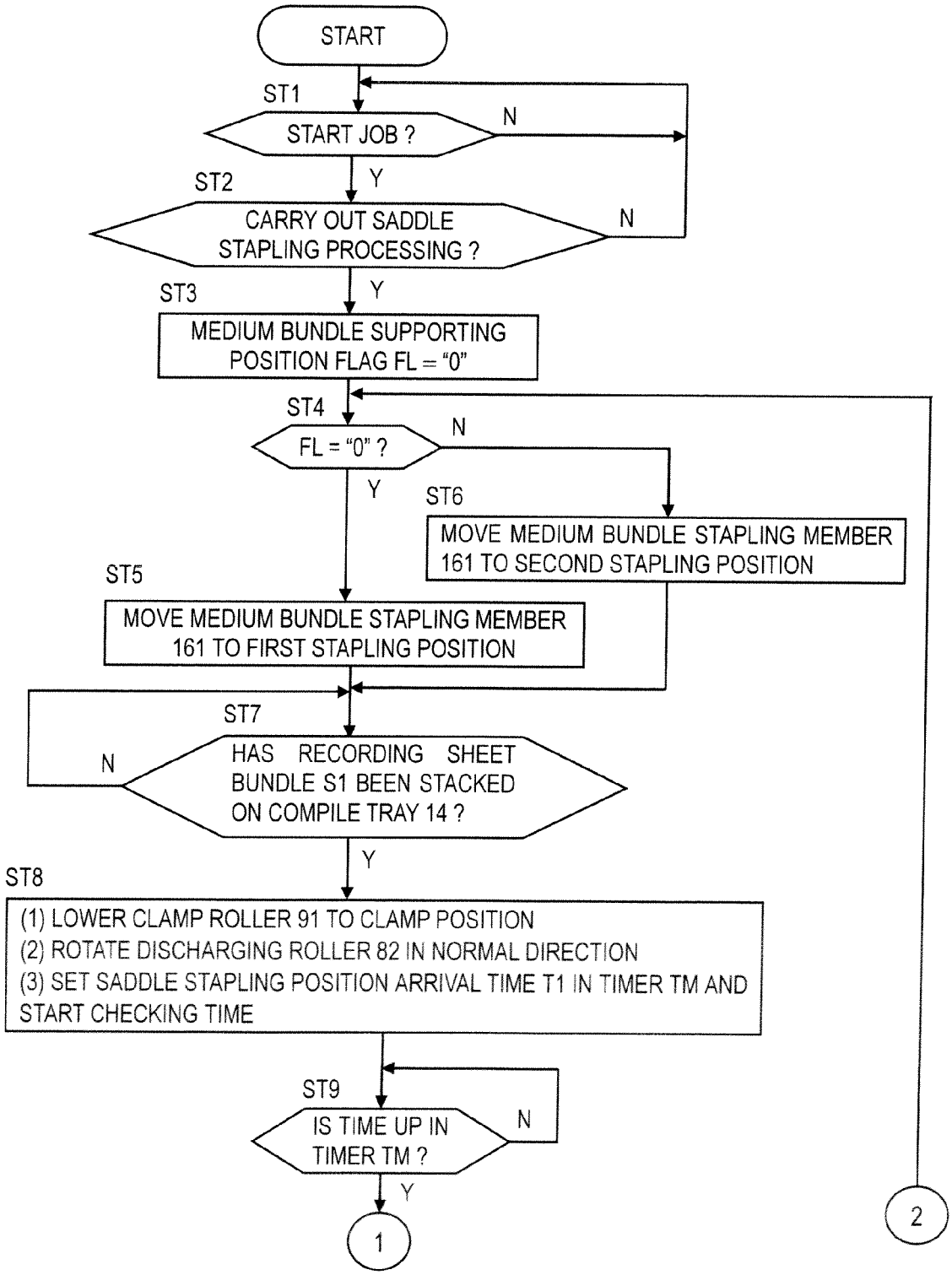
FIG. 15 is a schematic illustration of the flow chart of the medium bundle stacking control processing at the time of saddle stapling of Example 1.
Figure 15:
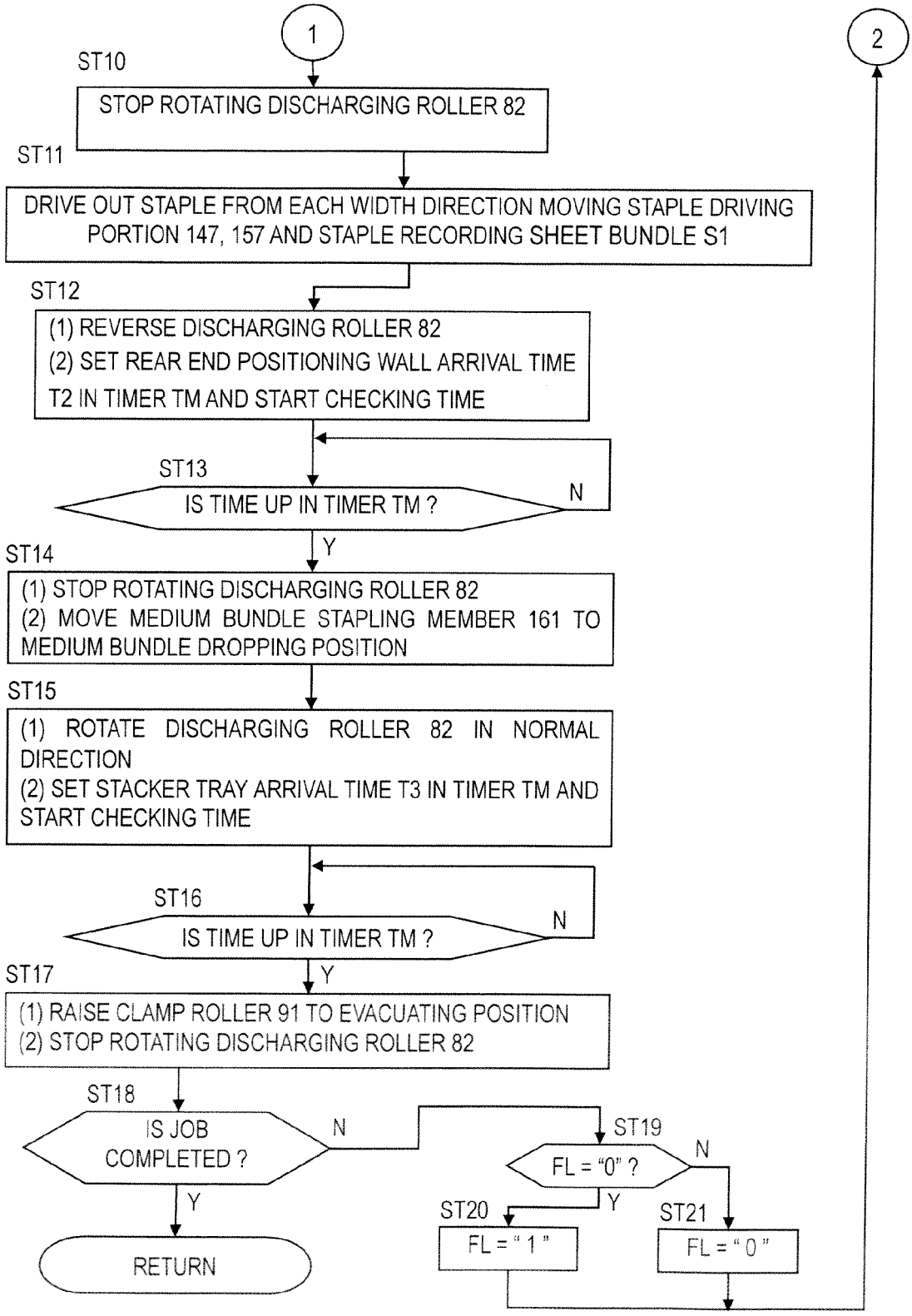

FIG. 15 is a schematic illustration of the flow chart of the medium bundle stacking control processing at the time of saddle stapling of Example 1.

Processing of each step ST of the flow chart shown in FIG. 15 is executed according to programs stored in the control portions C, CA of the printer U. This processing is carried out together with other various processing of the printer U.

The flow chart shown in FIG. 15 is started when a power source to the printer U is turned on.

In ST1 shown in FIG. 15, it is discriminated whether or not an image forming operation, that is, a so-called job is started. In the case of Yes (Y), the program transfers to ST2 In the case of No (N), ST1 is repeated.

In ST2, when the post-processing that has been discriminated by the post-processing discriminating unit CA1 is discriminated to be whether or not "Saddle stapling", it is judged whether or not the saddle stapling processing is executed. In the case of Yes (Y), the program transfers to ST3. In the case of No (N), the program returns to ST1.

In ST3, the medium bundle supporting position flag FL is set at "0". Then, the program transfers to ST4.

In ST4, it is discriminated whether or not the medium bundle supporting position flag FL is "0". In the case of Yes (Y), the program transfers to ST5. In the case of No (N), the program transfers to ST6.

In step ST5, the medium bundle stapling member 161 is moved to the first stapling position shown in FIG. 10. Then, the program transfers to ST7.

In ST6, the medium bundle stapling member 161 is moved to the second stapling position shown in FIG. 11. Then, the program transfers to ST7.

In ST7, it is discriminated whether or not the recording sheet bundle S1 arranged on the compile tray 14 has already been stacked. In the case of Yes (Y), the program transfers to ST8. In the case of No (N), step ST7 is repeated.

In ST8, the following processing (1) to (3) is carried out and the program transfers to ST9.

(1) The clamp roller 91 is lowered to the clamping position.

(2) The discharging roller 82 is rotated in the normal direction.

(3) The saddle stapling position arrival time T1 is set in the timer TM and the check of time is started.

In ST9, when it is discriminated whether or not the time is up in the timer TM, it is discriminated whether or not the recording sheet bundle S1 arranged on the compile tray 14 is conveyed to the saddle stapling position. In the case of Yes (Y), the program transfers to ST10. In the case of No (N), ST9 is repeated.

In ST10, a rotation of the discharging roller 82 is stopped. Then, the program transfers to ST11.

In ST11, staples are driven out from the width direction moving staple driving portions 147, 157 so as to staple the recording sheet bundle S1. Then, the program transfers to ST12.

In ST12, the following processing (1), (2) is carried out and the program transfers to ST13.

(1) The discharging roller 82 is reversed.

(2) In the timer TM, the rear end positioning wall arrival time T2 is set and the check of time is started.

In ST13, when it is discriminated whether or not the time is up in the timer TM, it is discriminated whether or not the recording sheet bundle S1 is conveyed from the saddle stapling position to a position where the rear end in the sheet conveyance width direction of the recording sheet bundle S1 collides again with the rear end positioning wall 41*a*. In the case of Yes (Y), the program transfers to ST14. In the case of No (N), step ST13 is repeated.

In step ST14, the following processing (1), (2) is carried out and the program transfers to ST15.

(1) A rotation of the discharging roller 82 is stopped.

(2) The medium bundle stapling member 161 is moved to the medium bundle dropping position shown in FIG. 12.

In ST15, the following processing (1), (2) is carried out and the program transfers to ST16.

(1) The discharging roller 82 is rotated in the normal direction.

(2) The stacker tray arrival time T3 is set in the timer TM and the check of time is started.

In ST16, when it is discriminated whether or not the time is up in the timer TM, it is discriminated whether or not the recording sheet bundle S1 is dropped and stacked on the stacker tray TH1 from the state in which the rear end in the sheet conveyance direction of the recording sheet bundle S1, which has been subjected to the saddle stapling, collides with the rear end positioning wall 41*a*. In the case of Yes (Y), the program transfers to ST17. In the case of No (N), ST16 is repeated.

In ST17 the following processing (1), (2) is carried out and the program transfers to ST18.

(1) The clamp roller 91 is raised to an evacuating position.

(2) A rotation of the discharging roller 82 is stopped.

In ST18, it is discriminated whether or not the job is completed. In the case of No (N), the program transfers to ST19. In the case of Yes (Y), the program returns to ST11.

In ST19, it is discriminated whether or not the medium bundle supporting position flag FL is "0". In the case of Yes (Y), the program transfers to ST20. In the case of No (N), the program transfers to ST21.

In ST20, the medium bundle supporting position flag FL is set at "1". Then, the program returns to ST4.

In ST21, the medium bundle supporting position flag FL is set at "0". Then, the program returns to ST4.

(Operation of Example 1)

In the printer U of Example 1 having the components described above, the recording sheet S is conveyed by an image forming action, an image is recorded on the recording sheet S, and the recording sheet is carried into the sheet-carry-in port 3 of the post-processing device U3 by the discharging roller Rh and the sheet conveyance unit U2. In the case where the post-processing setting information contained in the image information inputted from the information processing device PC is "No post-processing", the recording sheet S carried into the post-processing device U3 is discharged onto the stacker tray TH1 as it is. In the case where the post-processing setting information is "No stapling (Only arranging)", the recording sheet S is accommodated on the compile tray 14 and arranged by the rear end positioning wall 41*a* or tampers 21, 22 and then discharged onto the stacker tray. In the case where the post-processing setting information is "Corner stapling" or "Side edge stapling", the recording sheet S is accommodated on the compile tray 14 and arranged by the rear end positioning wall 41*a* or tampers 21, 22. Then, the recording sheet S is subjected to the edge stapling by the moving stapling member 70 moved to the stapling position corresponding to "Corner stapling" or "Side edge stapling" and then discharged onto the stacker tray.

As shown in ST2 in FIG. 15, in the case where the post-processing setting information is "Saddle stapling", the recording sheet S is accommodated in the compile tray 14 and then arranged by the rear end positioning wall 41*a* and the tampers 21, 22. After that, the recording sheet S is moved to the saddle stapling position shown in FIG. 10 as illustrated in ST8 to ST11 of FIG. 15 and then subjected to the saddle stapling. At this time, as shown in ST4 to ST6 and ST19 to ST21 in FIG. 15, the stapling position of the medium bundle stapling member 161 is alternately changed for each recording sheet bundle S1 between the first stapling position corresponding to the sheet width of the recording sheet bundle S1 shown in FIG. 10 and the second stapling position wider than the sheet width of the recording sheet bundle S1 shown in FIG. 11. In the case where the recording sheet bundle S1, which has been subjected to the saddle stapling, is discharged onto the stacker tray, as shown in ST14 in FIG. 15, the medium bundle stapling member 161 is moved to the medium bundle dropping position shown in FIG. 12. Then, the recording sheet bundle S1, which has been subjected to the saddle stapling, is discharged onto the stacker tray as shown in ST15 to ST17 in FIG. 15.

Figure 16A:
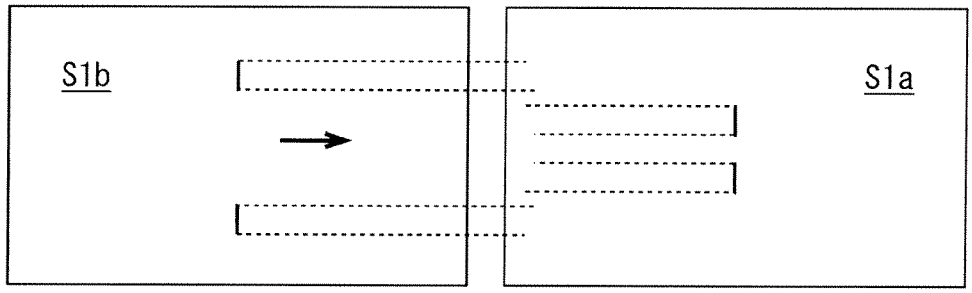
FIGS. 16A and 16B are schematic illustrations for explaining operation of Example 1.
Figure 16B:
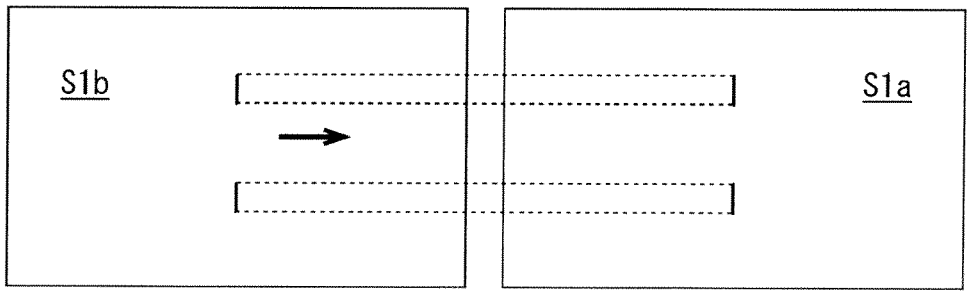

FIGS. 16A and 16B are schematic illustrations for explaining operation of Example 1. FIG. 16A is a schematic illustration for explaining a case in which the second medium bundle is stacked on the first medium bundle in the post-processing device of Example 1. FIG. 16B is a schematic illustration for explaining a case in which the second medium bundle is stacked on the first medium bundle in the conventional post-processing device.

In this case, the recording sheet bundle S1 stacked on the stacker tray TH1 is a first medium bundle S1*a* and the recording sheet bundle S1 conveyed and stacked on the stacker tray TH1 after the first medium bundle S1*a* is a second medium bundle S1*b*. Then, the following case is considered. For example, the medium bundle stapling member 161 is not alternately moved between the first stapling position and the second stapling position each time the saddle stapling processing is executed, which is unlike the conventional case, and the medium bundle stapling member 161 is moved between the first stapling position and the medium bundle dropping position. In this case, as shown in FIG. 16B, the second medium bundle S1*b*, which has been subjected to the saddle stapling at the first stapling position, is stacked on the first medium bundle S1*a* which has been subjected to the saddle stapling at the first stapling position. The staple located at the first stacking stapling position, which is a stapling position in the first medium bundle S1*a*, and the staple located at the second stacking stapling position, which is a stapling position in the second medium bundle S1*b*, collide with each other. Accordingly, there is a possibility that the recording bundles S1*a*, S1*b* on the stacker tray TH1 go into disorder.

However, in the printer U1 of Example 1, as shown in FIG. 16A, the second medium bundle S1*b*, which has been subjected to the saddle stapling at the second stapling position which is set wider than the staple width, is stacked on the first medium bundle S1 a which has been subjected to the saddle stapling at the first stapling position. As a result, in the printer U of Example 1, at the time of stacking the second medium bundle S1*b*, the staple located at the first stacking stapling position in the first medium bundle S1*a* and the staple located at the second stacking stapling position in the second medium bundle S1*b* do not collide with each other. Therefore the stacked recording sheet bundles S1*a*, S1*b* do not go into disorder. In the printer U of Example 1, when the first medium bundle S1*a* is stacked on the second medium bundle S1*b*, in the same manner as that described above, the staple located at the second stacking stapling position in the second medium bundle S1*b* and the staple located at the first stacking stapling position in the first medium bundle S1*a* do not collide with each other. Therefore, the stacked recording sheet bundles S1*a*, S1*b* do not go into disorder.

EXAMPLE 2

Next, explanations will be made into the printer U of Example 2 of the present invention. In the explanations of this Example 2, like reference marks are used to indicate like components in Examples 1 and 2 and the detailed explanations are omitted here. Example 2 is different from Example 1 at the following points, however, other points of Example 2 are the same as those of Example 1.

(Explanations of Control Portion of Example 2)

Figure 17:
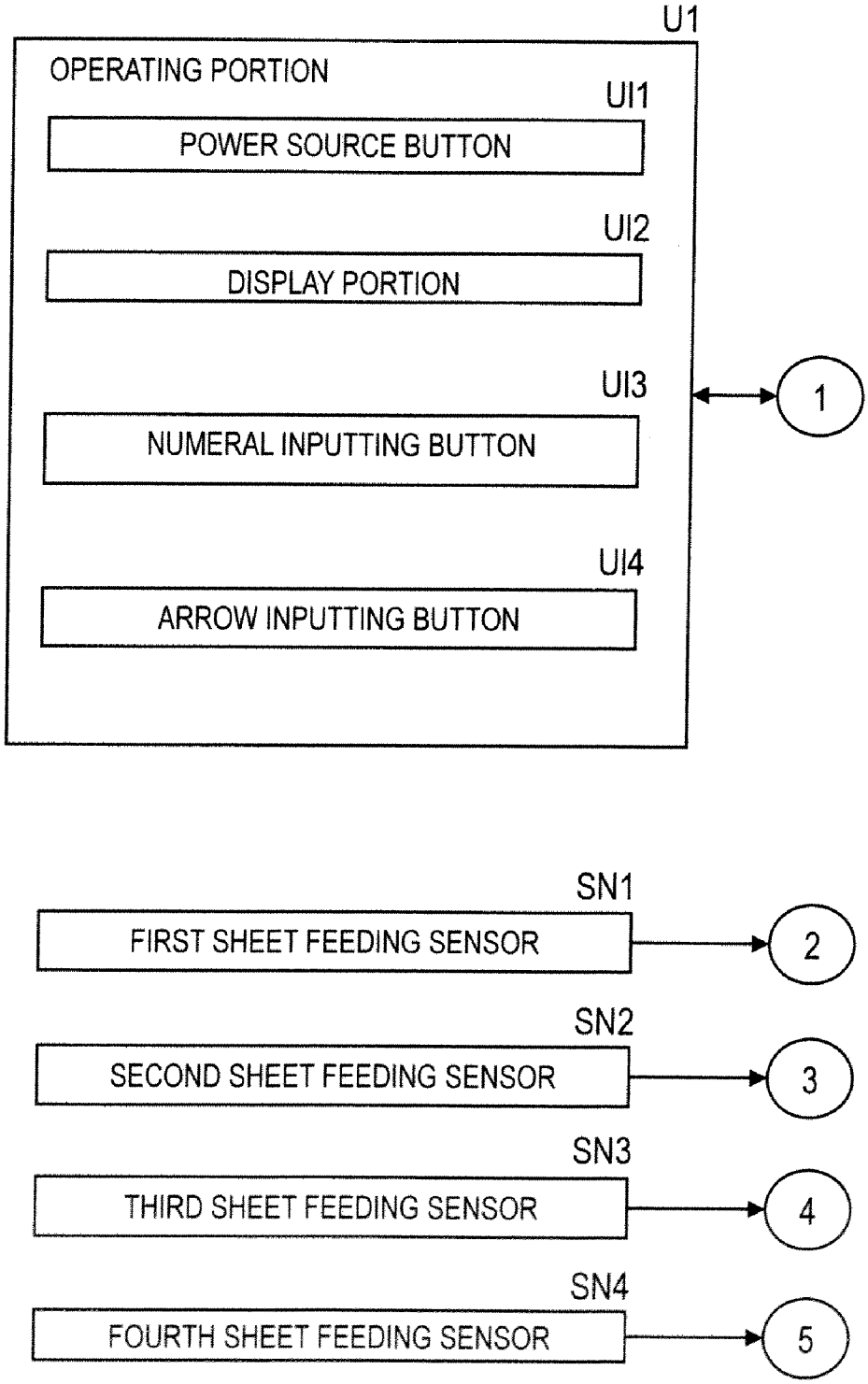
FIG. 17 is a functional diagram showing a control portion of the image forming apparatus of Example 2 of the present invention, that is.
Figure 17:
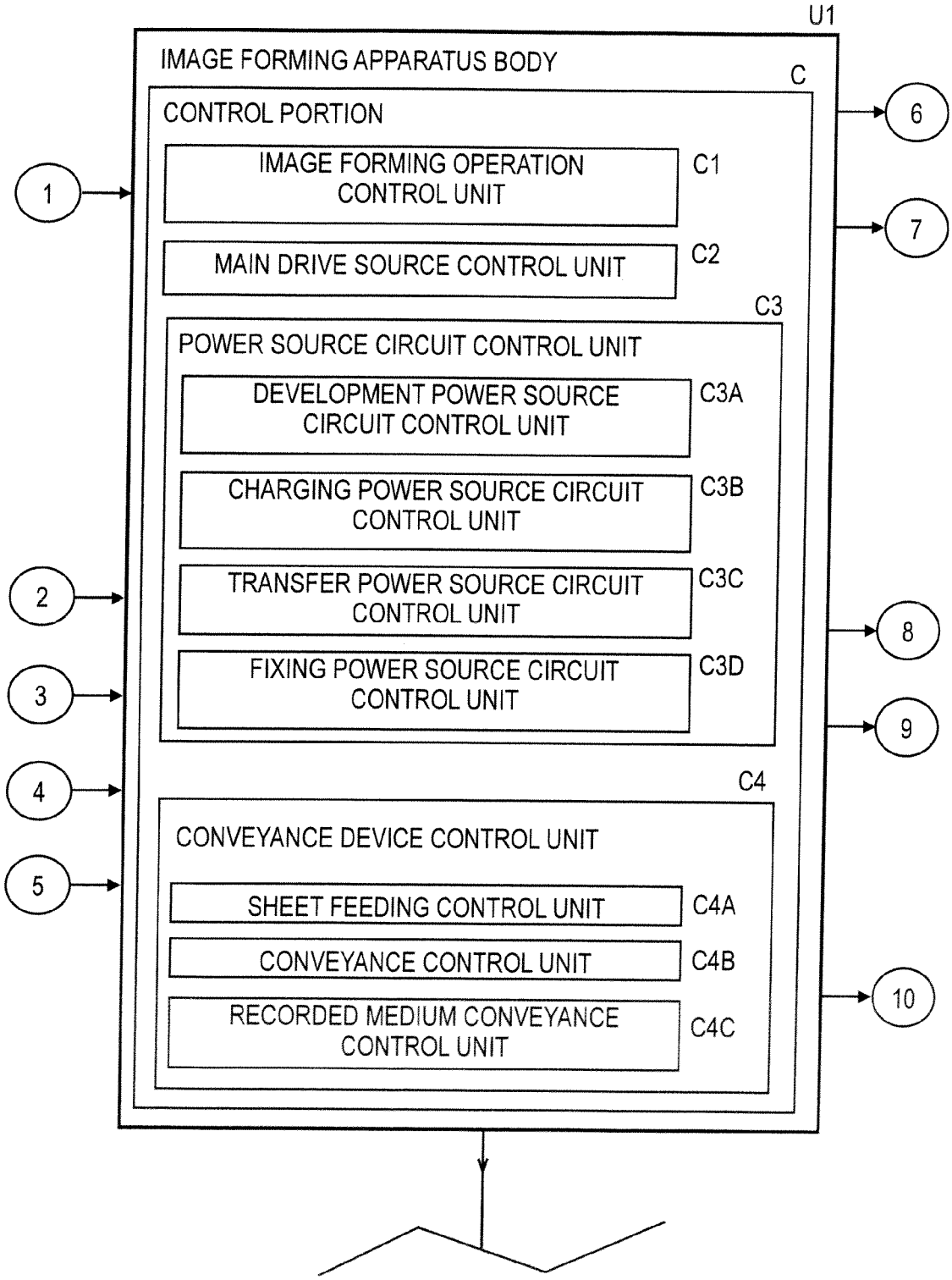
Figure 17:
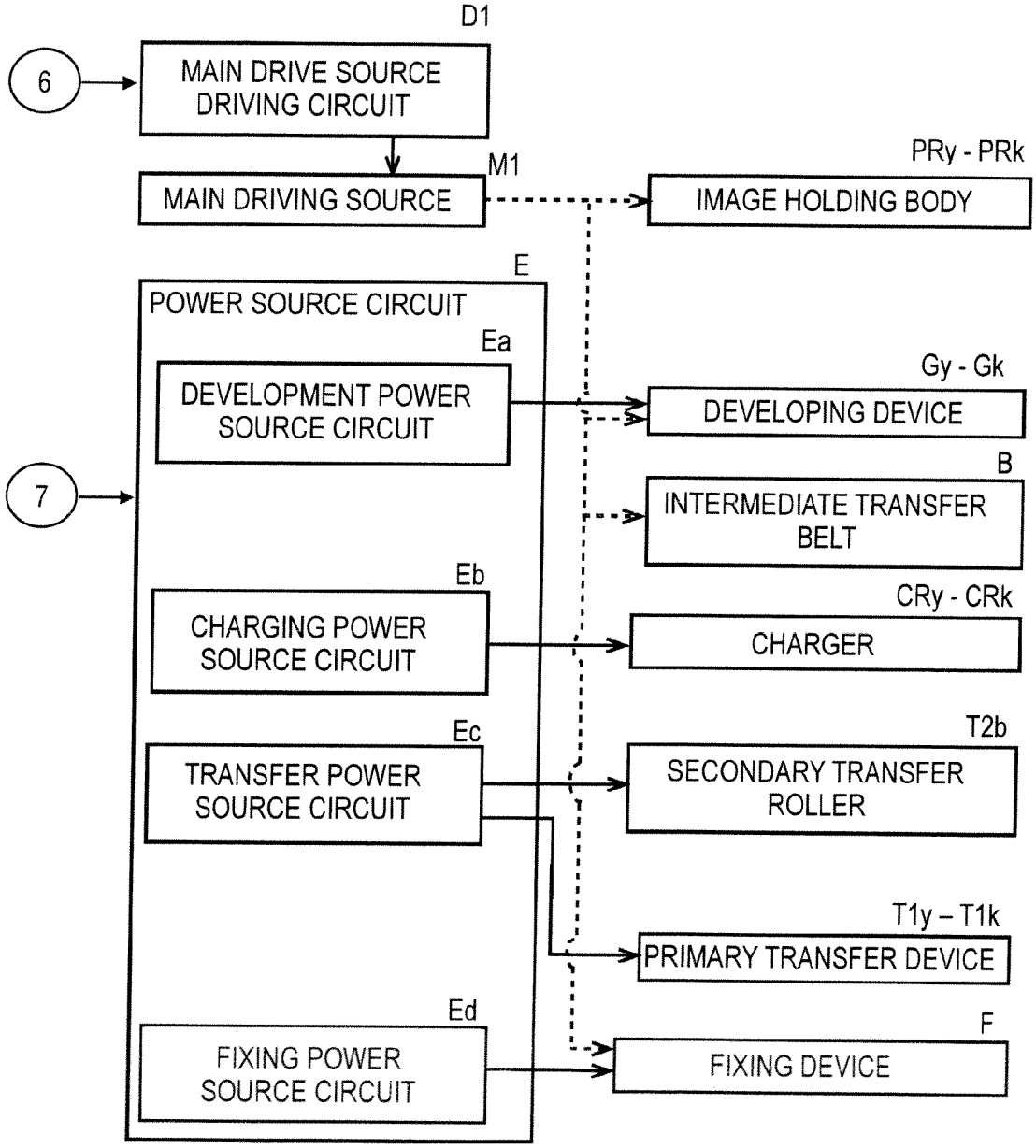
Figure 17:
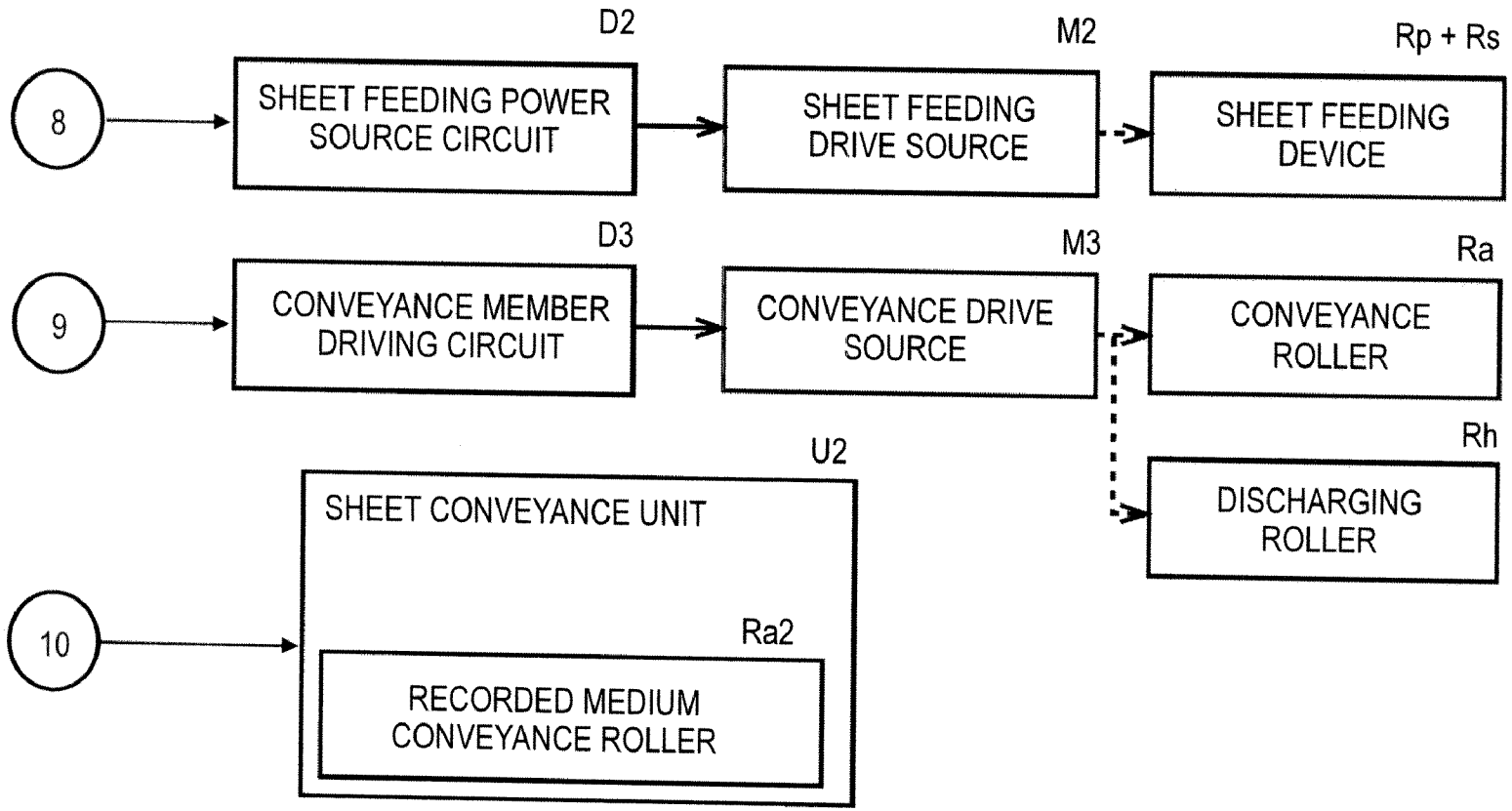

FIG. 17 is a functional diagram showing a control portion of the image forming apparatus of Example 2 of the present invention, that is, FIG. 17 is a so-called block diagram. FIG. 17 is a schematic illustration corresponding to FIG. 13 of Example 1.

Figure 18:
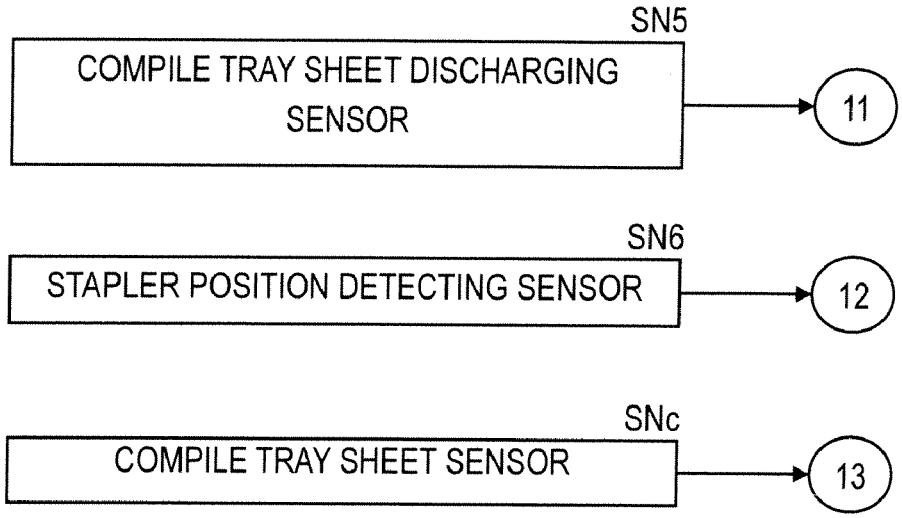
FIG. 18 is a block diagram continuing to the block diagram shown in FIG. 17 and is a schematic illustration corresponding to FIG. 14 of Example 1.
Figure 18:
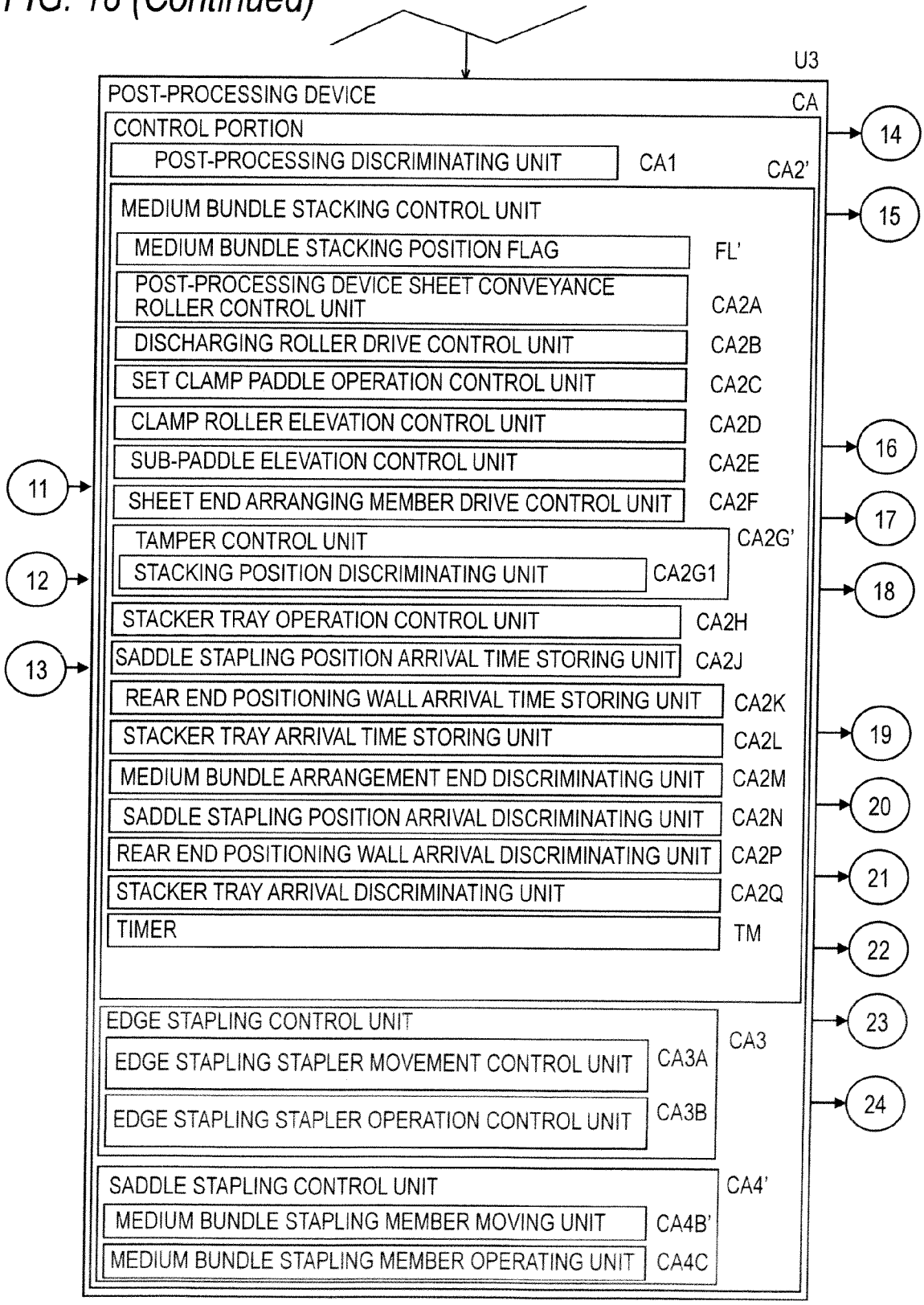
Figure 18:
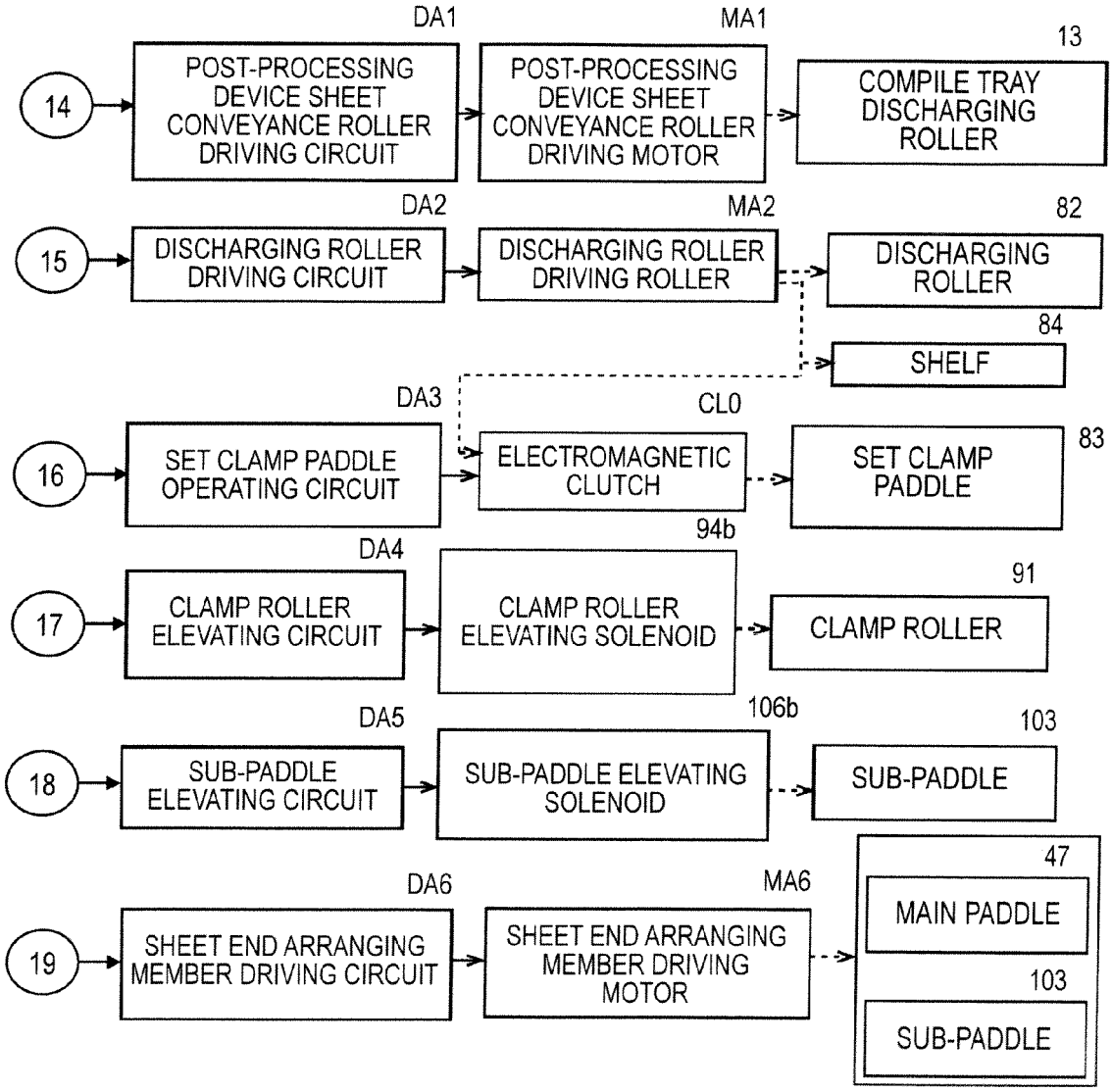
Figure 18:
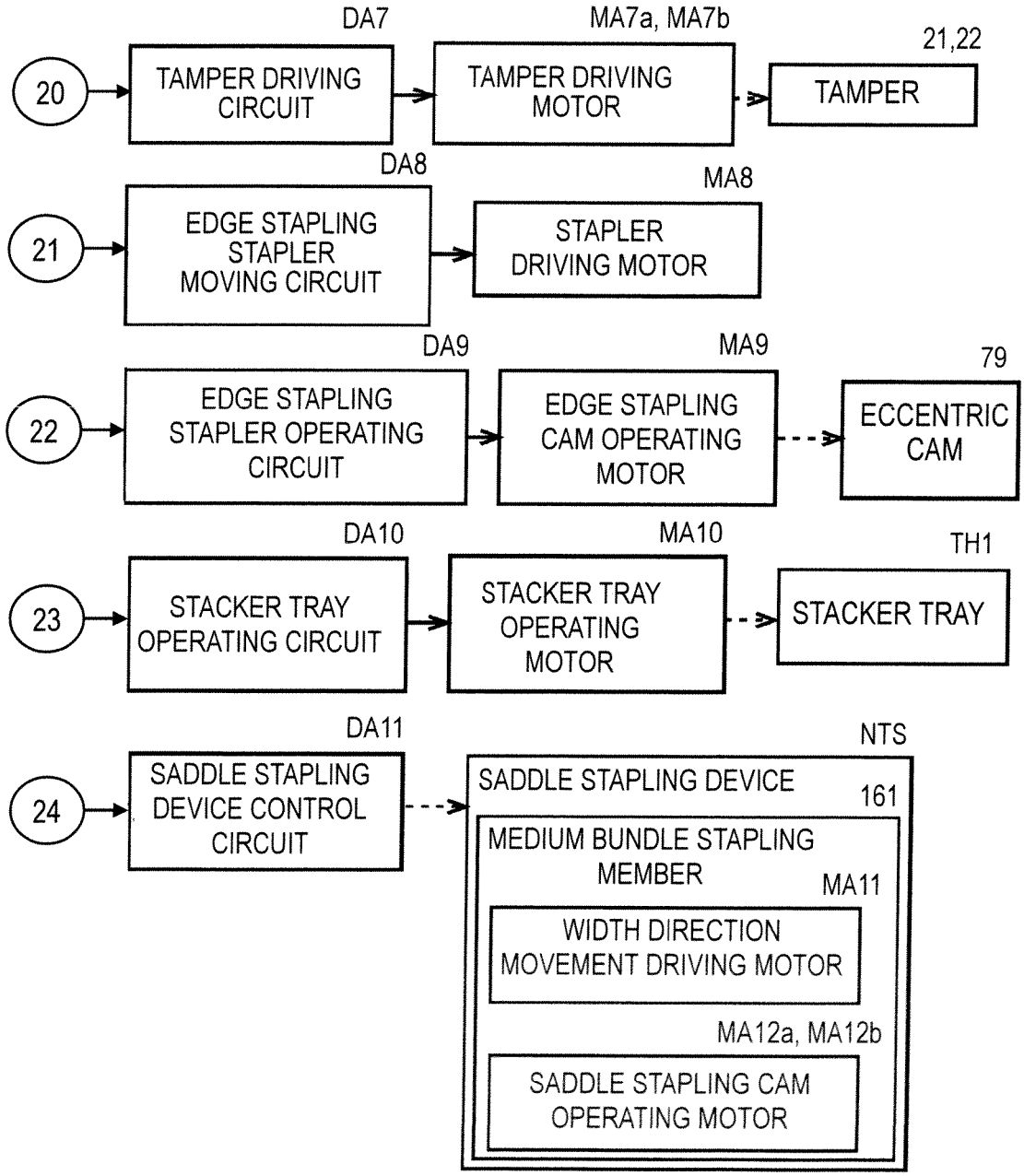

FIG. 18 is a block diagram continuing to the block diagram shown in FIG. 17. FIG. 18 is a schematic illustration corresponding to FIG. 14 of Example 1.

In FIG. 17, the control portion CA of the post-processing device U3 of Example 2 includes the unit CA2', CA4' instead of the unit CA2, CA4 of Example 1.

CA2': Medium Bundle Stacking Control Unit

The medium bundle stacking control unit CA' of Example 2 includes a tamper control unit CA2G' instead of the tamper control unit CA2G and the medium bundle positioning flag FL' is newly added.

FL': Medium Bundle Stacking Position Flag

An initial value of the medium bundle stacking position flag FL' which is an example of the medium bundle stacking position discriminating value, is "0". Each time the intermediate processing is carried out, the medium bundle stacking position flag FL' becomes "1", "0", "1", . . . . That is, the flag FL' is changed between "0" and "1".

CA2G': Tamper Control Unit

The Tamper control unit CA2G', which is an example of the medium bundle control unit, includes a stacking position discriminating unit CA2G1. According to the size of the recording sheet S carried onto the compile tray 14, the tamper control unit CA2G' controls a normal and a reverse rotation of each tamper driving motor MA7*a*, MA7*b* through the tamper driving circuit DA7 so as to operate the tampers 21, 22. In this way, the side edge of the recording sheet bundle S1 carried onto the compile tray 14 is arranged. Each time one recording sheet S is carried onto the compile tray 14, the tamper control unit CA2G' of Example 2 operates the tempers 21, 22 and arranges the side of the recording sheet bundle S1.

Figure 19:
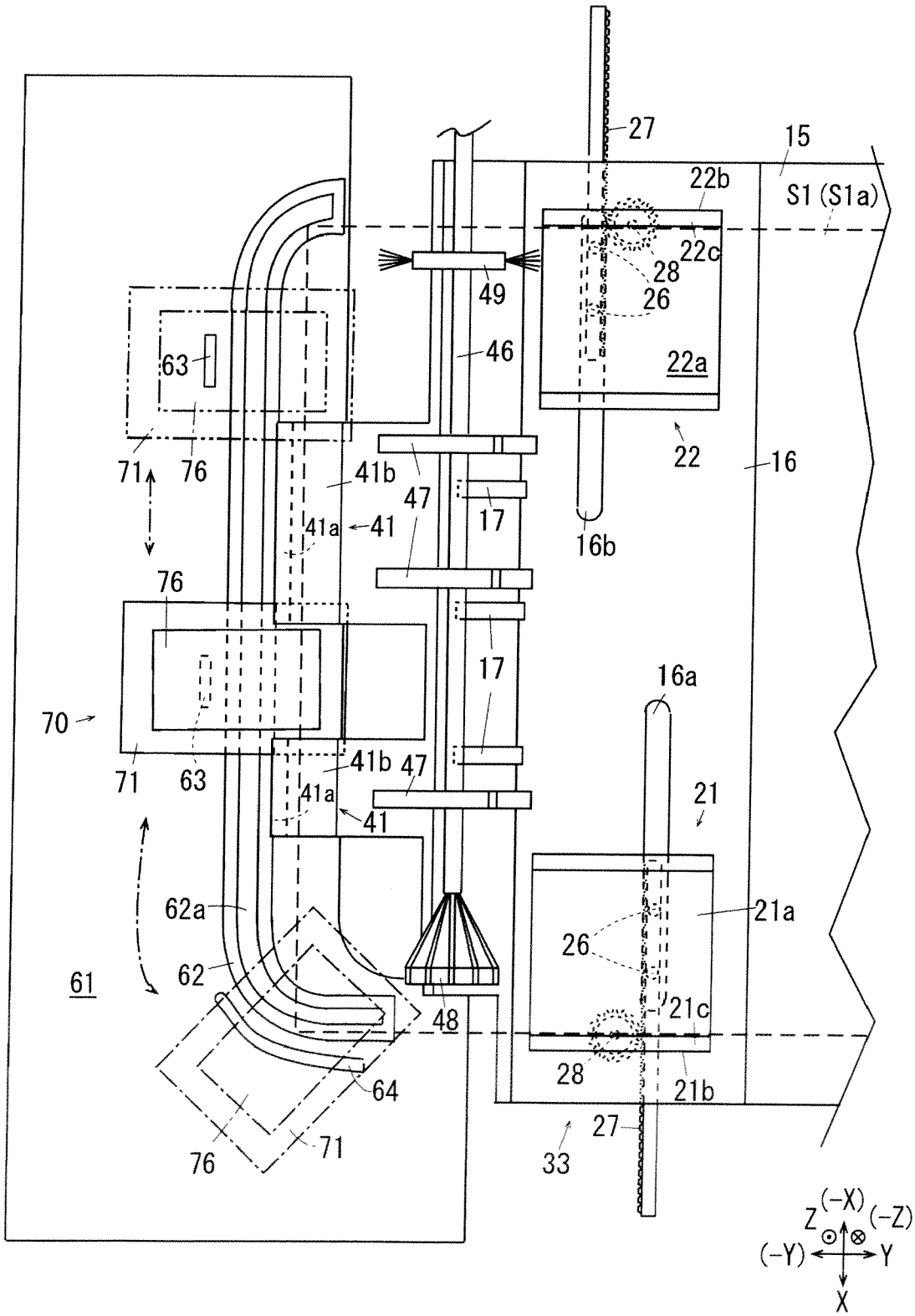
FIG. 19 is a schematic illustration showing a first stacking position of Example 2 and a schematic illustration corresponding to FIG. 6 of Example 1.

FIG. 19 is a schematic illustration showing a first stacking position of Example 2. FIG. 19 is a schematic illustration corresponding to FIG. 6 of Example 1.

Figure 20:
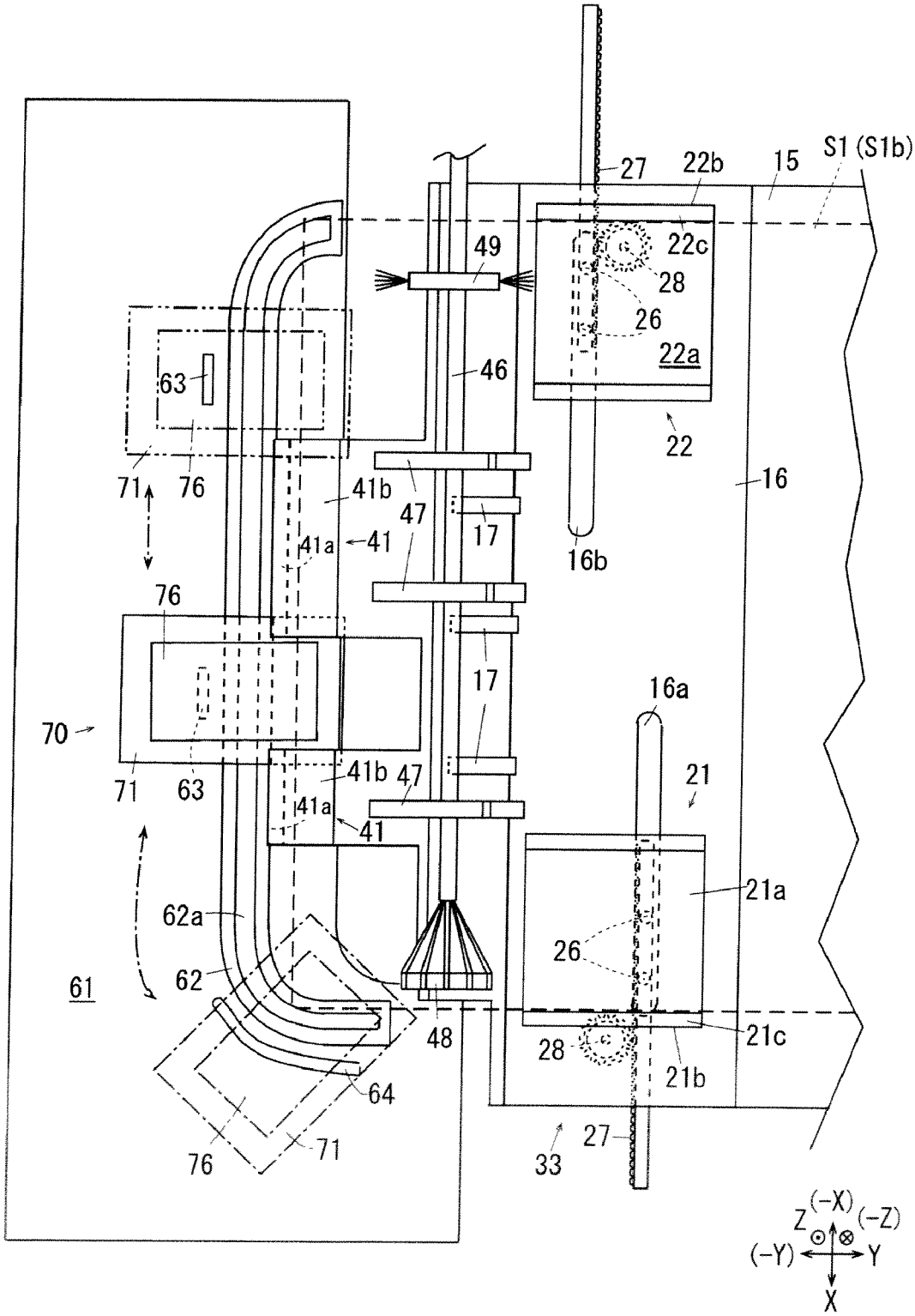
FIG. 20 is a schematic illustration showing a second stacking position of Example 2 and a schematic illustration corresponding to FIG. 6 of Example 1.

FIG. 20 is a schematic illustration showing a second stacking position of Example 2. FIG. 20 is a schematic illustration corresponding to FIG. 6 of Example 1.

The tamper control unit CA2G' operates the tampers 21, 22 so that a central portion in the width direction of the recording sheet bundle S1 shown in FIG. 19, which has already been subjected to the saddle stapling, on the compile tray 14 can be stacked at the first stacking position which is set in the central portion on the compile tray 14 or alternatively so that a central portion in the width direction of the recording sheet bundle S1 shown in FIG. 20, which has already been subjected to the saddle stapling, on the compile tray 14 can be stacked at the second stacking position which is set at the rear of the central portion in the width direction on the compile tray 14.

CA2G1: Stacking Position Discriminating Unit

The stacking position discriminating unit CA2G1 discriminates whether the stapling position in the width direction of the recording sheet bundle S1 at the time of carrying out the saddle stapling processing is the first stacking position shown in FIG. 19 or the second stacking position shown in FIG. 20. In the case where the medium bundle stacking position flag FL' is "0", the stacking position discriminating unit CA2G1 of Example 1 discriminates that the stapling position is the first stacking position. In the case where the medium bundle stacking position flag FL' is "1", the stacking position discriminating unit CA2G1 of Example 1 discriminates that the stapling position is the second stacking position.

CA4': Saddle stapling Control Unit

In the saddle stapling control unit CA4' of Example 2, the medium bundle supporting position flag FL and the stapling position discriminating unit CA4A, which are provided in Example 1, are omitted. Instead of the medium bundle stapling member moving unit CA4B provided in Example 1, the saddle stapling control unit CA4' includes the medium bundle stapling member moving unit CA4B'.

CA4B': Medium Bundle Stapling Member Moving Unit

The medium bundle stapling member moving unit CA4B' moves the medium bundle stapling member 161 in the width direction through the saddle stapling device control circuit DA11. In the case where the saddle stapling is executed, the medium bundle stapling member moving unit CA4B' of Example 2 moves the medium bundle stapling member 161 to the first stapling position corresponding to the sheet width of the recording sheet bundle S1 shown in FIG. 10. In the case where the recording sheet bundle S1, which has already been subjected to the saddle stapling, is discharged onto the stacker tray TH1, the medium bundle stapling member 161 is moved to the medium bundle dropping position shown in FIG. 12.

(Explanations of Flow Chart of Example 2)

Next, referring to the flow chart a flow of control in the printer U of Example 2 will be explained below.

(Explanations of Flow Chart of Medium Bundle Stacking Control Processing at Time of Saddle Stapling)

Figure 21:
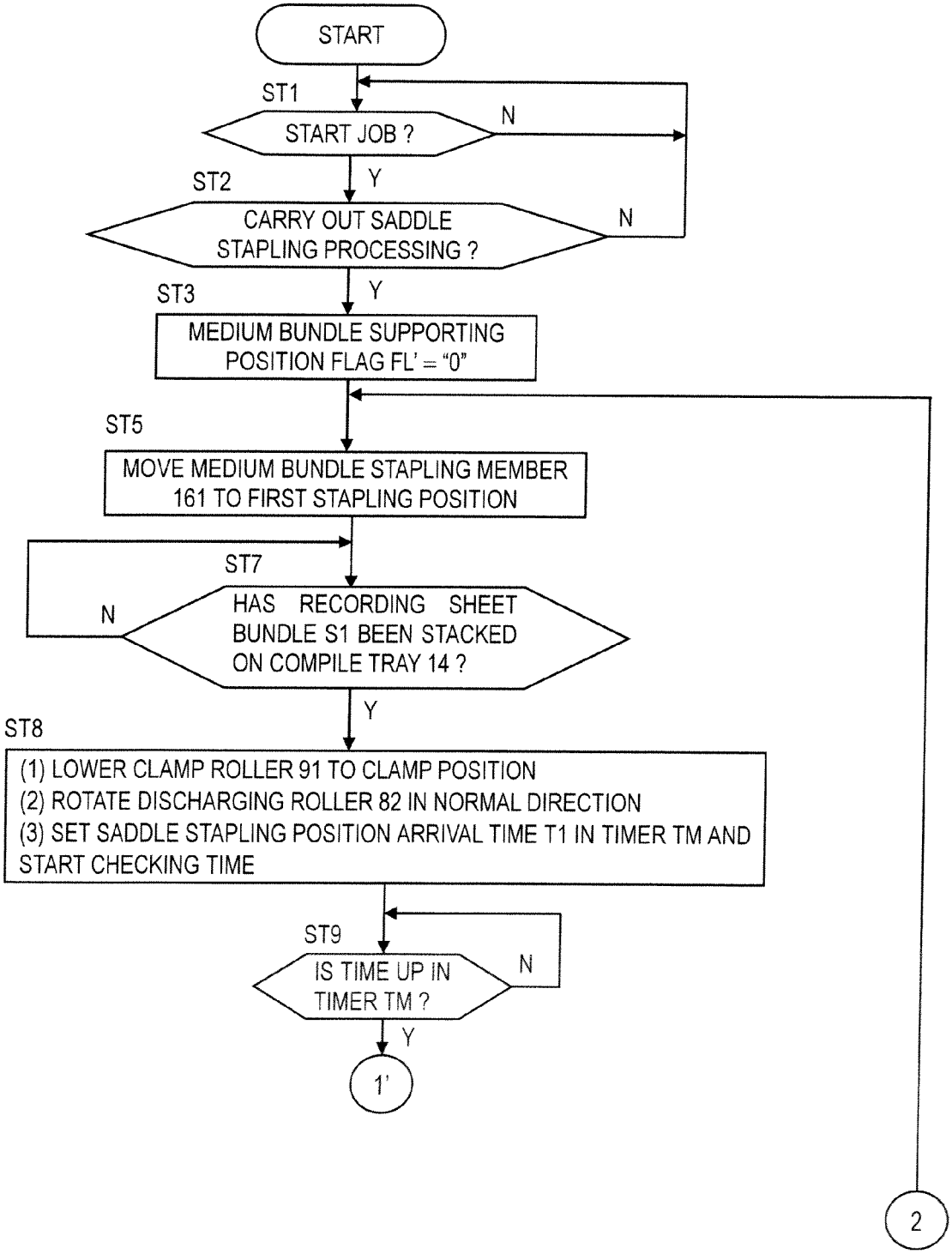
FIG. 21 is a schematic illustration of the medium bundle stacking control processing at the time of saddle stapling of Example 2 and a schematic illustration corresponding to FIG. 15 of Example 1.
Figure 21:
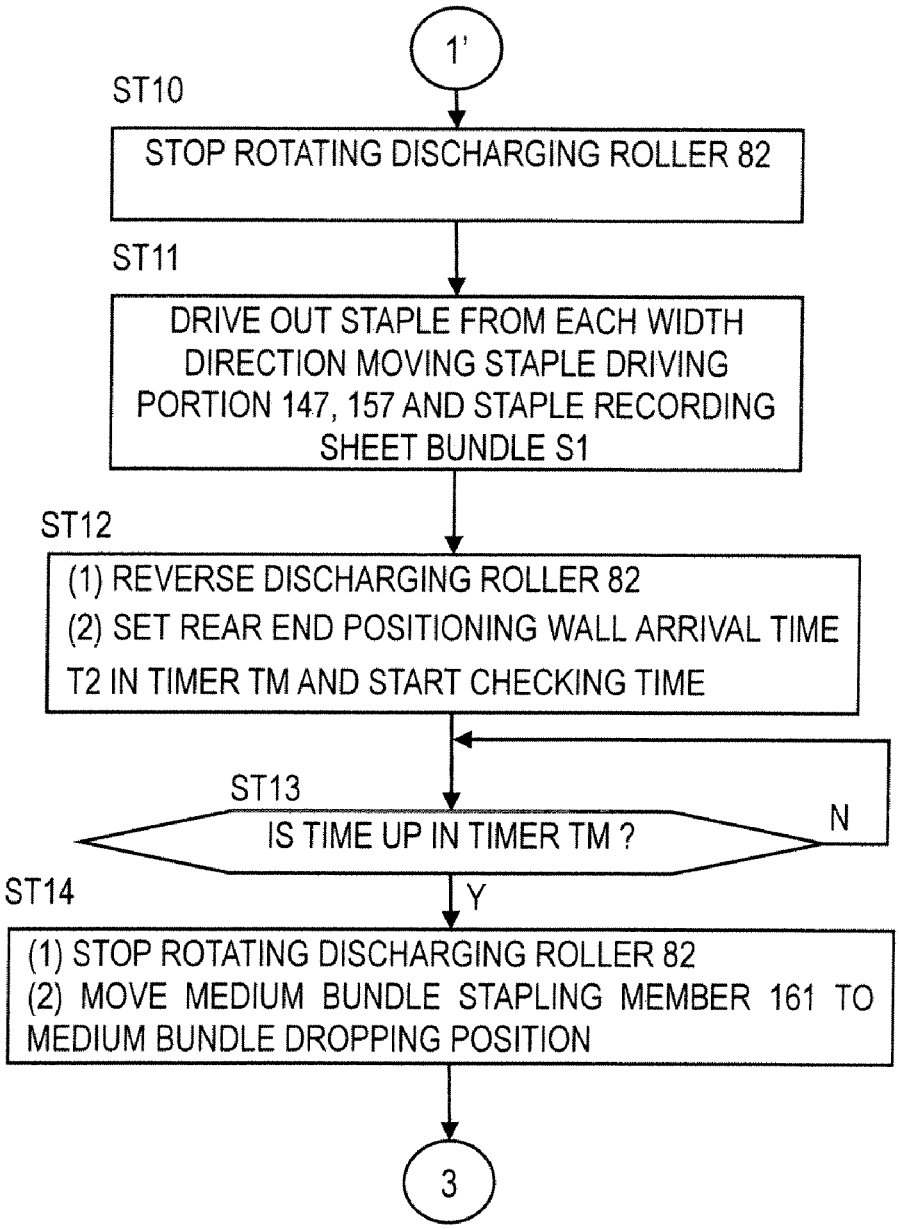
Figure 21:
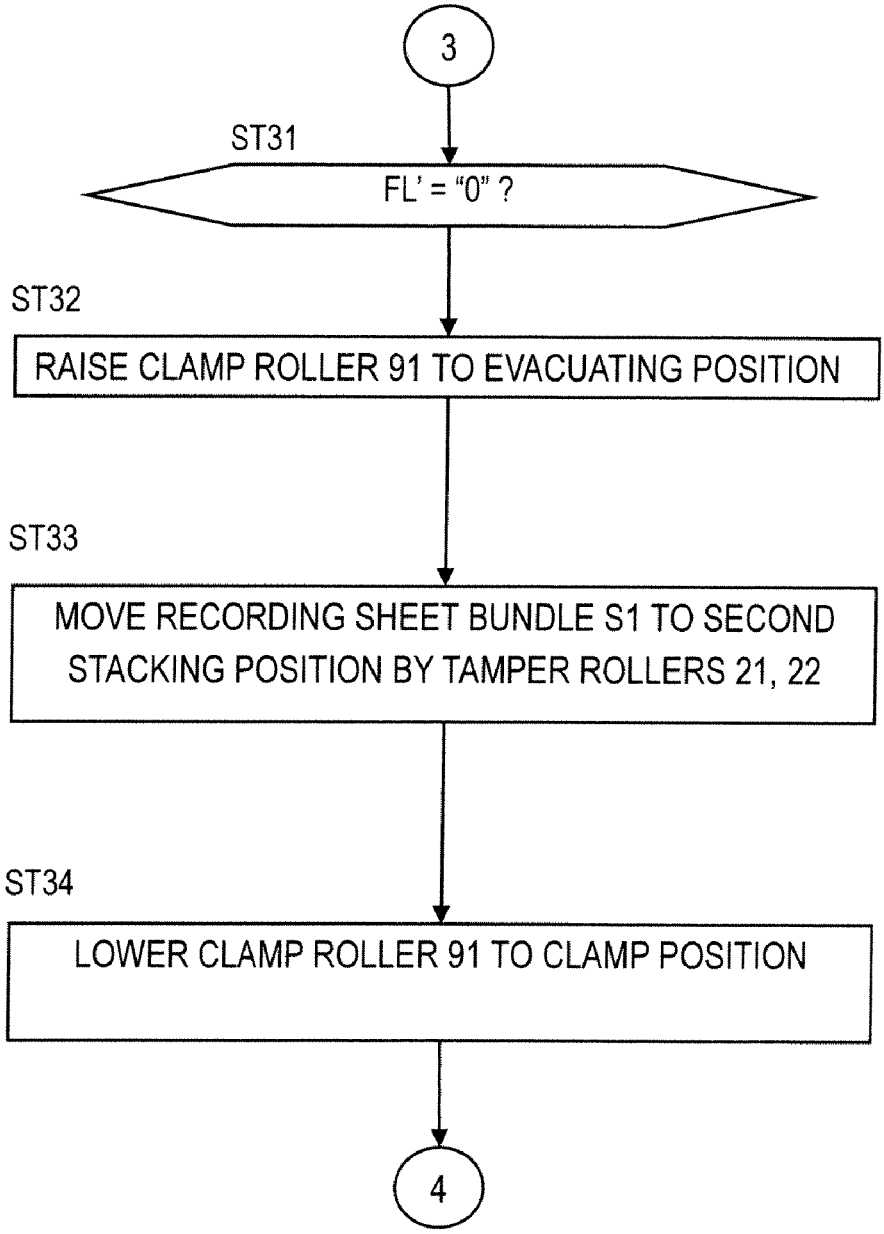
Figure 21:
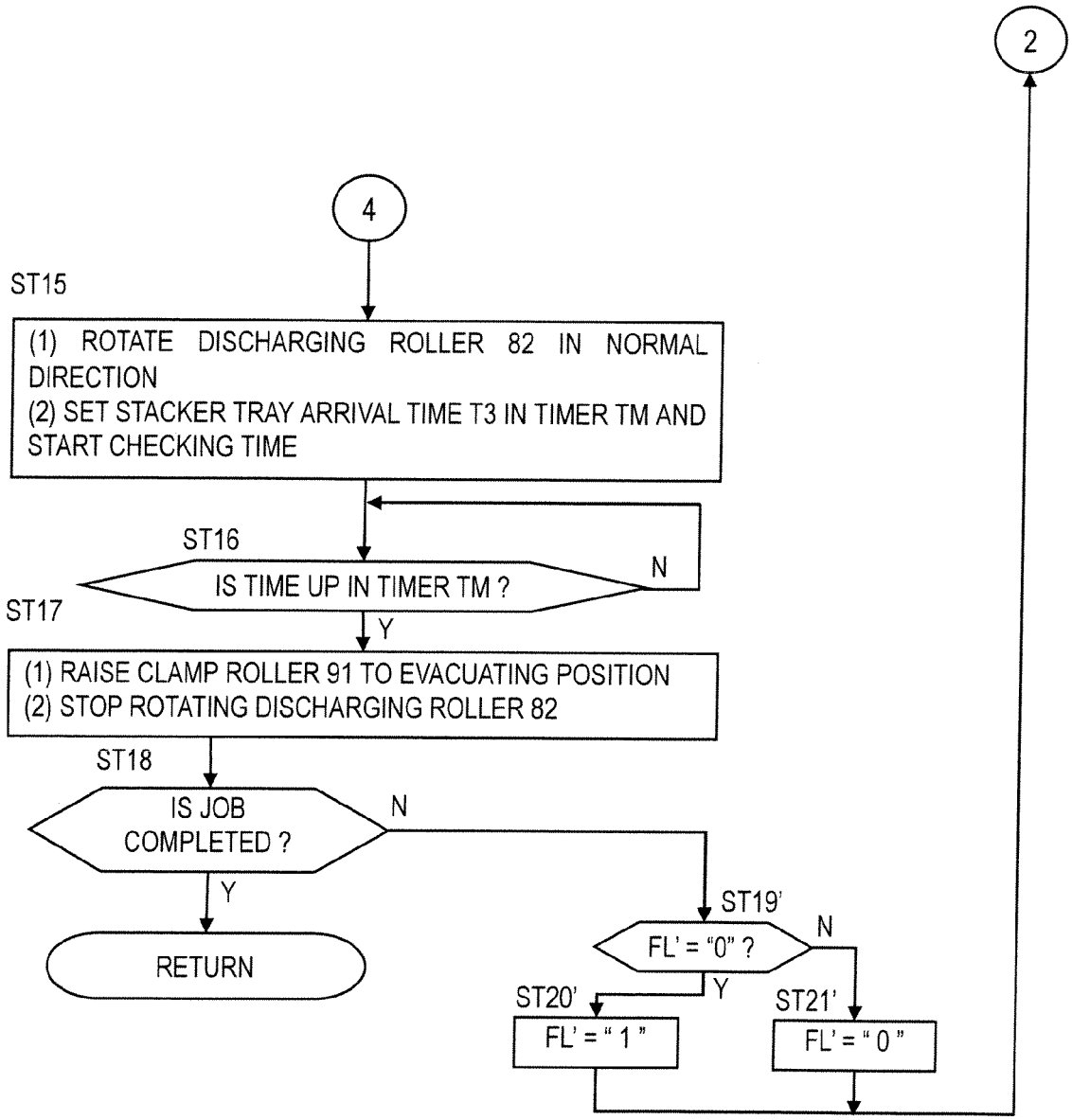

FIG. 21 is a schematic illustration of the medium bundle stacking control processing at the time of saddle stapling of Example 2. FIG. 21 is a schematic illustration corresponding to FIG. 15 of Example 1.

In FIG. 21, in the flow chart of the medium bundle stacking control processing at the time of saddle stapling of Example 2, instead of ST3 and ST19 to 21, ST3' and ST19' to ST21' are carried out with respect to the flow chart of the medium bundle stacking control processing at the time of saddle stapling of Example 1 shown in FIG. 15. In the flow chart of the medium bundle stacking control processing at the time of saddle stapling of Example 2, ST4 and ST6 are omitted with respect to the flow chart of the medium bundle stacking control processing at the time of saddle stapling of Example 1 and ST31 to ST34 are newly added between ST14 and ST15. Accordingly, the other processing of ST1, ST2, ST5 and ST7 to 18 are the same as those shown in FIG. 15. Therefore, the detailed explanations of the other processing are omitted here.

In ST3' of FIG. 21, the medium bundle stacking position flag FL' is set at "0" and then the program transfers to ST4.

In ST31, it is discriminated whether or not the medium bundle stacking position flag FL' is "0". In the case of Yes (Y), the program transfers to ST15. In the case of No (N), the program transfers to ST32.

In ST32, the clamp roller 91 is raised to an evacuating position. Then, the program transfers to ST33.

In ST33, the recording sheet bundle S1 is moved to the second stacking position shown in FIG. 19 by the tampers 21, 22. Then, the program transfers to ST34.

In ST34, the clamp roller 91 is lowered to the clamp position. Then, the program transfers to ST15.

In ST19', it is discriminated whether or not the medium bundle stacking position flag FL' is "0". In the case of Yes (Y), the program transfers to ST20'. In the case of No (N), the program transfers to ST21'.

In ST20', the medium bundle stacking position flag FL' is set at "1". Then, the program returns to ST4.

In ST21', the medium bundle stacking position flag FL' is set at "0". Then, the program returns to ST4.

(Operation of Example 2)

Figure 22:
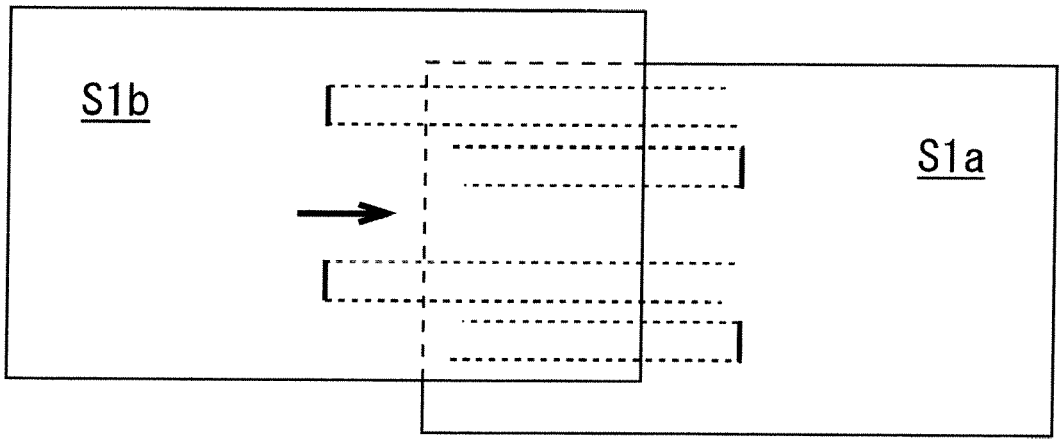
FIG. 22 is a schematic illustration for explaining operation of Example 2.

FIG. 22 is a schematic illustration for explaining operation of Example 2. FIG. 22 is a schematic illustration for explaining a case in which the second medium bundle is stacked on the first medium bundle in the post-processing device of Example 2.

In the printer U of Example 2 provided with the above components, as shown in ST5 of FIG. 21, a stapling position of the medium bundle stapling member 161 is set at the first stapling position shown in FIG. 10.

In the printer U of Example 2, as shown in ST31 to ST34 and ST19' to ST21' and also as shown in FIG. 22, the stacking position of the recording sheet bundle S1 on the compile tray 14 is moved by the tampers 21, 22 for each recording sheet bundle S1. Therefore, the stacking position of the recording sheet bundle S1 on the compile tray 14 is alternately changed between the first stacking position shown in FIG. 18 and the second stacking position which is set at a rear position distant from the first stacking position described above by a distance not less than the staple width.

As a result, in the printer U of Example 1, at the time of stacking the second medium bundle S1*b*, the staple located at the first stacking stapling position in the first medium bundle S1*a* and the staple located at the second stacking stapling position in the second medium bundle S1*b* do not collide with each other. Therefore, the stacked recording sheet bundles S1*a*, S1*b* do not go into disorder. When the first medium bundle S1*a* is stacked on the second medium bundle S1*b*, in the same manner as that described above, the staple located at the second stacking stapling position in the second medium bundle S1*b* and the staple located at the first stacking stapling position in the first medium bundle S1*a* do not collide with each other. Therefore, the stacked recording sheet bundles S1*a*, S1*b* do not go into disorder.

(Variations)

Examples of the present invention have been explained above in detail. However, it should be noted that the present invention is not restricted by the above specific examples. Variations can be made without departing from the scope of the claim of the present invention. Variations (H01) to (H09) of the present invention are exemplarily shown below.

(H01) In the examples described above, the printer is shown as an ex ample of the image forming apparatus. However, the present invention is not limited to the printer. It is possible to apply the present invention to a facsimile terminal device, a copier and a compound machine having all the functions of those devices or a compound machine having a plurality of functions of the above devices. In the above explanations, the image forming apparatus is exemplarily shown which includes four colors of image holding bodies PRy to PRk, developing devices Gy to Gk and latent image forming devices LHy to LHk. However, the present invention is not restricted by the above specific example. It is possible to apply the present invention to a monochromatic image forming apparatus. It is also possible to apply the present invention to a rotary type image forming apparatus having one image holding body and latent image forming device, in which four developing devices are rotated and opposed to the image forming body in order. Further, the latent image forming device is not limited to a latent image forming device formed out of a so-called LED array. It is possible to apply the present invention to a well known latent image forming device in which a polygonal mirror is used.

(H02) In the above example, the saddle stapling device NTS operates as follows. The width direction movement driving motor MA11 is controlled so that it can be driven in the normal and the reverse direction. The front side medium bundle stapling members 137+141 to 147 and the rear side medium bundle stapling members 138+151 to 157 are moved in a direction in which the members come close to and separate from each other, that is, the members are moved in the width direction of the recording sheet bundle S1. However, the present invention is not restricted by the above specific exemplary embodiment. For example, the following constitution can be employed. The front side medium bundle stapling members 137+141 to 147 and the rear side medium bundle stapling members 138+151 to 157 are driven by motors different from each other and the front side medium bundle stapling members 137+141 to 147 and the rear side medium bundle stapling members 138+151 to 157 are moved in the width direction of the recording sheet bundle S1.

(H03) In Example described above, in the medium stapling member 161 of the saddle stapling device NTS, when the width direction movement driving motor MA11 is rotated in the normal and the reverse direction, the width direction moving stacking portions 142, 152 are moved in the width direction of the recording sheet bundle S1 together with the front side medium bundle stapling members 137+141 to 147 and the rear side medium bundle stapling members 138+151 to 157. However, the present invention is not restricted by the above specific example. The following constitution can be employed. For example, the width direction movement stacking portions 142, 152 and the medium bundle stapling members 137+141 to 147 and 138+151 to 157 are respectively driven by motors different from each other so as to independently move the members in the width direction of the recording sheet bundle S1.

(H04) In the above Example, the medium bundle stapling member 161 of the saddle stapling device NTS intermediately staples, by two-dotted stapling, the recording sheet bundle S1 stacked on the width direction moving stacking portions 142, 152 by two sets of the width direction moving staple bending portions 144, 154 and the width direction moving staple driving portions 147, 157 moving together with the width direction moving stacking portions 142, 152. However, the present invention is not limited to the above specific example. For example, it is possible to execute two-dot-stapling in such a manner that the recording sheet bundle S1, which is stacked on the width direction moving stacking portions 142 and 152, is stapled at two different points by one set of width direction moving staple bending portion and the width direction moving staple driving portion capable of moving in the width direction independently from the width direction moving stacking portions 142, 152. In this connection, the recording sheet bundle S1 is subjected to the saddle stapling by two-dotted-stapling. However, the present invention is not limited to the above specific example. It is possible to execute the three-do ted-saddle stapling or the four-dotted-saddle stapling.

(H05) In this connection, in the above example, the medium bundle stapling member 161 of the saddle stapling device NTS executes the saddle stapling, while the stapling position is being shifted for each recording sheet bundle S1, by two sets of staple bending portions 144, 154 and staple driving portions 147, 157 moved in the width direction of the recording sheet bundle S1. However, the present invention is not limited to the above specific example. For example, the stapling position can be shifted in such that four sets of staple bending portions and staple driving portions, which are not moved in the width direction, are controlled and the saddle stapling is executed by two different sets of staple bending portions and staple driving portions for each recording sheet bundle S1.

(H06) In the above Example 1, the medium bundle stapling member 161 of the saddle stapling device NTS executes the saddle stapling by two sets of staple bending portions 144, 154 and staple driving portions 147, 157, which are moved in the width direction of the recording sheet bundle S1, while the stapling position is being shifted for each recording sheet bundle S1. However, the present invention is not limited to the above specific example. For example, the stapling position can be shifted in such a manner that two staple bending portions capable of being moved in the width direction independently from the staple driving portion are moved being controlled with respect to four staple driving portions not moving in the width direction and the saddle stapling is executed by a different combination of staple bending portion and staple driving portion for each recording sheet bundle S1. Further, for example, it is possible to change positions of the staple driving portion and the staple bending portion in the vertical direction. The stapling position can be shifted in the following manner. With respect to four staple bending portions not moving in the width direction, moving of two staple driving portions capable of moving in the width direction independently from the staple bending portion is controlled and the saddle stapling is executed by a different combination of the staple bending portion and the staple driving portion for each recording sheet bundle S1.

(H07) In the above Example 2, when a normal and a reverse rotation of the tamper driving motors MA7*a*, MA7*b* are controlled for independently moving the tampers 21, 22, the stacking position is changed for each recording sheet bundle S1. However, the present invention is not limited to the above specific example. For example, in the case where the recording sheet bundle S1 is discharged onto the stacker tray TH1 by the discharging roller 82, the discharging roller 82 is slid in the width direction of the recording sheet bundle S1, that is, a so-called offset processing is carried out. By carrying out the offset processing as described above, the stacking position can be changed for each recording sheet bundle S1.

(H08) In the above Example, the recording sheet bundle S1 on the medium bundle stapling member 161 is subjected to the saddle stapling under the condition that only arranging is executed on the compile tray 14. However, the present invention is not limited to the above specific example. For example, the recording sheet bundle S1, in which a fold is made by the folding unit U4, can be intermediately stapled.

(H09) In the above Example 1, when a normal and a reverse rotation of the tamper driving motors MA7*a*, MA7*b* are controlled for independently moving the tampers 21, 22, the side edge of the recording sheet bundle S1 carried onto the compile tray 14 is arranged. However, the present invention is not limited to the above specific example. For example, when one tamper is fixed and only the other tamper is moved for making the other tamper come close to the one tamper, the side edge of the recording sheet bundle S1 can be arranged.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a conveyed medium stacking portion into which a plurality of recording mediums, on which images are recorded, are conveyed and stacked;

a medium bundle stapling member that staples a medium bundle with staples for saddle stapling processing in which a central portion of the medium bundle in a conveyance direction of the medium bundle is stapled, the medium bundle being a bundle of the plurality of recording mediums stacked on the conveyed medium stacking portion, wherein the medium bundle stapling member comprises:

movement stacking portions that support the central portion of the medium bundle in the conveyance direction of the medium bundle;

staple driving portions that drive the staples for stapling the central portion of the medium bundle in the conveyance direction of the medium bundle; and staple bending portions that bend tips of the driven staples;

a medium bundle stacking portion that stacks the stapled medium bundle thereon, wherein the medium bundle stacking portion is located directly under the medium bundle stapling member so that the stapled medium bundle drops in a vertical direction from a supporting position at which the medium bundle is supported by the medium bundle stapling member; and a medium bundle stacking control unit that stacks a second medium bundle on a first medium bundle under the condition that a second stacking stapling position deviates from a first stacking stapling position in a width direction by a distance not less than a staple width, wherein the first medium bundle indicates the medium bundle stacked in the medium bundle stacking portion, the second medium bundle indicates the medium bundle conveyed to and stacked on the medium bundle stacking portion after the first medium bundle is stacked on the medium bundle stacking portion, the first stacking stapling position indicates positions of the staples in the first medium bundle stacked in the medium bundle stacking portion, the second stacking stapling position indicates positions of the staples in the second medium bundle stacked in the medium bundle stacking portion, and the staple width indicates a width of the staple in the width direction of the medium bundle perpendicular to a conveyance direction of the medium bundle.

2. The post-processing device according to claim 1, further comprising:

a medium bundle stapling member control unit that arranges the second stacking stapling position at a position deviating from the first stacking stapling position by a distance not less than the staple width in the width direction by controlling the medium stapling member so that a first stapling position and a second stapling position are shifted from each other in the width direction and the medium bundles are stapled, wherein the first stapling position is a position where the first medium bundle is stapled by a staple, and the second stapling position is a position where the second medium bundle is stapled by a staple.

3. The post-processing device according to claim 2, further comprising:

the medium bundle stapling member that is movable in the width direction; and wherein the medium bundle stapling member control unit controls a movement of the medium bundle stapling member in the width direction.

4. The post-processing device according to claim 1, wherein the medium bundle stacking control unit that arranges a second stacking position at a position deviating from a first stacking position in the width direction by a distance not less than the staple width by stacking the second medium bundle on the first medium bundle so that the first stacking position and the second stacking position are shifted in the width direction by a distance not less than the staple width, the first stacking position is a stacking position of the first medium bundle in the width direction, and the second stacking position is a stacking position of the second medium bundle in the width direction.

5. The post-processing device according to claim 4, further comprising:

a medium bundle moving member that is provided in the conveyed medium stacking portion and comes into contact with both end portions in the width direction of the medium bundle and arranges both end portions in order in the width direction and moves the medium bundle between the first stacking position and the second stacking position; and a medium bundle movement control unit for controlling a movement of the medium bundle between the first stacking position and the second stacking position through the medium bundle moving member.

6. The post-processing device according to claim 1, wherein the medium bundle stapling member is movable in a direction perpendicular to a conveyance direction of the medium bundle between a position corresponding to the first stacking stapling position and a position at the medium bundle is dropped.

7. The post-processing device according to claim 1, wherein the medium bundle stapling member staples the medium bundle with moving the position of staples and without moving the medium bundle.

8. The post-processing device according to claim 1, wherein the medium bundle stapling member has at least two sets of staple bending portions, each sets of the stapling bending portions corresponds to one of the first stapling position and the second stapling position.

9. The post-processing device according to claim 1, wherein the movement stacking portions move in the width direction in conformity to movements of the staple driving portions and the staple bending portions.

10. The post-processing device according to claim 1, wherein the medium bundle stapling member is formed of a pair of a first side medium bundle stapling member and a second side medium bundle stapling member, the medium bundle stapling member moves to a stapling position at which the pair come close to each other, and the medium bundle stapling member moves to a dropping position at which the pair is separated from each other.

* * * * *